US005951320A

United States Patent [19]

Crane, Jr.

[11] Patent Number: 5,951,320

[45] **Date of Patent: *Sep. 14, 1999**

[54] ELECTRICAL INTERCONNECT SYSTEM WITH WIRE RECEIVING PORTION

[76] Inventor: Stanford W. Crane, Jr., 3934 Northwest 57th Street, Boca Raton, Fla. 33496

[ * ] Notice: This patent is subject to a terminal disclaimer.

[21] Appl. No.: 08/855,368

[22] Filed: May 13, 1997

Related U.S. Application Data

[63] Continuation of application No. 08/469,763, Jun. 6, 1995, Pat. No. 5,641,309, which is a continuation of application No. 08/209,219, Mar. 11, 1994, abandoned, which is a continuation-in-part of application No. 07/983,083, Dec. 1, 1992, abandoned.

[51] Int. Cl.[6] ..... H01R 9/09

[52] U.S. Cl. ..... 439/405

[58] Field of Search ..... 439/660, 284–295, 439/931, 404, 405

[56] References Cited

U.S. PATENT DOCUMENTS

| | | | |
|---|---|---|---|
| 3,337,838 | 8/1967 | Damiano et al. | 339/217 |
| 3,366,915 | 1/1968 | Miller | 339/49 |
| 3,444,506 | 5/1969 | Wedekind | 339/99 |
| 3,848,221 | 11/1974 | Lee, Jr. | 339/74 R |
| 4,274,700 | 6/1981 | Keglewitsch et al. | 339/192 R |
| 4,487,463 | 12/1984 | Tillotson | 339/17 C |

(List continued on next page.)

FOREIGN PATENT DOCUMENTS

| | | |
|---|---|---|
| 0 321 212 | 6/1989 | European Pat. Off. . |
| 0 405 454 A2 | 1/1991 | European Pat. Off. . |
| 0 467 698 | 1/1992 | European Pat. Off. . |
| 3737819 A1 | 5/1988 | Germany . |
| 1129608 | 10/1968 | United Kingdom . |
| WO 94/13034 | 6/1994 | WIPO . |
| WO 94/27345 | 11/1994 | WIPO . |

OTHER PUBLICATIONS

AMP Product Guide, Printed Circuited Board Connectors 3, pp. 3008, 3067–3068, 3102–3103, 3122–3123.

George D. Gregoire, "3–Dimensional Circuitry Solves Fine Pitch SMT Device Assembly Problem;" Connection Technology.

George D. Gregoire, "Very Fine Line Recessed Circuitry—A New PCB Fabriction Process".

Robert Barnhouse, "Bifurcated Through–Hole Technology—An Innovative Solution to Circuit Density," Connection Technology, pp. 33–35 (Feb., 1992).

AMP Product Information Bulletin, "AMP–ASC Interconnection Systems," pp. 1–4 (1991).

AMP Product Guide, "Micro–Strip Interconnection System," pp. 3413–3414 (Jun., 1991).

(List continued on next page.)

*Primary Examiner*—Neil Abrams

*Attorney, Agent, or Firm*—Morgan, Lewis & Bockius LLP

[57] ABSTRACT

An electrical interconnect component and system is disclosed. The electrical interconnect component and system includes a support element, an array of groups of multiple receiving-type electrically conductive contacts held by the support element, each of the receiving-type electrically conductive contacts having a contact portion and tail portion. The receiving-type electrically conductive contacts of each group of contacts are circumferentially arranged such that a projection-type interconnect component may be received therein. The contact portion of each receiving-type electrically conductive contact is adapted to contact a corresponding electrically conductive contact of the projection-type interconnect component. The tail portion of each receiving-type electrically conductive contact includes a blade having a forked end that is adapted to receive and provide electrical contact to a wire. The blades of the electrically conductive contacts within each group being parallel to each other.

17 Claims, 59 Drawing Sheets

U.S. PATENT DOCUMENTS

| | | | |
|---|---|---|---|
| 4,572,604 | 2/1986 | Ammon et al. | 339/176 MP |
| 4,616,406 | 10/1986 | Brown | 29/588 |
| 4,648,673 | 3/1987 | Endo et al. | 439/395 |
| 4,654,472 | 3/1987 | Goldfarb | 174/52 R |
| 4,655,526 | 4/1987 | Shaffer | 339/74 R |
| 4,698,663 | 10/1987 | Sugimoto et al. | 357/81 |
| 4,734,042 | 3/1988 | Martens et al. | 439/62 |
| 4,897,055 | 1/1990 | Jurista et al. | 439/924 |
| 4,943,846 | 7/1990 | Shirling | 357/80 |
| 4,959,750 | 9/1990 | Cnyrim et al. | 361/401 |
| 4,975,066 | 12/1990 | Sucheski et al. | 439/63 |
| 4,997,376 | 3/1991 | Buck et al. | 439/59 |
| 5,015,207 | 5/1991 | Koepke | 439/886 |
| 5,037,311 | 8/1991 | Frankeny et al. | 439/66 |
| 5,071,363 | 12/1991 | Reylek et al. | 439/291 |
| 5,081,563 | 1/1992 | Feng et al. | 361/414 |
| 5,088,934 | 2/1992 | Chow et al. | 439/395 |
| 5,117,069 | 5/1992 | Higgins, III | 174/261 |
| 5,123,164 | 6/1992 | Shaheen et al. | 29/852 |
| 5,137,456 | 8/1992 | Desai et al. | 439/66 |
| 5,281,151 | 1/1994 | Arima et al. | 439/68 |
| 5,309,024 | 5/1994 | Hirano | 257/773 |
| 5,326,936 | 7/1994 | Taniuchi et al. | 174/260 |
| 5,330,372 | 7/1994 | Pope et al. | 439/692 |
| 5,334,279 | 8/1994 | Gregoire | 156/630 |
| 5,342,999 | 8/1994 | Frei et al. | 174/266 |
| 5,351,393 | 10/1994 | Gregoire | 29/835 |
| 5,371,404 | 12/1994 | Juskey et al. | 257/659 |
| 5,376,825 | 12/1994 | Tukamoto et al. | 257/685 |
| 5,390,412 | 2/1995 | Gregoire | 29/848 |

OTHER PUBLICATIONS

Du Pont Connector Systems Product Catalog A, "Rib–Cage II Through–Mount Shrouded Headers" and "Micropax Board–to–board Interconnect System," pp. 2–6, 3–0, 3–1 (Feb., 1992).

R.R. Tummala et al., "Microelectronics Packaging Handbook," Van Nostrand Reinhold, 1989, pp. 38–43, 398–403, 779–791, 853–859, and 900–905.

Intel Corporation, "Packing," pp. 2–36, 2–96, 2–97, 2–100, 3–2, 3–24, and 3–25; (1993).

ELECTRICAL INTERCONNECT SYSTEM WITH WIRE RECEIVING PORTION

RELATED APPLICATION

This is a continuation of application Ser. No. 08/469,763, filed on Jun. 6, 1995, now issued as U.S. Pat. No. 5,641,309, which is a continuation of application Ser. No. 08/209,219, filed Mar. 11, 1994, now abandoned, which is continuation-in-part of application Ser. No. 07/983,083, filed on Dec. 1, 1992, now abandoned.

BACKGROUND OF THE INVENTION

1. Field of the Invention

The present invention relates to a plug-in electrical interconnect system and, in particular, to interconnect components used in the plug-in electrical interconnect system and the manner in which such interconnect components are arranged in relation to one another. Although the electrical interconnect system of the present invention is particularly suitable for use in connection with high-density systems, it may also be used with high-power systems or other systems.

2. Description of the Related Art

Electrical interconnect systems (including electronic interconnect systems) are used for interconnecting electrical and electronic systems and components. In general, electrical interconnect systems contain both a projection-type interconnect component, such as a conductive pin, and a receiving-type interconnect component, such as a conductive socket. In these types of electrical interconnect systems, electrical interconnection is accomplished by inserting the projection-type interconnect component into the receiving-type interconnect component. Such insertion brings the conductive portions of the projection-type and receiving-type interconnect components into contact with each other so that electrical signals may be transmitted through the interconnect components. In a typical interconnect system (e.g., the grid array of FIG. 31, discussed below), a plurality of individual conductive pins are positioned in a grid formation and a plurality of individual conductive sockets (not shown in FIG. 31) are arranged to receive the individual pins, with each pin and socket pair transmitting a different electrical signal.

High-density electrical interconnect systems are characterized by the inclusion of a large number of interconnect component contacts within a small area. By definition, high-density electrical interconnect systems take up less space and include shorter signal paths than lower-density interconnect systems. The short signal paths associated with high-density interconnect systems allow such systems to transmit electrical signals at higher speeds. In general, the higher the density of an electrical interconnect system, the better the system.

Various attempts have been made in the past at producing an electrical interconnect system having a suitably high density. One electrical interconnect system that has been proposed is shown in FIG. 1(*a*).

The electrical interconnect system of FIG. 1(*a*) is known as a post and box interconnect system. In the system of FIG. 1(*a*), the projection-type interconnect component is a conductive pin or post 101, and the receiving-type interconnect component is a box-shaped conductive socket 102. FIG. 1(*b*) is a top view of the interconnect system of FIG. 1(*a*) showing the post 101 received within the socket 102. As can be seen from FIG. 1(*b*), the inner walls of the socket 102 include sections 103 and 104 which protrude inwardly to allow a tight fit of the post 101 within the socket. FIGS. 1(*a*) and 1(*b*) are collectively referred to herein as "FIG. 1."

Another electrical interconnect system that has been proposed is illustrated in FIG. 2(*a*). The electrical interconnect system of FIG. 2(*a*) is known as a single beam interconnect system. In the system of FIG. 2(*a*), the projection-type interconnect component is a conductive pin or post 201, and the receiving-type interconnect component is a conductive, flexible beam 202. FIG. 2(*b*) is a top view of the interconnect system of FIG. 2(*a*) showing the post 201 positioned in contact with flexible beam 202. The flexible beam 202 is biased against the post 201 to maintain contact between the flexible beam and the post. FIGS. 2(*a*) and 2(*b*) are collectively referred to herein as "FIG. 2."

A third electrical interconnect system that has been proposed is shown in FIG. 3(*a*). The electrical interconnect system shown in FIG. 3(*a*) is known as an edge connector system. The projection-type interconnect component of the edge connector system includes an insulative printed wiring board 300 and conductive patterns 91 formed on the upper and/or lower surfaces of the printed wiring board. The receiving-type interconnect component of the edge connector system includes a set of upper and lower conductive fingers 302 between which the printed wiring board 300 may be inserted.

FIG. 3(*b*) is a side view of the system illustrated in FIG. 3(*a*) showing the printed wiring board 300 inserted between the upper and lower conductive fingers 302. When the printed wiring board 300 is inserted between the conductive fingers, each conductive pattern 91 contacts a corresponding conductive finger 302 so that signals may be transmitted between the conductive patterns and the conductive fingers. FIGS. 3(*a*) and 3(*b*) are collectively referred to herein as "FIG. 3"

A fourth electrical interconnect system that has been proposed is shown in FIG. 4. The electrical interconnect system shown in FIG. 4 is known as a pin and socket interconnect system. In the system of FIG. 4, the projection-type interconnect component is a conductive, stamped pin 401, and the receiving-type interconnect component is a conductive, slotted socket 402. The socket 402 is typically mounted within a through-hole formed in a printed wiring board. The pin 401 is oversized as compared to the space within the socket 402. The size differential between the pin 401 and the space within the socket 402 is intended to allow the pin to fit tightly within the socket.

The interconnect systems of FIGS. 1 through 4 are deficient for a variety of reasons. The main problem associated with the systems of FIGS. 1 through 4 is that these systems are not high enough in density to meet the needs of existing and/or future semiconductor and computer technology. Interconnect system density has already failed to keep pace with semiconductor technology, and as computer and microprocessor speeds continue to climb, with space efficiency becoming increasingly important, electrical interconnect systems having even higher densities and higher pin counts will be required. The electrical interconnect systems discussed above fall short of current and contemplated interconnect density and pin number requirements.

Moreover, the interconnect components in the systems of FIGS. 1 through 4 generally include plating on each external and internal surface to ensure adequate electrical contact between the projection-type and receiving-type components. Since plating is typically accomplished using gold or other expensive metals, the systems of FIGS. 1 through 4 can be quite costly to manufacture.

Performance-wise, the grid arrangements generally associated with FIGS. 1 and 2 are not dense enough to provide an adequate number of grounded contacts and, consequently, signal transmission problems can result. Furthermore, the edge connector system of FIG. 3 is subject to capacitance problems and electromagnetic interference. Likewise, the pin and socket system of FIG. 4 requires a high insertion-force to insert the pin 401 within the slotted socket 402, and will not fit together properly in the absence of near-perfect tolerancing.

SUMMARY OF THE INVENTION

Accordingly, it is a goal of the present invention to provide a high-density electrical interconnect system capable of meeting the needs of existing and contemplated computer and semiconductor technology.

Another goal of the present invention is to provide an electrical interconnect system that is less costly and more efficient than existing high-density electrical interconnect systems. Higher density and lower cost would also mean that more pins could be used to add better functionality and performance.

Yet another goal of the present invention is to provide an electrical interconnect system wherein high-density is achieved through the use of electrical interconnect components arranged in a nested configuration or the like.

These and other goals may be achieved by using an electrical interconnect system comprising a first support element; a first array of groups of multiple electrically conductive contacts arranged on the first support element, wherein the groups of the first array are arranged such that at least one contact of each group includes a front surface facing outwardly and away from that group along a line initially intersected by a side surface of a contact from another one of the groups of the first array; a second support element; and a second array of groups of multiple electrically conductive contacts arranged on the second support element, wherein the groups of the second array are arranged such that at least one contact of each group of the second array includes a front surface facing outwardly and away from that group along a line initially intersected by a side surface of a contact from another one of the groups of the second array, and each group of contacts from the first array may mate with a corresponding one of the groups of contacts from the second array.

Such goals may also be achieved by using an electrical interconnect system comprising a support element; and an array of groups of multiple electrically conductive contacts arranged on the support element such that at least one contact of each group includes a front surface facing outwardly and away from that group along a line initially intersected by a side surface of a contact from another one of the groups of the array.

Methods of making and using electrical interconnect systems having characteristics such as those discussed above may also be carried out for the purpose of achieving the aforementioned goals.

It is to be understood that both the foregoing general description and the following detailed description are exemplary and explanatory, and are not restrictive of the invention as claimed. The accompanying drawings, which are incorporated in and constitute a part of the specification, illustrate embodiments of the present invention and together with the general description, serve to explain the principles of the present invention.

BRIEF DESCRIPTION OF THE DRAWINGS

FIG. 1(*b*) is a top view of the conventional electrical interconnect system shown in FIG. 1(*a*) when mated.

FIG. 2(*b*) is a top view of the conventional electrical interconnect system shown in FIG. 2(*a*).

FIG. 3(*b*) is a side view of the conventional electrical interconnect system shown in FIG. 3(*a*).

FIG. 5(*b*) is a side view of a buttress portion of the projection-type interconnect component shown in FIG. 5(*a*).

FIG. 5(*c*) is a side view of two projection-type interconnect components in accordance with the embodiment of the present invention shown in FIG. 5(*a*).

FIG. 11(*b*) is a diagram showing patterns associated with the foot port ions of alternating right-angle projection-type electrical interconnect components.

FIG. 12(*b*) is a perspective view of a projection-type electrical interconnect component in accordance with still another embodiment of the p resent invention.

FIG. 13(*b*) is a perspective view of a projection-type electrical interconnect component in accordance the embodiment of FIG. 5(*a*) and a projection-type interconnect component in accordance with still another embodiment of the present invention.

FIG. 13(*c*) is a perspective view of a portion of one of the a projection-type electrical interconnect components shown in FIG. 13(*b*) with the tip portion of the component removed.

FIG. 23(*b*) is a perspective view of the low-insertion-force or zero-insertion-force component of FIG. 23(*a*) in a second state.

FIG. 23(*c*) is a perspective view of the first type of low-insertion-force or zero-insertion-force component using a straight member.

FIG. 24(*b*) is a perspective view of the low-insertion-force or zero-insertion-force component of FIG. 24(*a*) in a second state.

FIG. 24(*c*) is a perspective view of the second type of low-insertion-force or zero-insertion-force component using a straight member.

FIG. 25(*b*) is a perspective view of the low-insertion-force or zero-insertion-force component of FIG. 25(*a*) in a second state.

FIG. 26(*b*) is a perspective view of an interconnect system including the interconnect component of FIG. 12(*a*) in the mated condition.

FIG. 27(*b*) is a perspective view of another interconnect system including the interconnect component of FIG. 13(*a*) in a position prior to mating.

FIG. 27(*c*) is a perspective view of an interconnect system including the interconnect component of FIG. 13(*a*) after mating.

FIG. 28(*b*) is a perspective view of the conductive contacts of hybrid interconnect components prior to mating.

FIG. 29(*b*) is a top view of a projection-type interconnect component in accordance with the present invention.

FIG. 30(*b*) is a perspective view of another electrical interconnect system showing insulative electrical carriers functioning as the substrates for the system.

FIG. 33(*b*) is a view of an arrangement of electrical interconnect components in accordance with the present invention.

FIG. 41(*b*) is a view of an arrangement of electrical interconnect components in accordance with the modified arrangement of FIG. 35 modified to include a space at a center portion thereof.

FIG. 48(*b*) is a top view of an arrangement of projection-type electrical interconnect components in accordance with the illustration in FIG. 12(*b*).

FIG. 48(*c*) is a top view of an arrangement of projection-type electrical interconnect components in accordance with the illustration in FIG. 12(*b*).

FIG. 48(*d*) is a top view of an arrangement of projection-type electrical interconnect components in accordance with the illustration in FIG. 12(*b*).

FIG. 50(*b*) is a side view of a conductive post having an offset foot portion.

DESCRIPTION OF THE PREFERRED EMBODIMENTS

GENERAL DESCRIPTION

The electrical interconnect system of the present invention includes a plurality of conductive contacts arranged in groups, and each group may be interleaved or nested within other groups of contacts of the electrical interconnect system to form an interleaved or nested arrangement of the groups of contacts. The groups of contacts may be positioned within the interleaved or nested arrangement such that the groups are arranged in rows and columns, the groups of adjacent rows of the arrangement are staggered as are the groups from adjacent columns of the arrangement, and the groups are interleaved among one another in a nested configuration such that a portion of each group overlaps into an adjacent row of the groups or an adjacent column of the groups. Moreover, the groups of contacts may be arranged such that at least one contact of each group includes a front surface facing outwardly and away from that group along a line initially intersected by a side surface of a contact from another one of the group 5 of the arrangement.

Each group of conductive contacts may constitute the conductive C section of a projection-type interconnect component that is configured for receipt within a corresponding receiving-type interconnect component which includes a plurality of conductive beams or, alternatively, each group of conductive contacts may constitute the conductive section of a receiving-type interconnect component configured to receive a corresponding projection-type interconnect component. The conductive beams mate with the conductive posts when a projection-type interconnect component is received within a corresponding receiving-type interconnect component.

THE PROJECTION-TYPE INTERCONNECT COMPONENT

The projection-type interconnect component of the present invention includes several electrically conductive posts attached to an electrically insulative substrate. The projection-type interconnect component may also include an electrically insulative buttress around which the conductive posts are positioned, although use of an insulative buttress is optional. The substrate and the buttress insulate the conductive posts from one another so that a different electrical signal may be transmitted on each post.

Figure 1A:
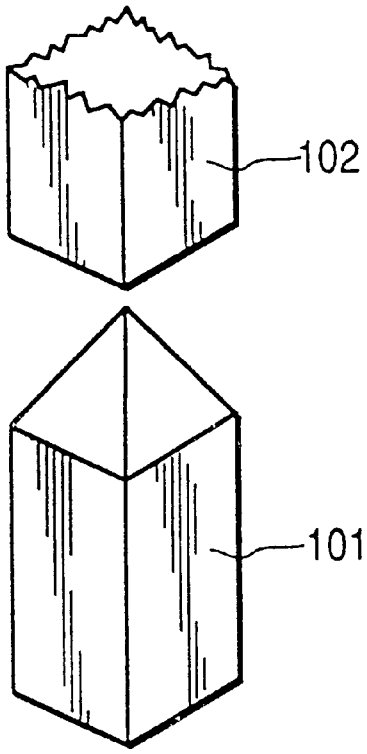
FIG. 1(a) PRIOR ART
FIG. 1(*a*) is a perspective view illustrating a conventional electrical interconnect system prior to mating.
Figure 1B:
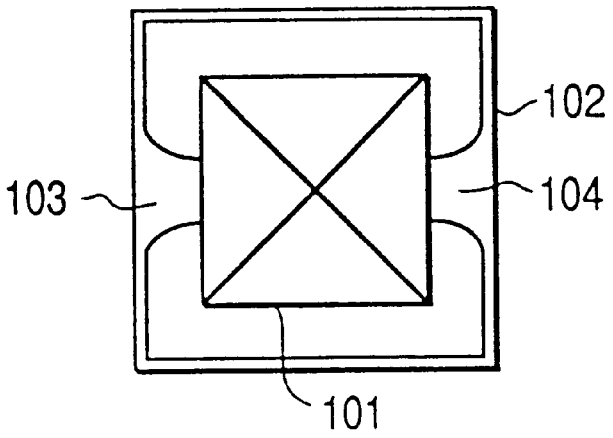
FIG. 1(b) PRIOR ART
Figure 2A:
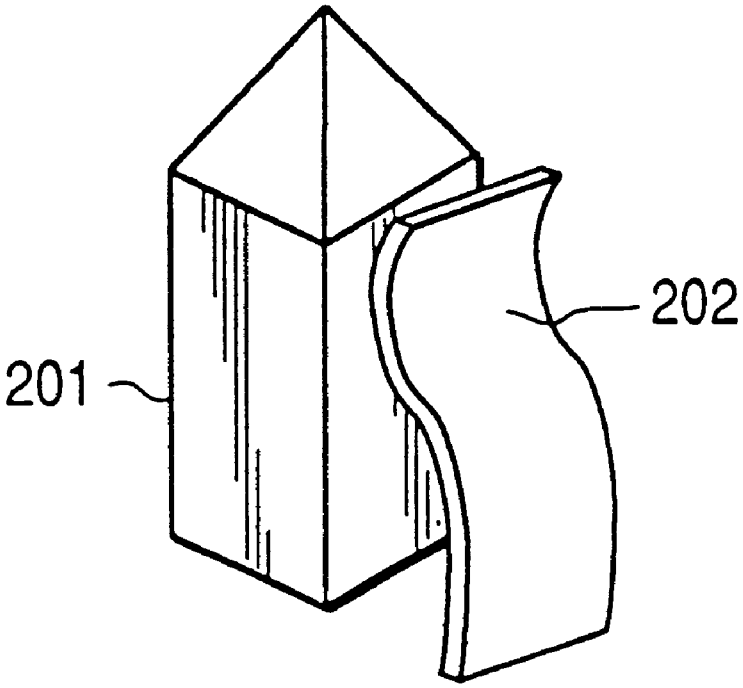
FIG. 2(a) PRIOR ART
FIG. 2(*a*) is a perspective view illustrating another conventional electrical interconnect system.
Figure 2B:
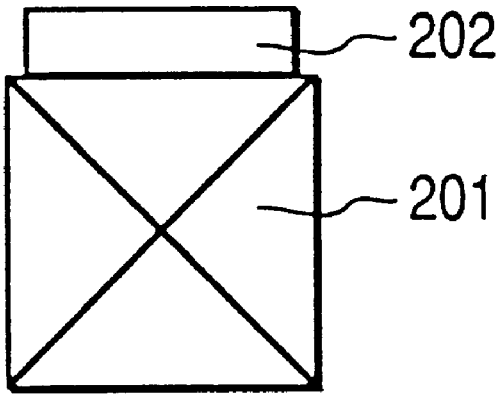
FIG. 2(b) PRIOR ART
Figure 3A:
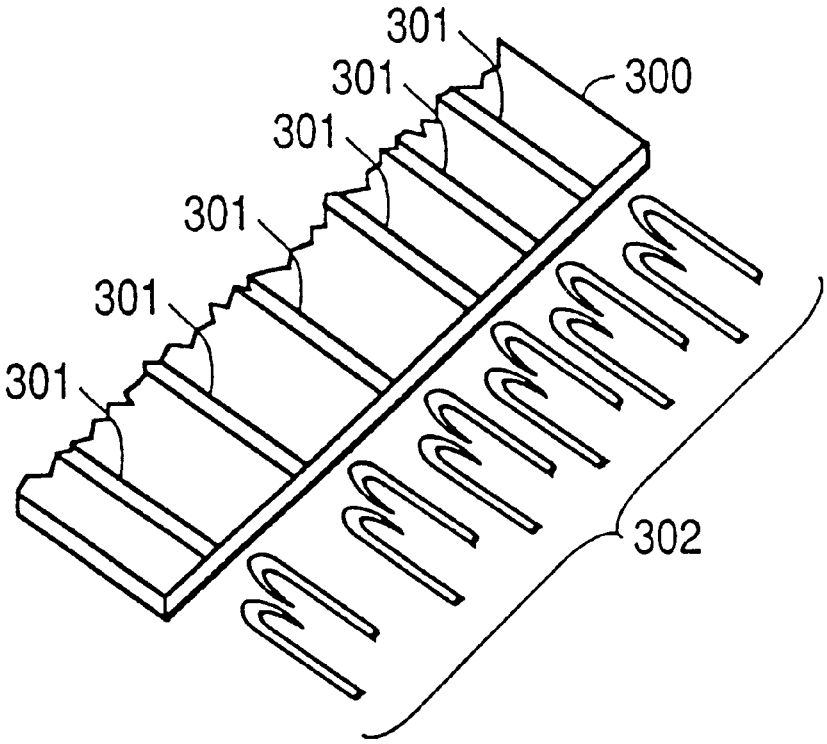
FIG. 3(a) PRIOR ART
FIG. 3(*a*) is a perspective view illustrating yet another conventional electrical interconnect system.
Figure 3B:
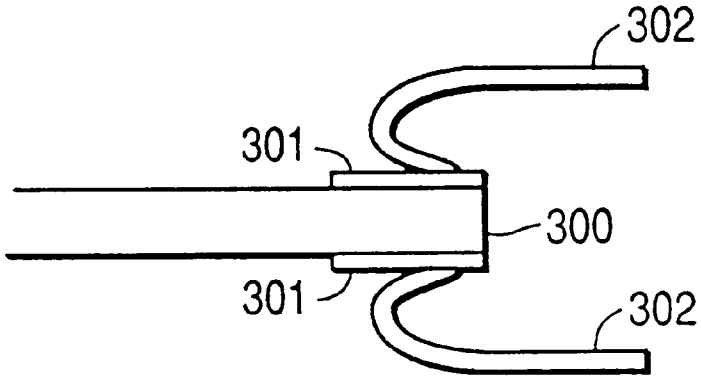
FIG. 3(b) PRIOR ART
Figure 4:
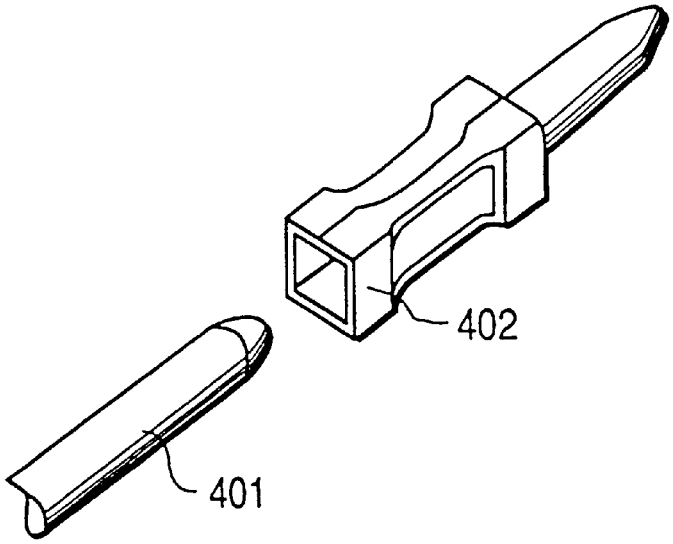
FIG. 4 PRIOR ART
FIG. 4 is a perspective view illustrating still another conventional electrical interconnect system prior to mating.
Figure 5B:
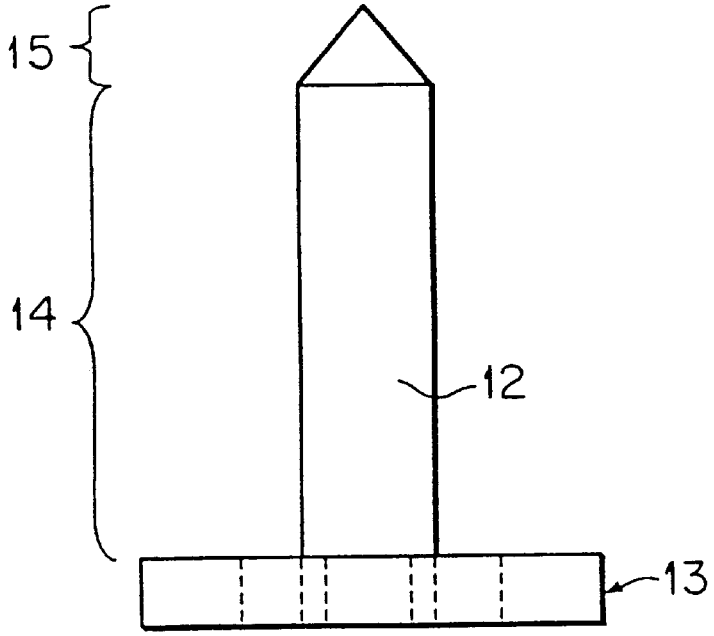
FIG. 5(*a*) is a perspective view of a portion of a projection-type interconnect component in accordance with an embodiment of the present invention.
Figure 5A:
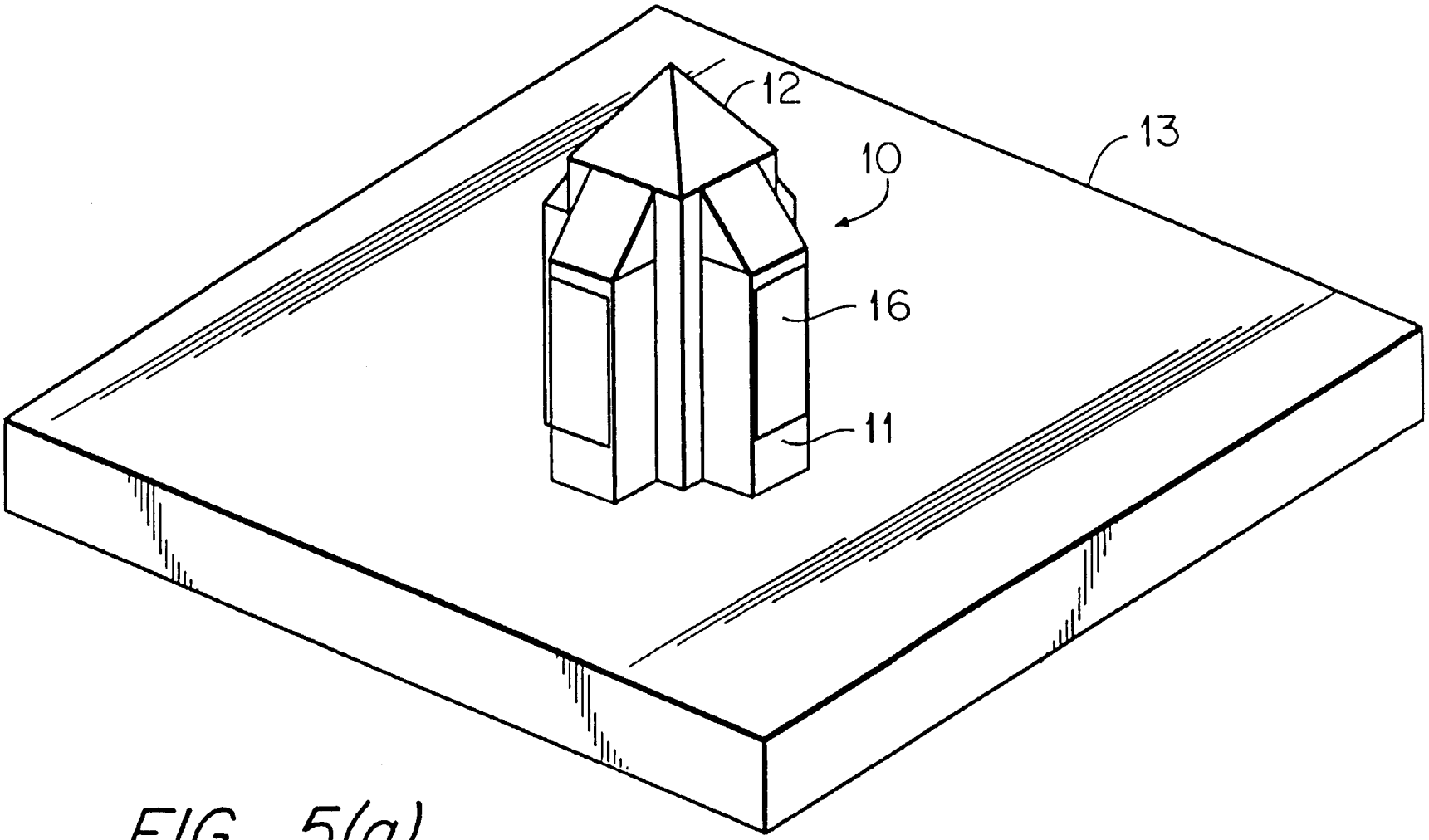
Figure 5C:
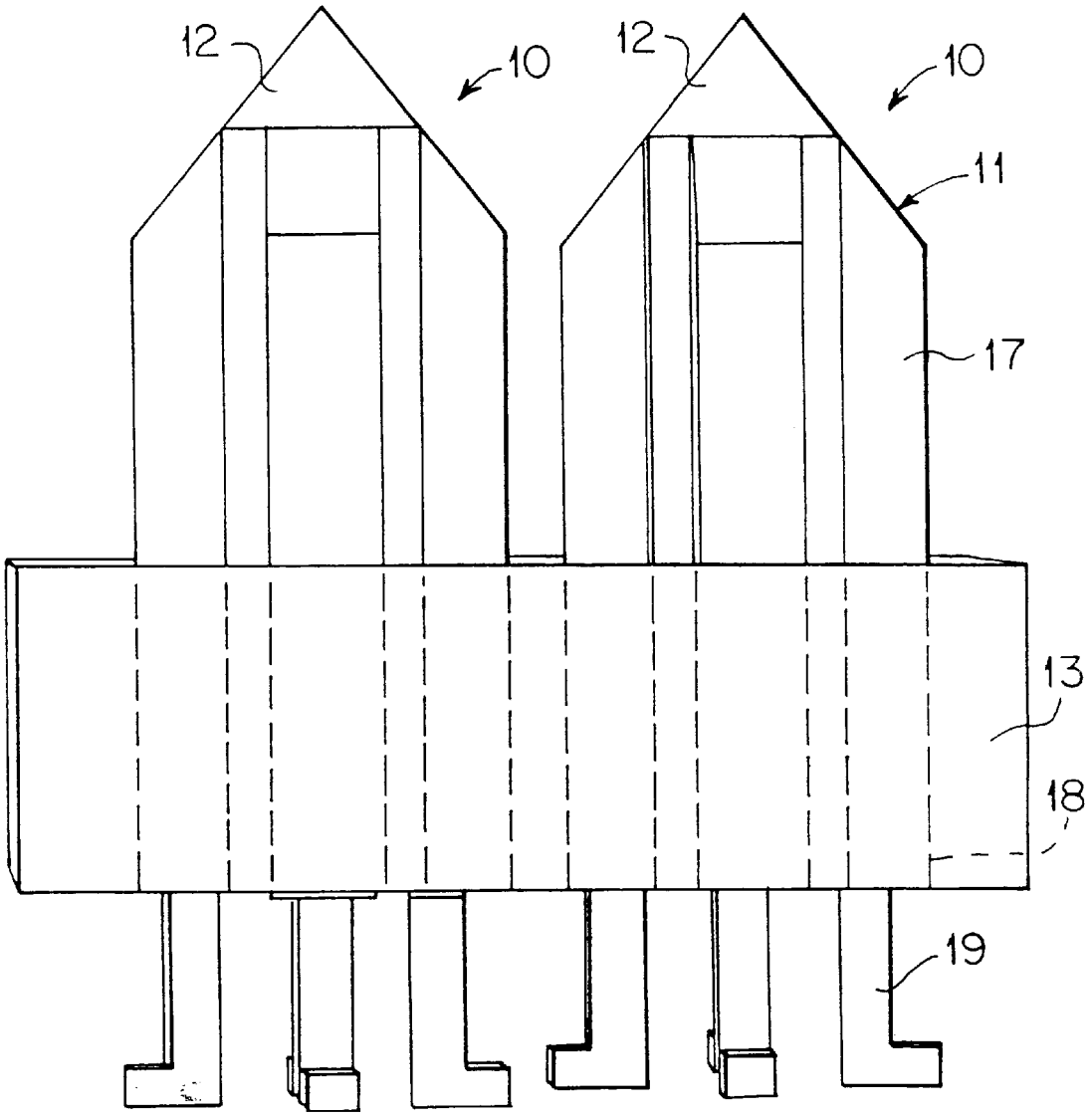

FIG. 5(*a*) is a perspective view of a portion of a projection-type interconnect component 10 in accordance with an embodiment of the present invention. The projection-type interconnect component includes several conductive posts 11. The projection-type interconnect component may also include an insulative buttress 12, although, in accordance with the discussion above, use of a buttress in the embodiment of FIG. 5(*a*) is not required. The conductive posts and the buttress (when used) are attached to an insulative substrate 13. The conductive posts are electrically isolated from one another by the substrate 13 and the buttress 12 (when used).

FIG. 5(*b*) is a side view of the buttress 12 and the insulative substrate 13. The buttress 12 and the substrate 13 may be integrally molded from a single unit of insulative material. Preferably, the material of the buttress and the substrate is an insulative material that does not shrink when molded (for example, a liquid crystal polymer such as VECTRA, which is a trademark of Hoescht Celanese). The conductive posts 11 are inserted into the substrate 13 through holes in the substrate represented by the dotted lines in FIG. 5(*b*) or, alternatively, the substrate may be formed around the posts using an insert molding procedure.

As seen from FIG. 5(*b*), the buttress 12 includes an elongated portion 14 having a rectangular (e.g., square) cross-section, and a tip portion 15 located at the top of the elongated portion. The buttress dimensions shown in FIG. 5(*b*) are exemplary and, accordingly, other dimensions for buttress 12 may be used. For example, the cross-section of the buttress 12 may be 0.5 mm×0.5 mm rather than the illustrated dimensions of 0.9 mm×0.9 mm.

Each conductive post 11 includes three sections: a contact portion, a stabilizing portion, and a foot portion. In FIG. 5(*a*), the contact portion of each conductive post is shown in a position adjacent the buttress 12. The stabilizing portion (not shown in FIG. 5(*a*) or FIG. 5(*b*)) is the portion of each post that is secured to the substrate 13. The foot portion (not shown in FIG. 5(*a*) or FIG. 5(*b*)) extends from the side of the substrate opposite the contact portion. The conductive posts may have a rectangular (e.g., square) cross-section, or a cross-section that is triangular, semicircular, or some other shape.

The three portions of each conductive post 11 can be seen more clearly in FIG. 5(*c*), which is a side view of two projection-type interconnect components 10 attached to the substrate 13. In FIG. 5(*c*), reference numeral 17 designates the contact portion of each conductive post 11; reference numeral 18 designates the stabilizing portion of each conductive post; and reference numeral 19 designates the foot portion of each conductive post. When the projection-type interconnect component is received within a corresponding receiving-type interconnect component, electrical signals may be transferred from the foot portion of each conductive post 11 through the stabilizing and contact portions of that post to the receiving-type interconnect component, and v; e versa.

Each conductive post 11 may be formed of beryllium copper, phosphor bronze, brass, a copper alloy, tin, gold, palladium, or any other suitable metal or conductive material. In a preferred embodiment, each conductive post 11 is formed of beryllium copper, phosphor bronze, brass, or a copper alloy, and plated with tin, gold, palladium, nickel, or a combination including at least two of tin, gold, palladium, or nickel. The entire surface of each post may be plated, or just a selected portion 16 (see, for example, FIG. 5(*a*)) corresponding to the portion of conductive post 11 that will contact a conductive beam when the projection-type interconnect component is received within the corresponding receiving-type interconnect component.

Figure 6:
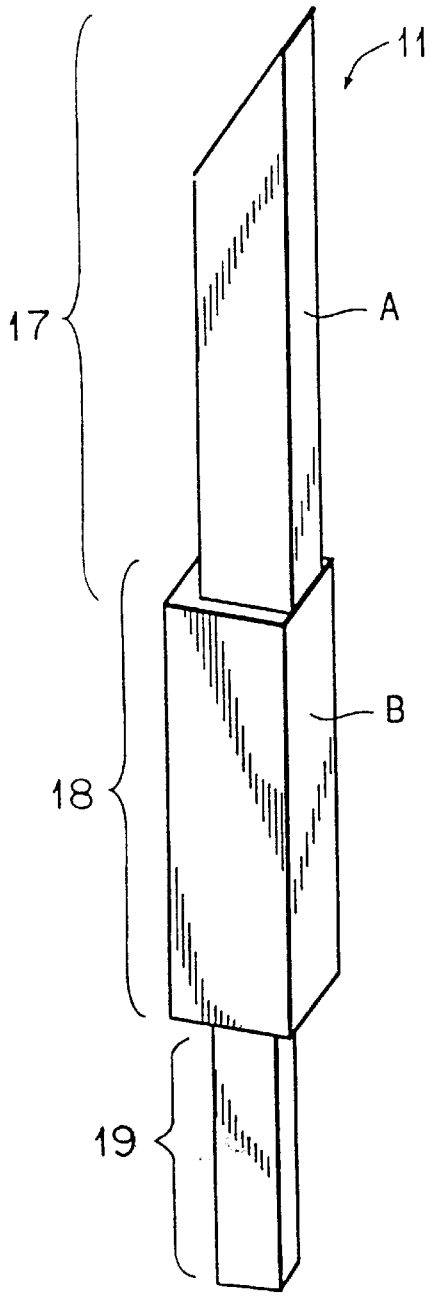
FIG. 6 is a perspective view of a conductive post that may be used in the electrical interconnect system of the present invention.

A conductive post 11 that may be used in the electrical interconnect system of the present invention is shown in FIG. 6. The post 11 of FIG. 6 is a non-offset or straight post, so-called because the respective surfaces A and B of the contact portion 17 and stabilizing portion 18 which face toward the interior of the projection-type interconnect component for that post are in alignment (i.e., surfaces A and B are coplanar).

Figure 7:
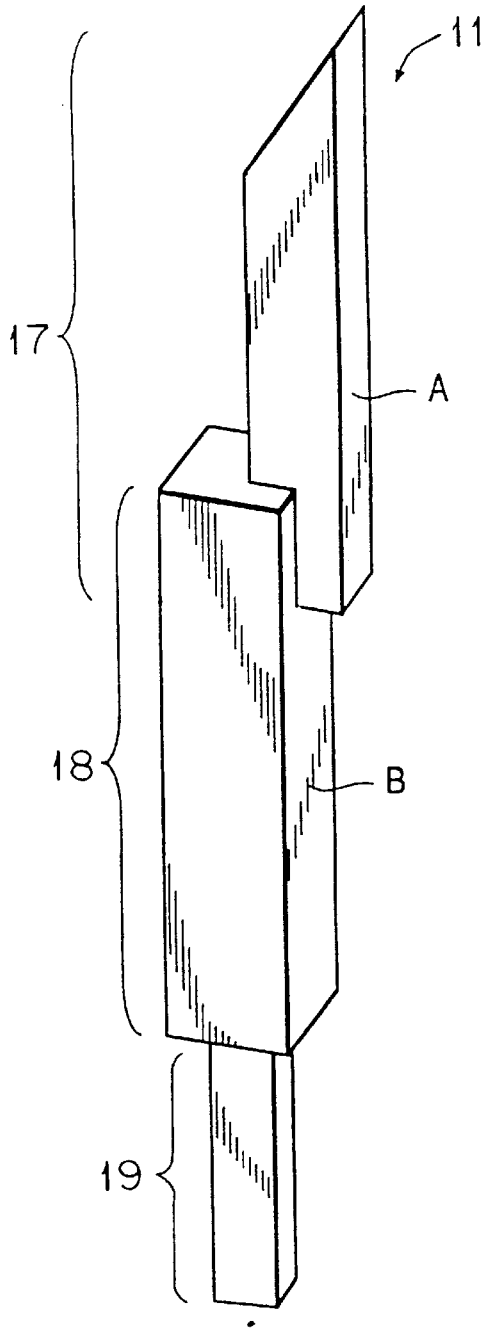
FIG. 7 is a perspective view of another conductive post that may be used in the electrical interconnect system of the present invention.

Another conductive post that may be used in the electrical interconnect system of the present invention is shown in FIG. 7. The conductive post 11 of FIG. 7 is called an offset post because the surface A of the contact portion 17 which faces toward the interior of the projection-type interconnect component for that post is offset in the direction of the interior as compared to the surface B of the stabilizing portion 18 which faces in the direction of the interior. In the post 11 of FIG. 7, surfaces A and B are not coplanar.

The offset post of FIG. 7 is used in situations where the buttress 12 of the projection-type interconnect component 10 is extremely small, or the projection-type interconnect component does not include a buttress, to achieve an ultra high-density. In situations other than these, the straight post of FIG. 6 may be used.

The different portions of each conductive post 11 each perform a different function. The contact portion 17 establishes contact with a conductive beam of the receiving-type interconnect component when the projection-type and receiving-type interconnect components are mated. The stabilizing portion 18 secures the conductive post to the substrate 13 during handling, mating, and manufacturing. The stabilizing portion 18 is of a dimension that locks the post into the substrate 13 while allowing an adequate portion of the insulative substrate to exist between adjacent conductive posts. The foot portion 19 connects to an interface device (e.g., a semiconductor chip, a printed wiring board, a wire, or a round, flat, or flex cable) using the electrical interconnect system as an interface. The contact and foot portions may be aligned or offset with respect to the stabilizing portion to provide advantages that will be discussed in detail below.

Figure 8:
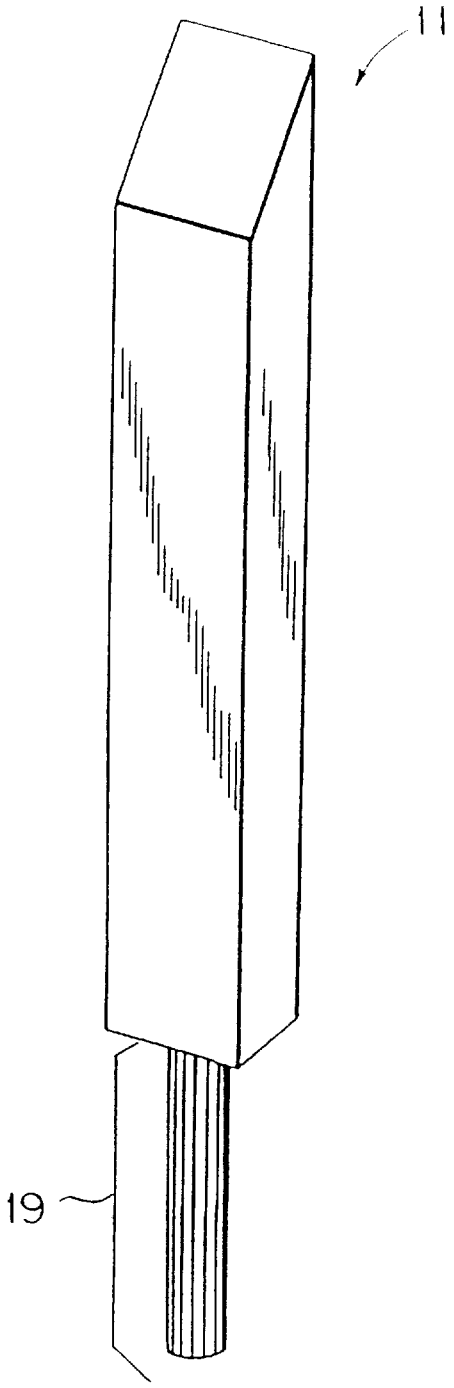
FIG. 8 is a perspective view of a conductive post in accordance with the present invention having a rounded foot portion.
Figure 9:
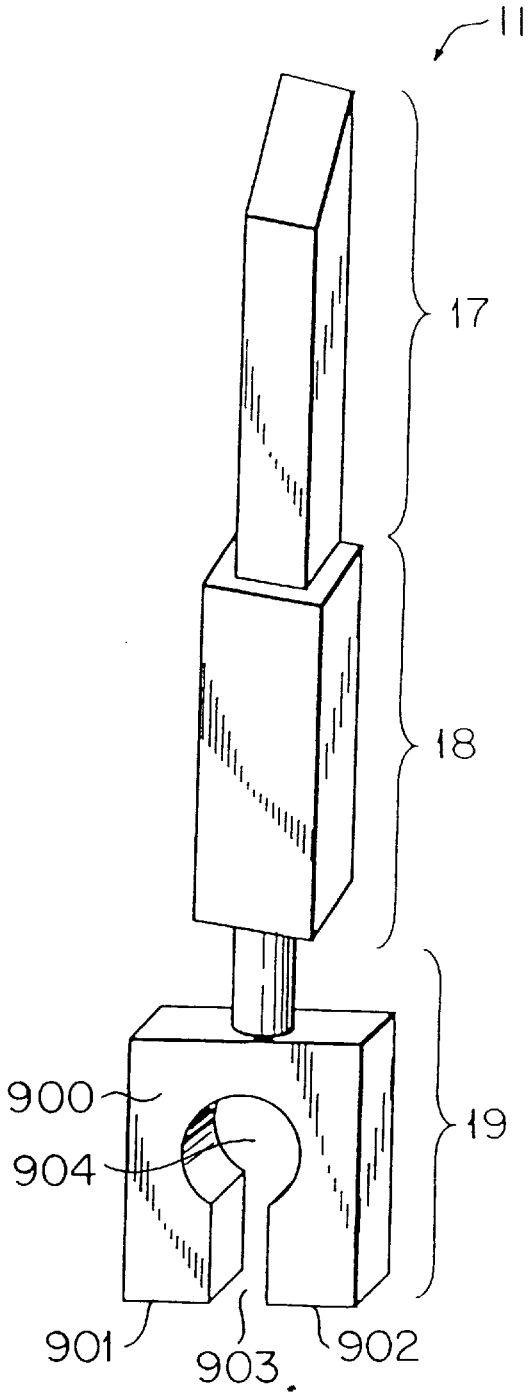
FIG. 9 is a perspective view of a conductive post in accordance with the present invention having a foot portion configured to interface with a round wire or cable.

The configuration of the foot portion 19 of each conductive post 11 depends on the type of device with which that foot portion is interfacing. For example, the foot portion 19 will have a rounded configuration (FIG. 8) if interfacing with a through-hole of a printed wiring board. The foot portion 19 will be configured as in FIG. 5(*c*) if interfacing with a printed wiring board through a surface mount technology (SMT) process. If interfacing with a round cable or wire, the foot portion 19 may be configured as in FIG. 9. As shown in FIG. 9, foot portion 19 may comprise blade 900 having forked end projections 901 and 902 extending therefrom. As also shown in FIG. 9, forked end projections 901 and 902 are separated by a slot comprised of channel 903 and semi-circular wire receiving portion 904 so as to interface with a wire or round cable as mentioned above. Other configurations may be used depending on the type of device with which the foot portion 19 is interfacing.

Figure 10:
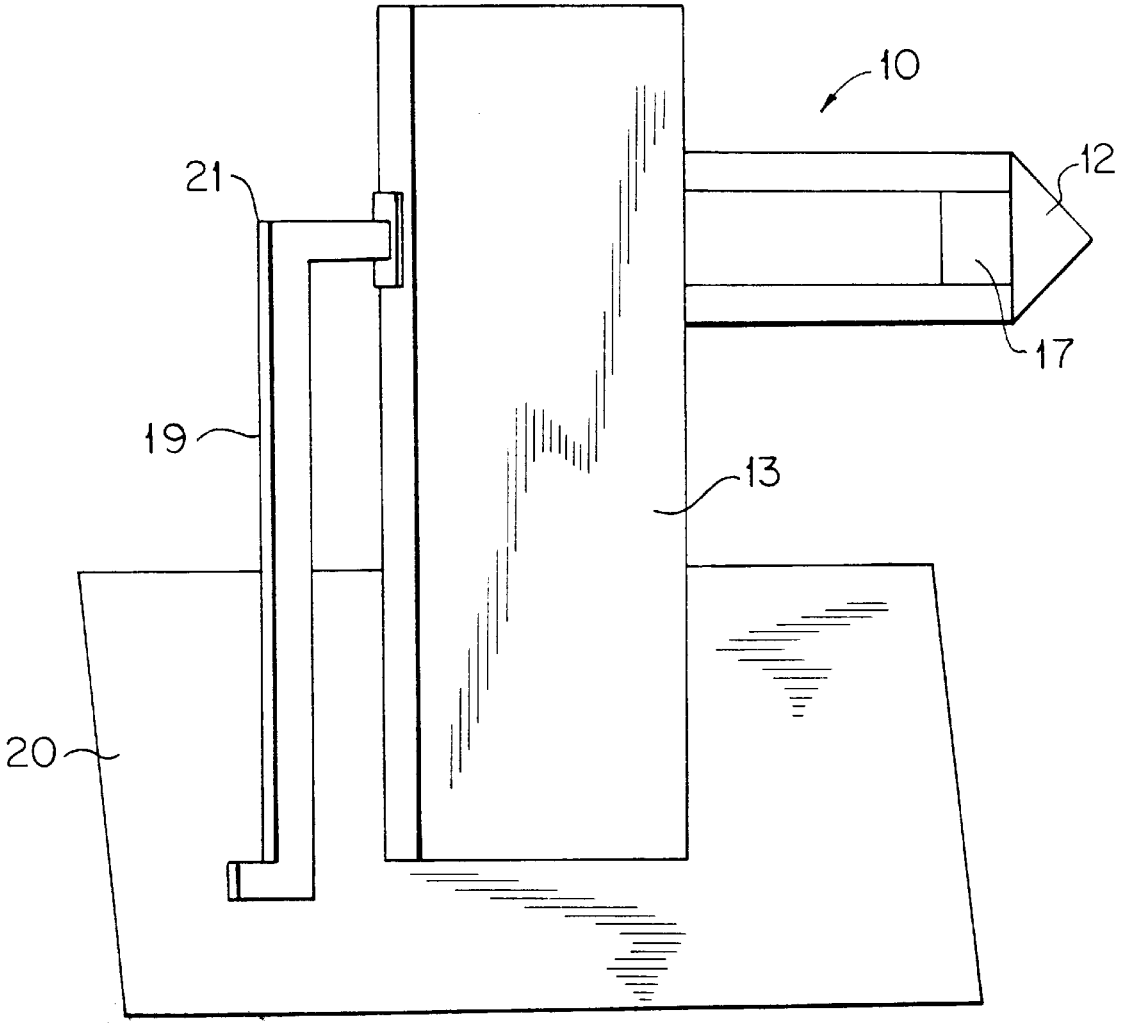
FIG. 10 is a perspective view showing a projection-type interconnect component located on a substrate arranged at a right-angle with respect to an interface device.

FIG. 10 shows a foot portion 19 of a conductive post configured for surface mounting on a printed wiring board 20. As shown in FIG. 10, the substrate 13 may be positioned at a right-angle with respect to the printed wiring board 20. This increases space efficiency and can facilitate cooling of the components on the wiring board and/or shorten various signal paths. Although not explicitly shown in FIG. 10, the substrate 13 may be positioned at a right-angle with respect to the device with which the foot portion is interfacing (e.g., a flex cable or a round cable) regardless of the nature of the device. As seen from FIG. 10, such positioning necessitates the orienting of the foot portion L9 at a right-angle at a point 21 of the foot portion. Th corner at point 21 and/or the corner of the foot portion 19 near the printed wire board 20 may be sharp, as depicted in g. 10, or one or both of each corners could be gradual or curved.

Figure 11A:
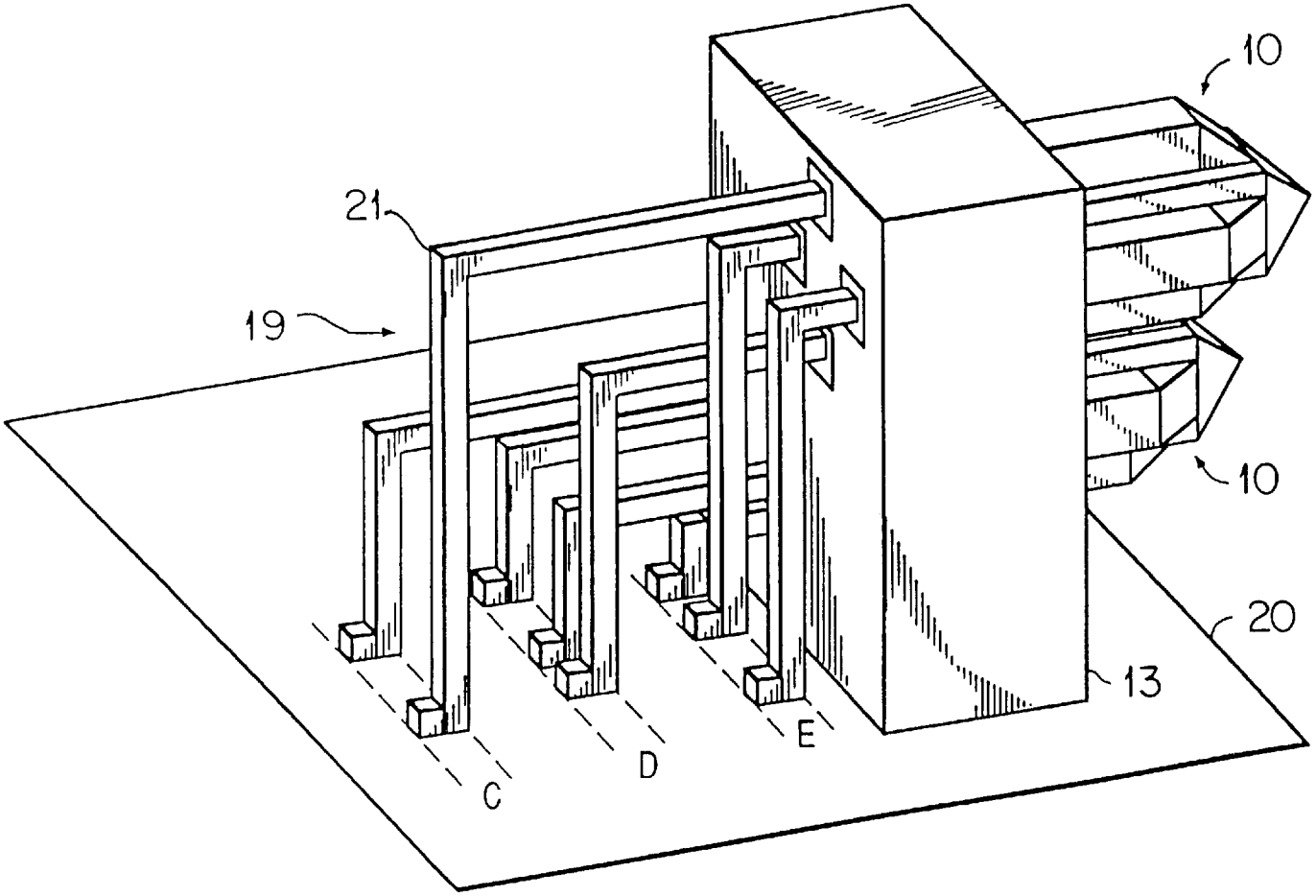
FIG. 11(*a*) is a perspective view showing several projection-type interconnect components located on a substrate arranged at a right-angle with respect to an interface device.
Figure 11B:
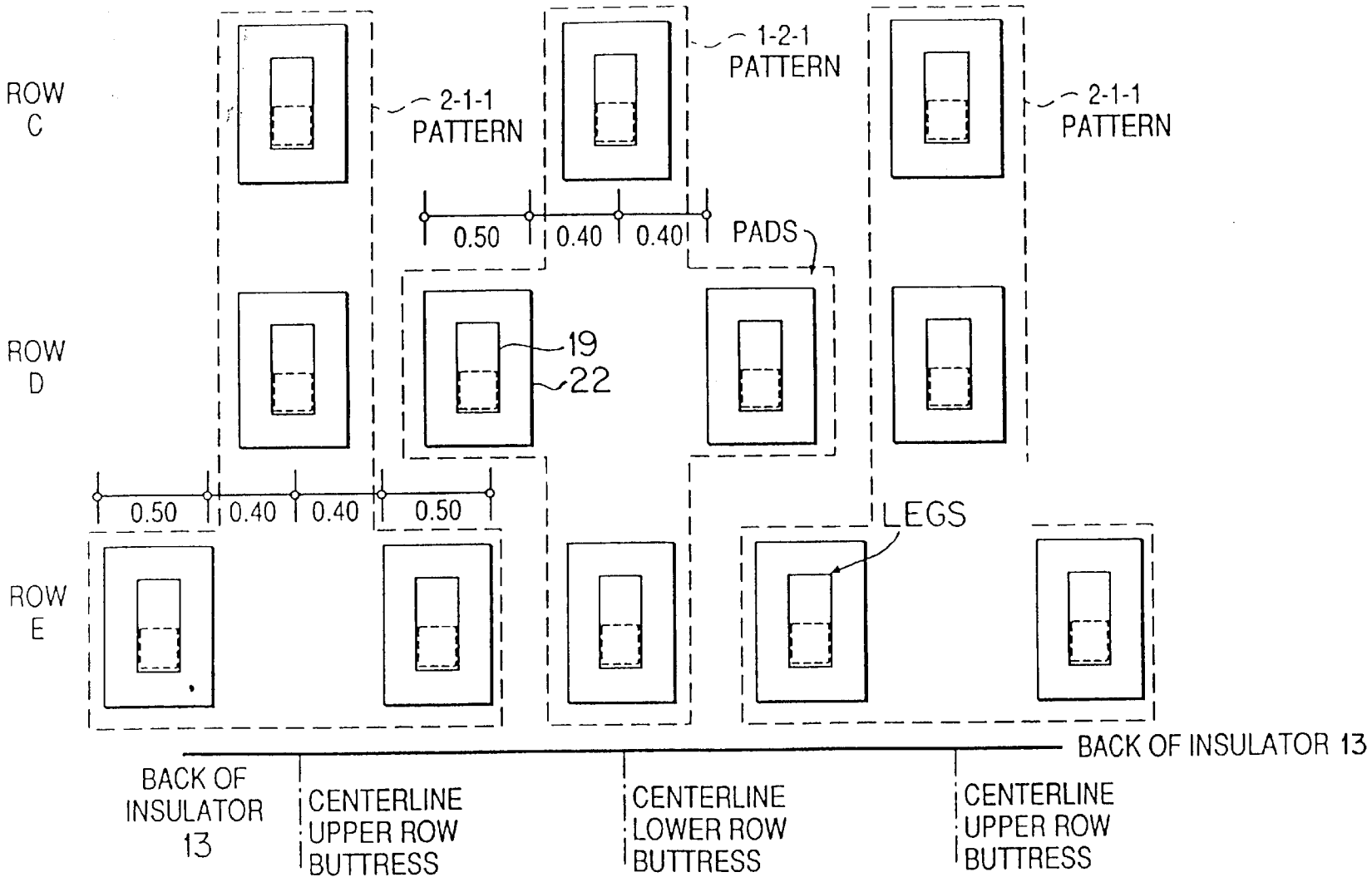

FIG. 11 (a) illustrates a preferred arrangement of the various foot portions 19 when several projection-type electrical interconnect Components 10 are attached to a substrate 13 positioned at a right-angle with respect to the interface device (e.g., printed wiring board 20). With reference to FIG. 11(*a*), each foot portion 19 extends out from a vertical surface of substrate 13, and then is oriented toward the surface of the interface device at a point 21 of that foot portion. The foot portions 19 are oriented such that the foot portions contact the interface device in three separate rows (i.e., rows C, D, and E of FIGS. 11(*a*) and 11(*b*)).

FIG. 11(*b*) is a diagram showing that with three interconnect components arranged in two rows, the foot portions 19 of such components can be arranged in three rows (C, D, and E) using patterns which alternate. As shown in FIG. 11(*b*), the foot portions 19 of alternating projection-type components 10 contact pads 22 of the interface device in "2-1-1" and "1-2-1" patterns. The alternating "2-1-1" and "1-2-1" patterns arrange the foot portions into three rows (C, D, and E), thereby decreasing signal path lengths, increasing speed, and saving space in a two-row, right-angle configuration wherein buttresses are used.

It should be noted that one or more rows (e.g., two additional rows) of interconnect components may be attached to substrate 13 rather than just the two rows illustrated in FIG. 11(*a*). If two additional rows of interconnect components are positioned above the two rows of components 10 illustrated in FIG. 11(*a*), for example, the foot portions of the additional components could extend over the foot portions of the lower two rows and then turn toward the interface device 20 just like the foot portions of the lower two rows. The alternating patterns formed by the additional foot portions could be identical to the alternating patterns illustrated in FIG. 11(*b*), but located further away from the substrate 13 than the patterns of the lower two rows.

Figure 12A:
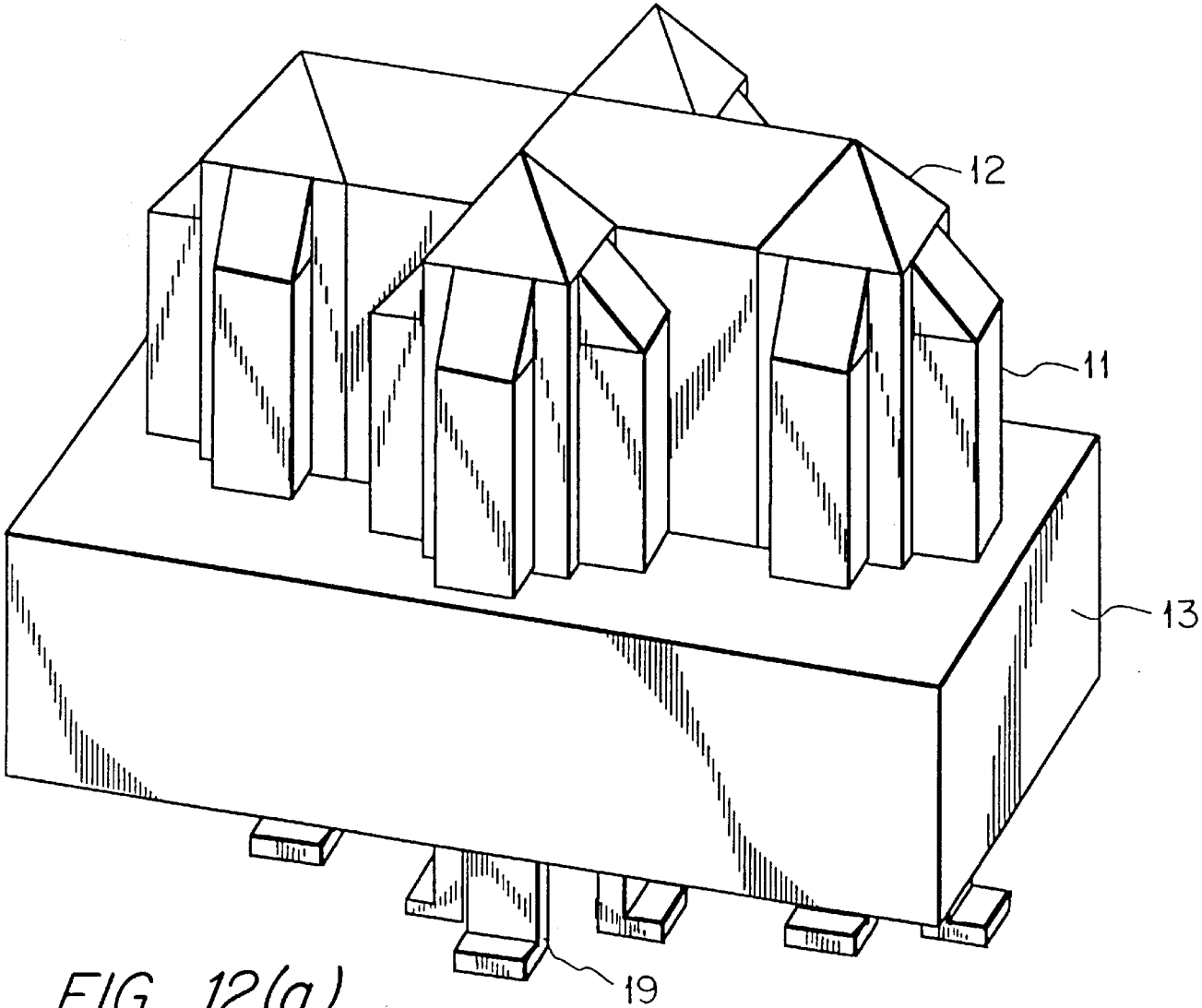
FIG. 12(*a*) is a perspective view of a projection-type electrical interconnect component in accordance with another embodiment of the present invention.
Figure 12B:
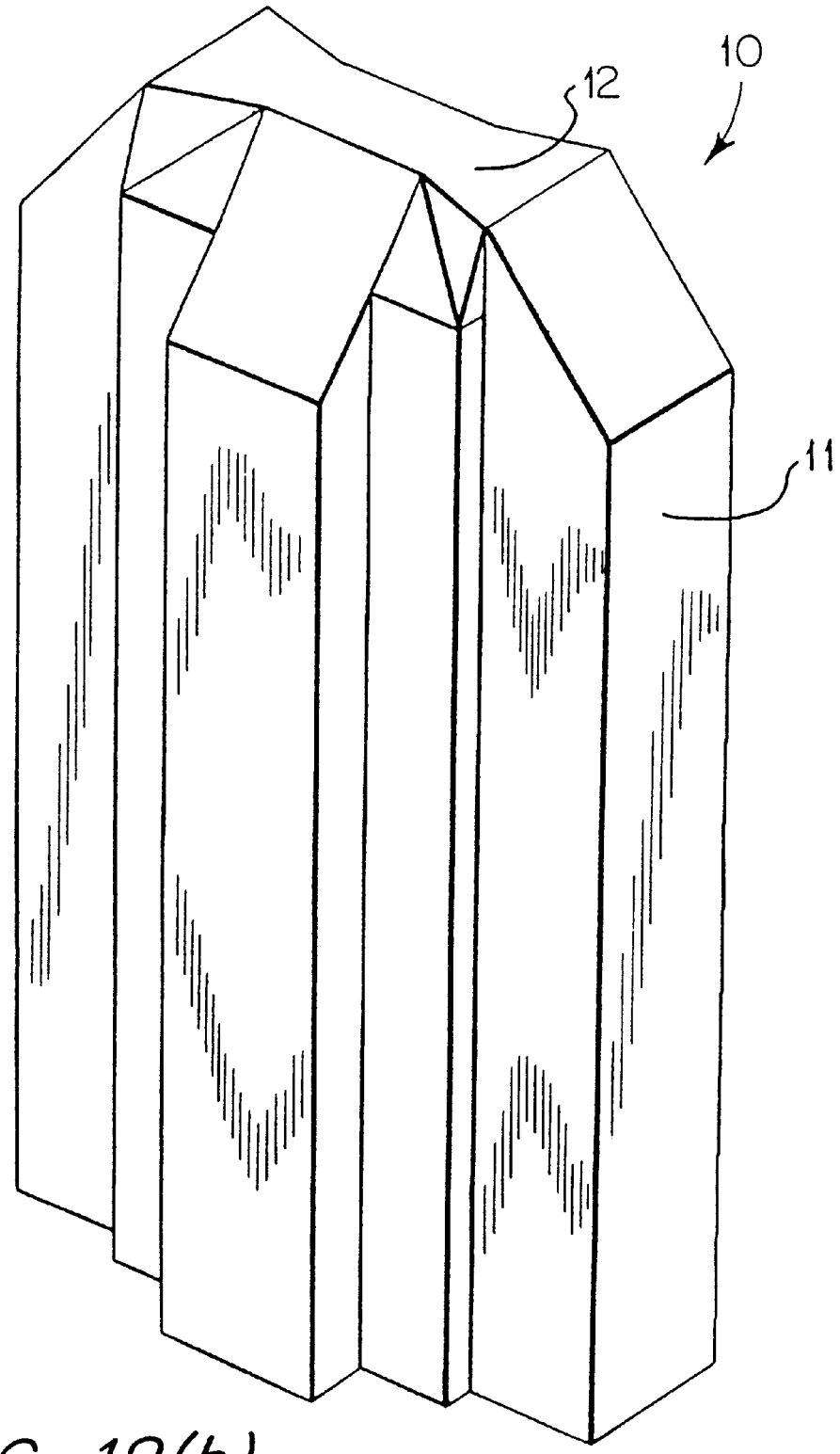

FIG. 12(*a*) shows that in an alternate embodiment, the projection-type component 10 may include a cross-shaped buttress 12 surrounded by a plurality of conductive posts 11. In FIG. 12(*a*), the foot portion 19 of each conductive post 11 is configured for surface mounting on a printed wire board (not shown in FIG. 12(*a*)) with the substrate 13 positioned parallel to the surface of the board. Although twelve conductive posts are illustrated in FIG. 12(*a*), one for each vertical surface of the buttress 12, either more or less than twelve conductive posts may be positioned around the buttress. Except for the arrangement and number of the conductive posts and the shape of the buttress, the projection-type electrical interconnect component of FIG. 12(*a*) is essentially identical to the one shown in FIG. 5(*a*). Thus, as with the embodiment of FIG. 5(*a*), the projection-type interconnect component of FIG. 12(*a*) may be used without buttress 12.

FIG. 12(*b*) is another alternate embodiment of the projection-type interconnect component 10 wherein the buttress 12 is H-shaped. In this embodiment, two opposing ones of the posts 11 are closer than the other two opposing ones of the posts. Although four conductive posts are illustrated in FIG. 12(*b*), either more or less than four posts may be positioned around the buttress. Except for the arrangement and number of the conductive posts and the shape of the buttress, the projection-type interconnect component 10 of FIG. 12(*b*) is essentially identical to the one shown in FIG. 5(*a*) and, therefore, the projection-type interconnect component of FIG. 12(*b*) may be used without a buttress.

Figure 13A:
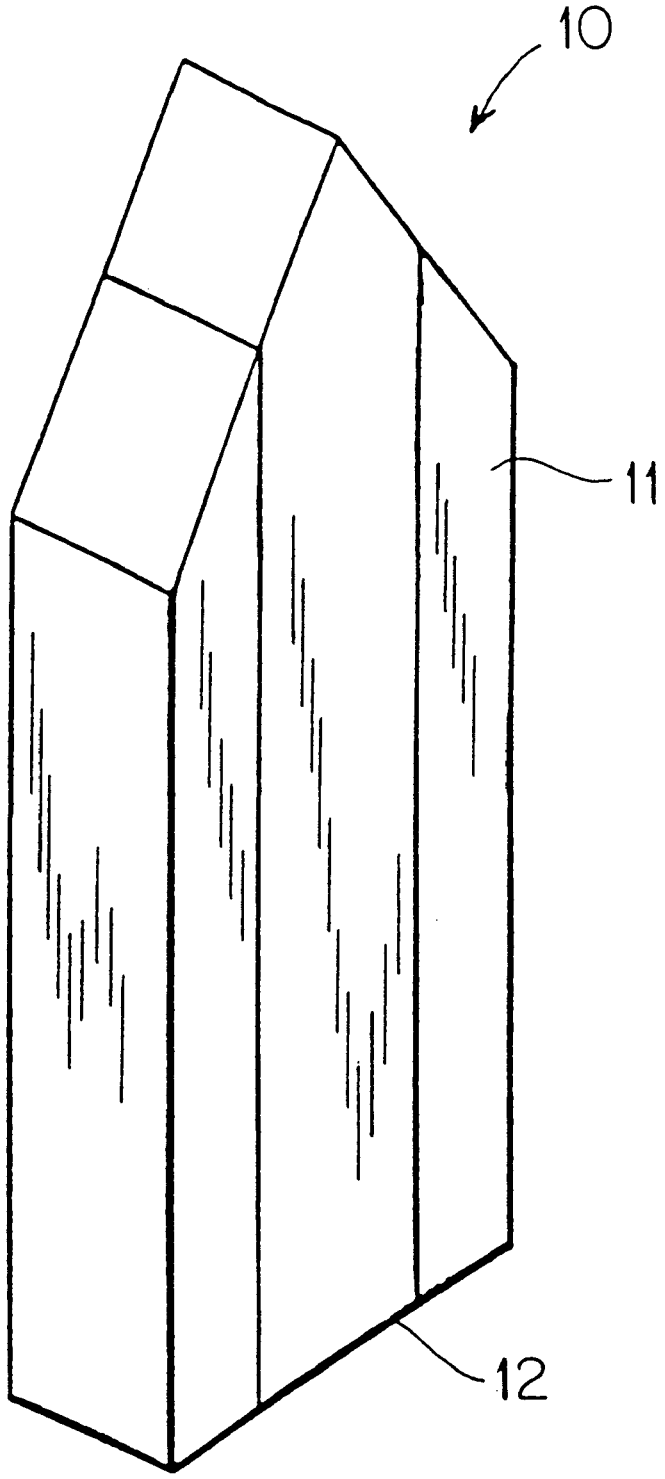
FIG. 13(*a*) is a perspective view of a projection-type electrical interconnect component in accordance with yet another embodiment of the present invention.
Figure 13C:
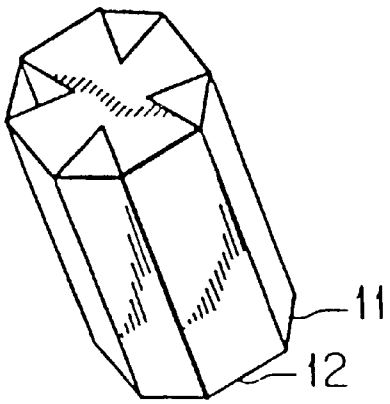
Figure 13B:
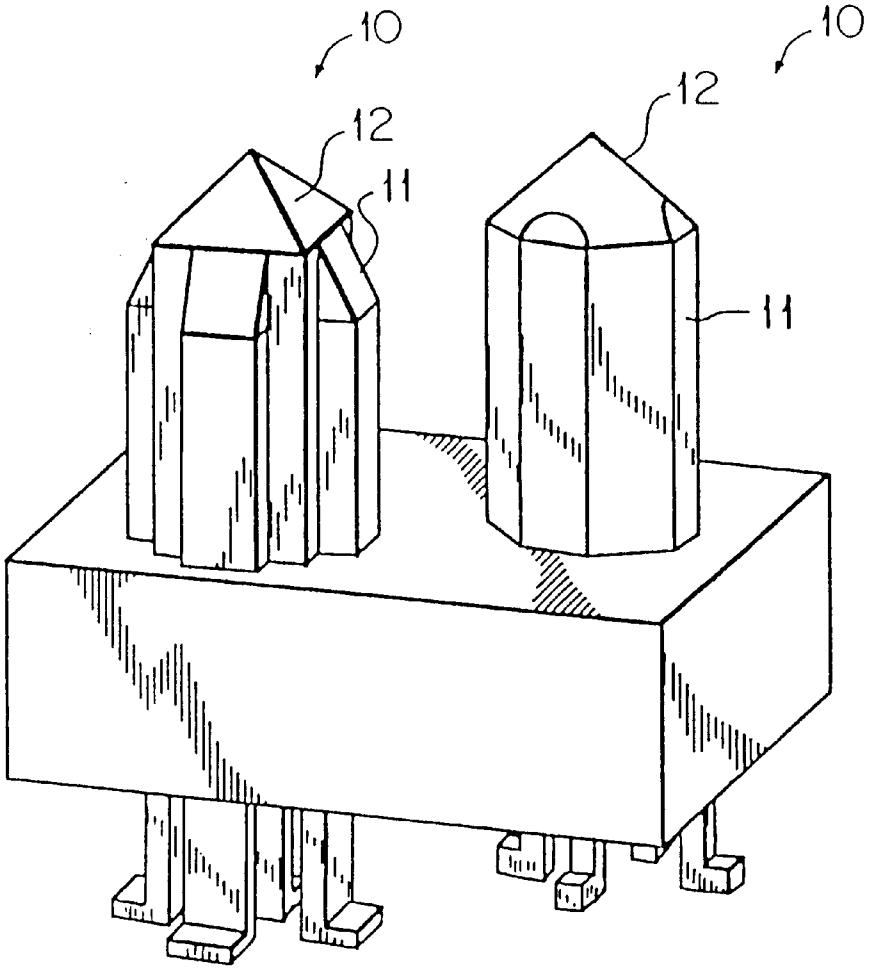

FIG. 13(*a*) shows yet another alternate embodiment of the projection-type component 10 wherein the tip portion of the buttress 12 has two sloped surfaces instead of four sloped surfaces, and each conductive post has the same width as a side of the buttress 12. Except for the shape of the tip portion and the number and width of the conductive posts 11 surrounding the buttress 12, the projection-type interconnect component is essentially identical to the one shown in FIG. 5(*a*). Consequently, although two conductive posts are illustrated in FIG. 13(*a*), either more or less than two conductive posts may be positioned around the buttress 12. Further, as with the embodiment of FIG. 5(*a*), the projection-type interconnect component of FIG. 13(*a*) may be used without buttress 12. Also, the width of each conductive post 12 may be greater or lesser than the width of a side of the buttress.

The leftward portion of FIG. 13(*b*) shows a projection-type interconnect component 10 in accordance with the embodiment of the present invention illustrated in FIG. 5(*a*). The rightward portion of FIG. 13(*b*) shows a projection-type interconnect component 10 in accordance with still another embodiment of the present invention.

FIG. 13(*c*) shows a portion of the rightward interconnect component with the tip portion of the component removed. The interconnect component of FIG. 13(*c*) has several conductive posts 11 each including a contact portion having a triangular cross-section. The interconnect component of FIG. 13(*c*) may also include a buttress 12 having a substantially cross-shaped, X-shaped, or H-shaped cross-section, although the buttress may be eliminated if desired. The embodiment of FIG. 13(*c*) allows close spacing between the posts 11 and may use a buttress 12 having a reduced thickness as compared to buttresses which may be used in connection with other embodiments of the present invention.

The projection-type interconnect components shown in the drawings are exemplary of the types of interconnect components that may be used in the electrical interconnect system of the present invention. Other projection-type interconnect components are contemplated.

THE RECEIVING-TYPE INTERCONNECT COMPONENT

The receiving-type electrical interconnect component of the present invention includes several electrically conductive beams attached to an insulative substrate. The receiving-type electrical interconnect component is configured to receive a corresponding projection-type electrical interconnect component within a space between the conductive beams. The substrate insulates the conductive beams from one another so that a different electrical signal may be transmitted on each beam.

Figure 14:
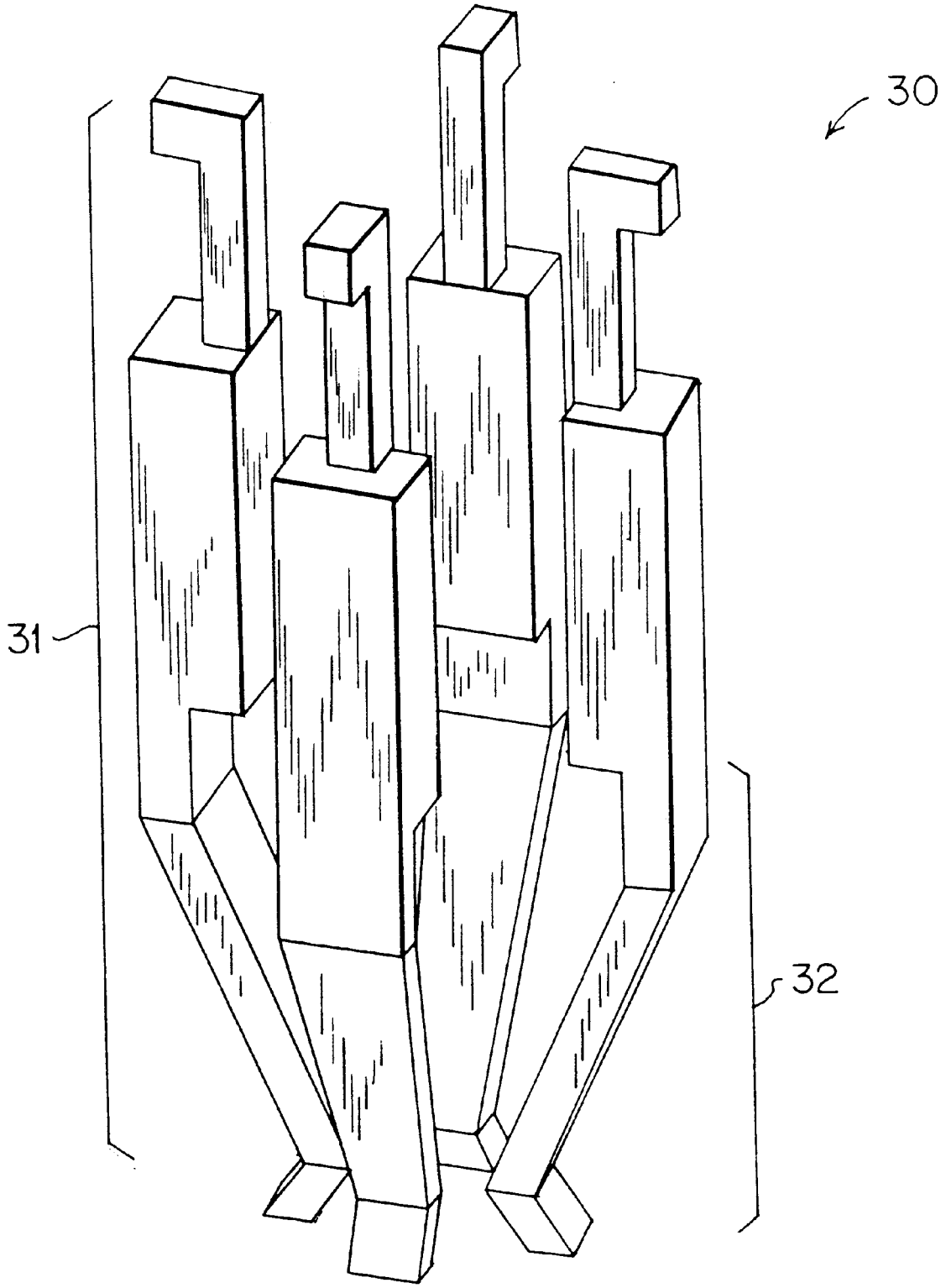
FIG. 14 is a perspective view of the conductive beams of a receiving-type interconnect component in accordance with an embodiment of the present invention.

FIG. 14 illustrates a portion of a receiving-type interconnect component 30 in accordance with an embodiment of the present invention. The receiving-type component 30 comprises several electrically conductive, flexible beams 31 attached to an electrically insulated substrate (not shown in FIG. 14). Preferably, the material of the substrate is an insulative material that does not shrink when molded (for example, a liquid crystal polymer such as VECTRA, which is a trademark of Hoescht Celanese). Portions of the conductive beams 31 bend away from each other to receive the projection-type interconnect component within the space between the conductive beams.

Each conductive beam 31 may be formed from the same materials used to make the conductive posts 11 of the projection-type electrical interconnect component. For example, each conductive beam 31 may be formed of beryllium copper, phosphor bronze, brass, or a copper alloy, and plated with tin, gold, palladium, or nickel at a selected portion of the conductive beam which will contact a conductive post of the projection-type interconnect component when the projection-type interconnect component is received within the receiving-type interconnect component 30.

Figure 15:
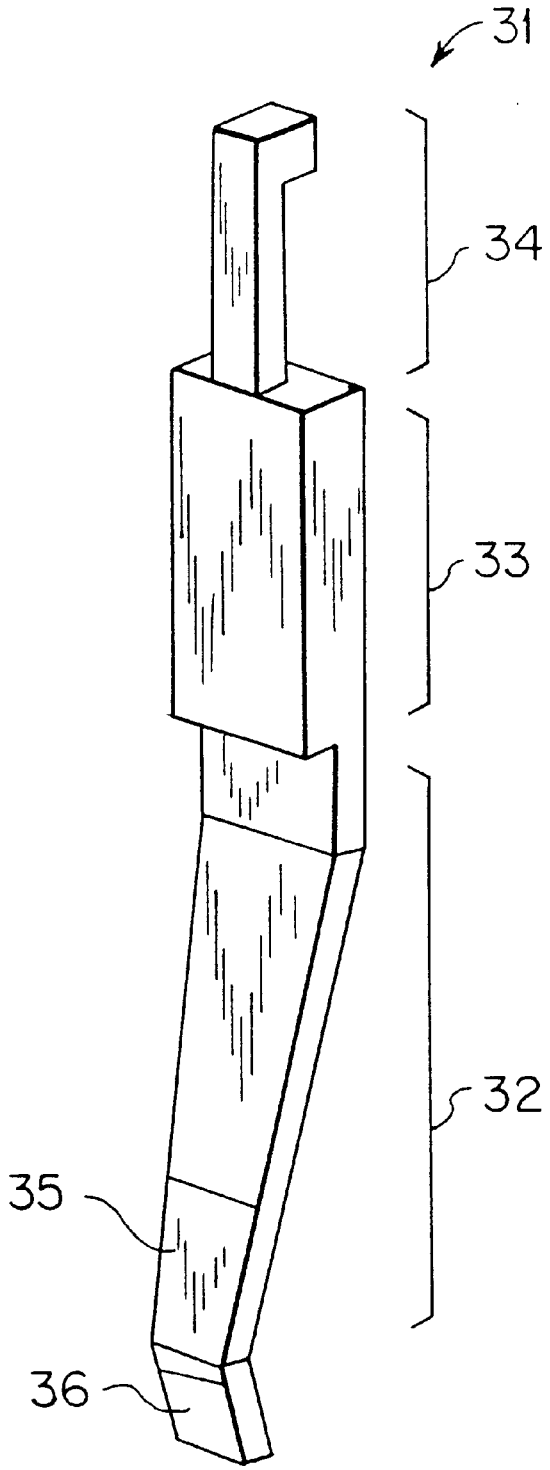
FIG. 15 is a perspective view showing an example of a conductive beam that may be used in the electrical interconnect system of the present invention.

An example of a conductive beam 31 that may be used in the electrical interconnect system of the present invention is shown in FIG. 15. With reference to FIG. 15, each conductive beam 31 of the present invention includes three sections: a contact portion 32; a stabilizing portion 33; and a foot portion 34.

The contact portion 32 of each conductive beam 31 contacts a conductive post of a corresponding projection-type receiving component when the projection-type receiving component is received within the corresponding receiving-type interconnect component. The contact portion 32 of each conductive beam includes an interface portion 35 and a lead-in portion 36. The interface portion 35 is the portion of the conductive portion 32 which contacts a conductive post when the projection-type and receiving-type interconnect components are mated. The lead-in portion 36 comprises a sloped surface which initiates separation of the conductive beams during mating upon coming into contact with the tip portion of the buttress of the projection-type interconnect component (or, when a buttress is not used, upon coming into contact with one or more posts of the projection-type interconnect component).

The stabilizing portion 33 is secured to the substrate (e.g., substrate 37 of FIG. 17) that supports the conductive beam 31. The stabilizing portion 33 of each conductive beam prevents that beam from twisting or being dislodged during handling, mating, and manufacturing. The stabilizing portion 33 is of a dimension that locks the beam into the substrate while allowing an adequate portion of the insulative substrate to exist between adjacent conductive beams.

The foot portion 34 is very similar to the foot portion 19 of the conductive post 11 described above in connection with the projection-type interconnect component 10. Like foot portion 19, the foot portion 34 connects to an interface device (e.g., a semiconductor chip, a printed wiring board, a wire, or a round, flat, or flex cable) which uses the electrical interconnect system as an interface.

Figure 16:
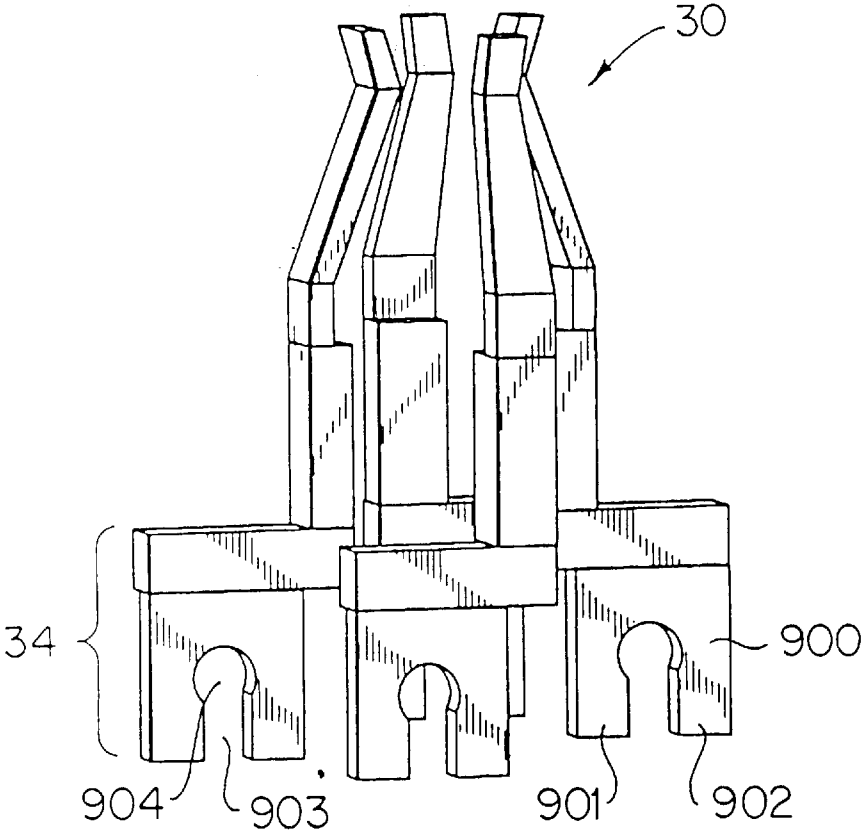
FIG. 16 is a perspective view of a plurality of flexible beams of a receiving-type interconnect component each having a wire or cable interface foot portion.
Figure 17:
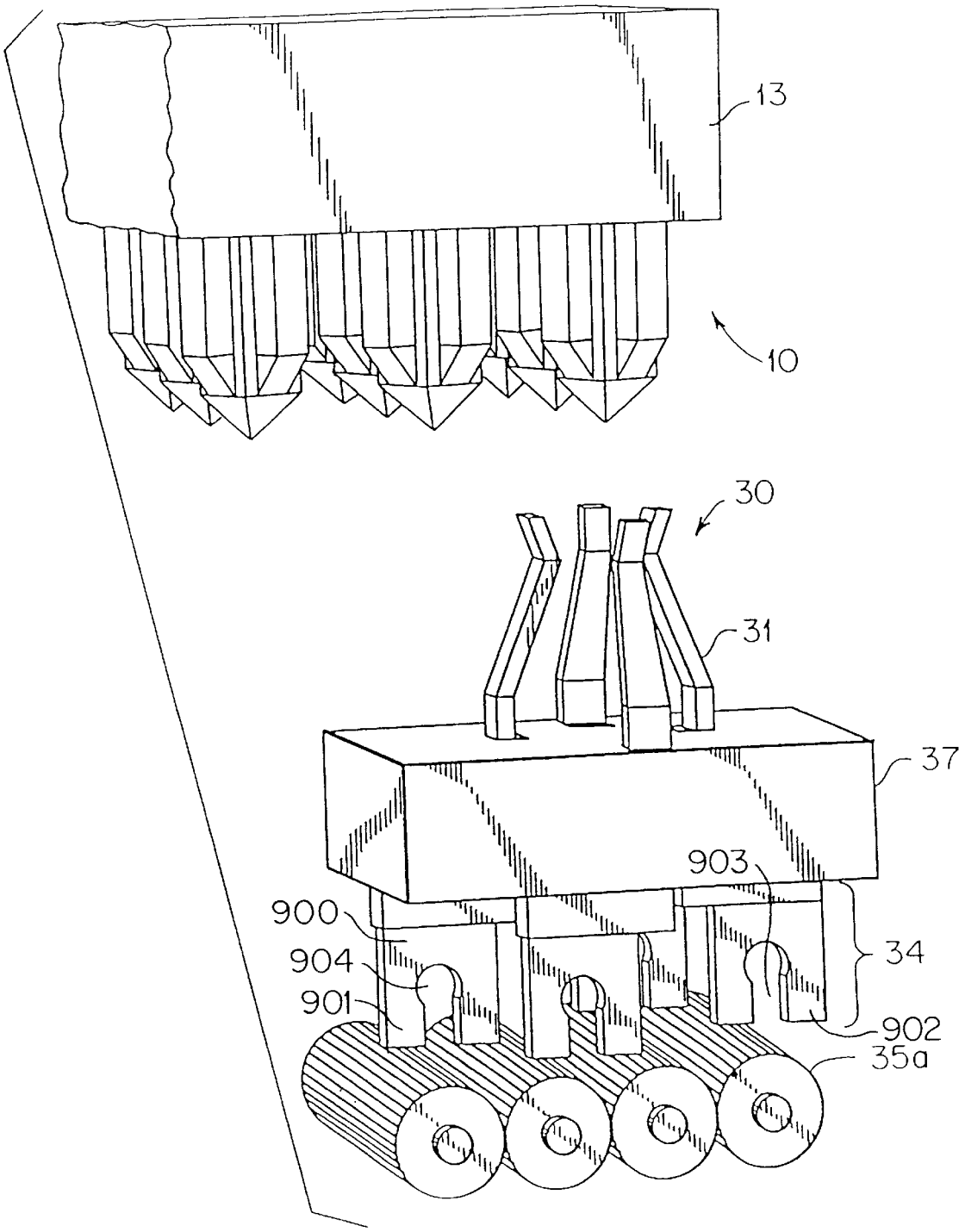
FIG. 17 is a perspective view of an interconnect system including plurality of flexible beams arranged to interface with a wire or cable.

In the same manner as foot portion 19, the configuration of the foot portion 34 depends on the type of device with which it is interfacing. Possible configurations of the foot portion 34 are the same as the possible configurations discussed above in connection with the foot portion 19 above. For example, FIGS. 16 and 17 show the configuration of the foot portion 34 used when interfacing wits a round cable or wire 35 and, in particular, FIG. 17 shows tie receiving-type component 30 prior to mating with the projection-type component 10, with the conductive beams 31 attached to an insulative substrate 37, and the foot portion 34 of each beam positioned for interfacing with round wire or cable 35. As shown in FIGS. 16 and 17, each foot portion 34 may comprise blade 900 having forked end projections 901 and 902 extending therefrom wherein forked end projections 901 and 902 are separated by a slot comprised of channel 903 and semi-circular wire receiving portion 904 so as to interface with a wire or round cable 35*a* as mentioned above.

Like foot portion 19, the foot portion 34 will be bent at right-angle in situations where the substrate of the receiving-type interconnect component is located at a right-angle with respect to the interface device with which the foot portion 34 is interfacing. The contact and foot portions of each conductive beam may be aligned or offset with respect to the stabilizing portion to provide advantages that will be discussed in detail below.

Figure 18:
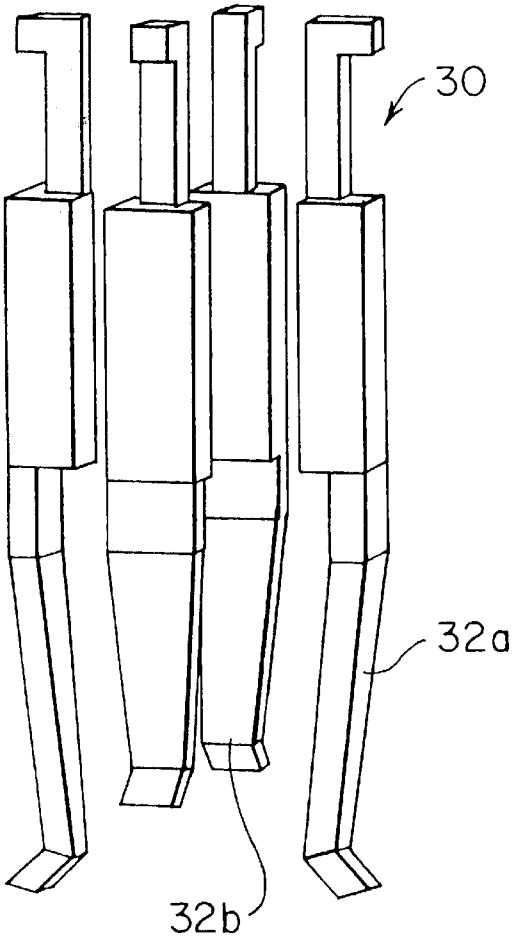
FIG. 18 is a perspective view of a receiving-type interconnect component having beams of different lengths.

FIG. 18 illustrates an alternate embodiment of the receiving-type interconnect component 30. Like the embodiment of FIG. 14, the receiving-type interconnect component 30 includes several electrically conductive, flexible beams. In the embodiment of FIG. 18, however, the contact portion 32*a* for two of the beams is longer than the contact portion 32*b* for the other two beams.

It should be noted that the configuration of the receiving-type component depends on the configuration of the projection-type interconnect component, or vice versa. For example, if the projection-type interconnect component comprises a cross-shaped buttress surrounded by conductive posts, then the receiving-type component should be configured to receive that type of projection-type interconnect component.

MATING OF THE INTERCONNECT COMPONENTS

Figure 19:
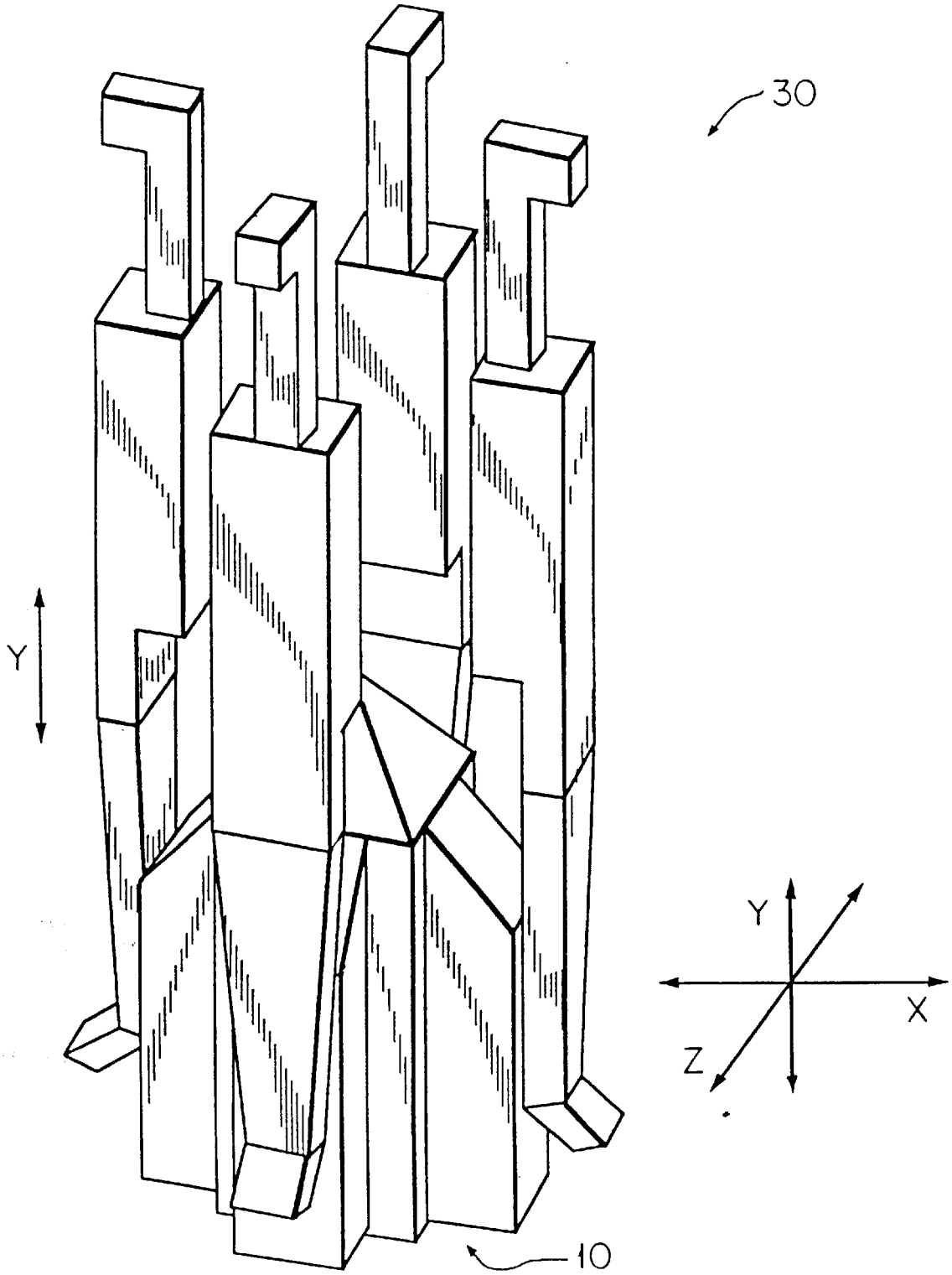
FIG. 19 is a perspective view showing a portion of a projection-type interconnect component received within the conductive beams of a receiving-type interconnect component.

FIG. 19 shows a projection-type interconnect component 10 received within the conductive beams of a receiving-type interconnect component 30. When the projection-type interconnect component is received within the receiving-type interconnect component in this fashion, such interconnect components are said to be mated or plugged together. When the projection-type and receiving-type interconnect components are mated, the contact portions 32 of the conductive beams bend or spread apart to receive the projection-type interconnect component within the space between the contact portions of the conductive beams.

The mated position shown in FIG. 19 is achieved by moving the projection-type interconnect component 10 and the receiving-type interconnect component 30 toward one another in the direction of arrow Y shown in FIG. 19. In the mated position, the contact portion of each conductive beam exerts a normal force against a contact portion of a corresponding one of the conductive posts in a direction within plane XZ. In FIG. 19, arrow Y is perpendicular with respect to plane XZ.

Figure 20:
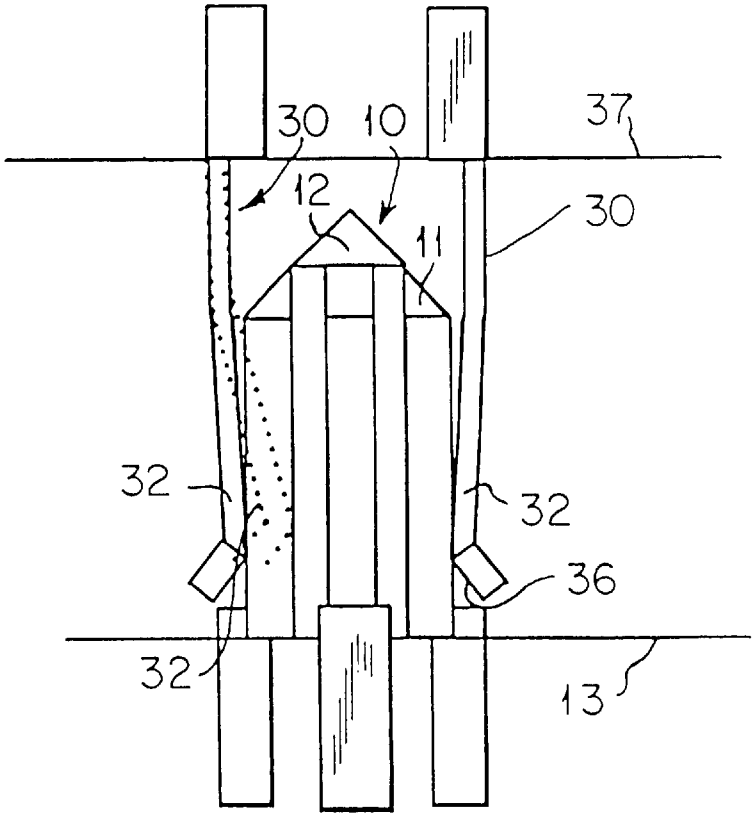
FIG. 20 is a side view of a projection-type interconnect component received within a receiving-type interconnect component.

The process of mating a projection-type interconnect component 10 with a corresponding receiving-type interconnect component 30 will now be discussed with reference to FIGS. 5(*a*), 14, 15, 19, and 20. FIG. 20 depicts exemplary dimensions for the electrical interconnect components. Other dimensions may be used. FIGS. 5(*a*) and 14 show the state of the projection-type interconnect component 10 and the corresponding receiving-type interconnect component 30 prior to mating. As can be seen from FIG. 14, the contact portions 32 of the beams of the receiving-type interconnect component are clustered together before mating with the projection-type interconnect component. Such clustering may involve contact between two or more of the beams.

Next, the projection-type and receiving-type interconnect components are moved toward one another in the direction of the arrow Y shown in FIG. 19. Eventually, the lead-in portions 36 (FIG. 15) of each conductive beam 31 contact the tip portion of the buttress 12 (when used). Upon further relative movement of the interconnect components toward one another, the sloped configuration of the tip portion causes the contact portions 32 of the conductive beams to start to spread apart. Further spreading of the contact portions 32 occurs with additional relative movement between the interconnect components due to the sloped upper surfaces of the conductive posts 11 of the projection-type component. Such spreading causes the conductive beams 31 to exert a normal force against the conductive posts 11 in the fully mated position (FIGS. 19 and 20), thereby ensuring reliable electrical contact between the beams and posts. In FIG. 20, solid lines are used to show the condition of the conductive beams in the mated position, while the dotted line shows one of the conductive beams in its condition prior to mating. It should be noted that when a buttress is not used, the initial spreading of the contact portions 32 is caused by one or more posts 11 of the projection-type interconnect component rather than a buttress tip portion.

The insertion force required to mate the projection-type interconnect 10 within the receiving-type interconnect component 30 is highest at the point corresponding to the early phases of spreading of the conductive beams 31. The subsequent insertion force is less as it relates to frictional forces rather than spreading forces. The insertion-force required to mate the projection-type and receiving-type interconnect components can be reduced (and programmed mating, wherein one or more interconnections are completed before one or more other interconnections, may be provided) using a projection-type interconnect component having conductive posts which vary in height. An example of such a projection-type interconnect component is shown in FIG. 21.

Figure 21:
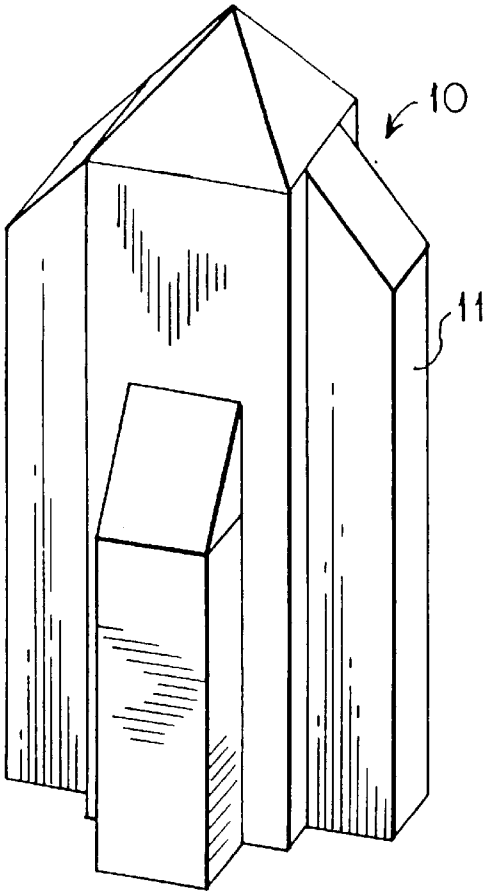
FIG. 21 is a perspective view of a portion of a projection-type interconnect component having conductive posts which vary in height.

As seen in FIG. 21, conductive posts 11 can be arranged so that one pair of opposing posts has a first height, and the other pair of opposing posts has a second height. In essence, the configuration of FIG. 21 breaks the peak of the initial insertion-force into separate components occurring at different times so that the required insertion-force is spread out incrementally over time as the mating process is carried out.

Figure 22:
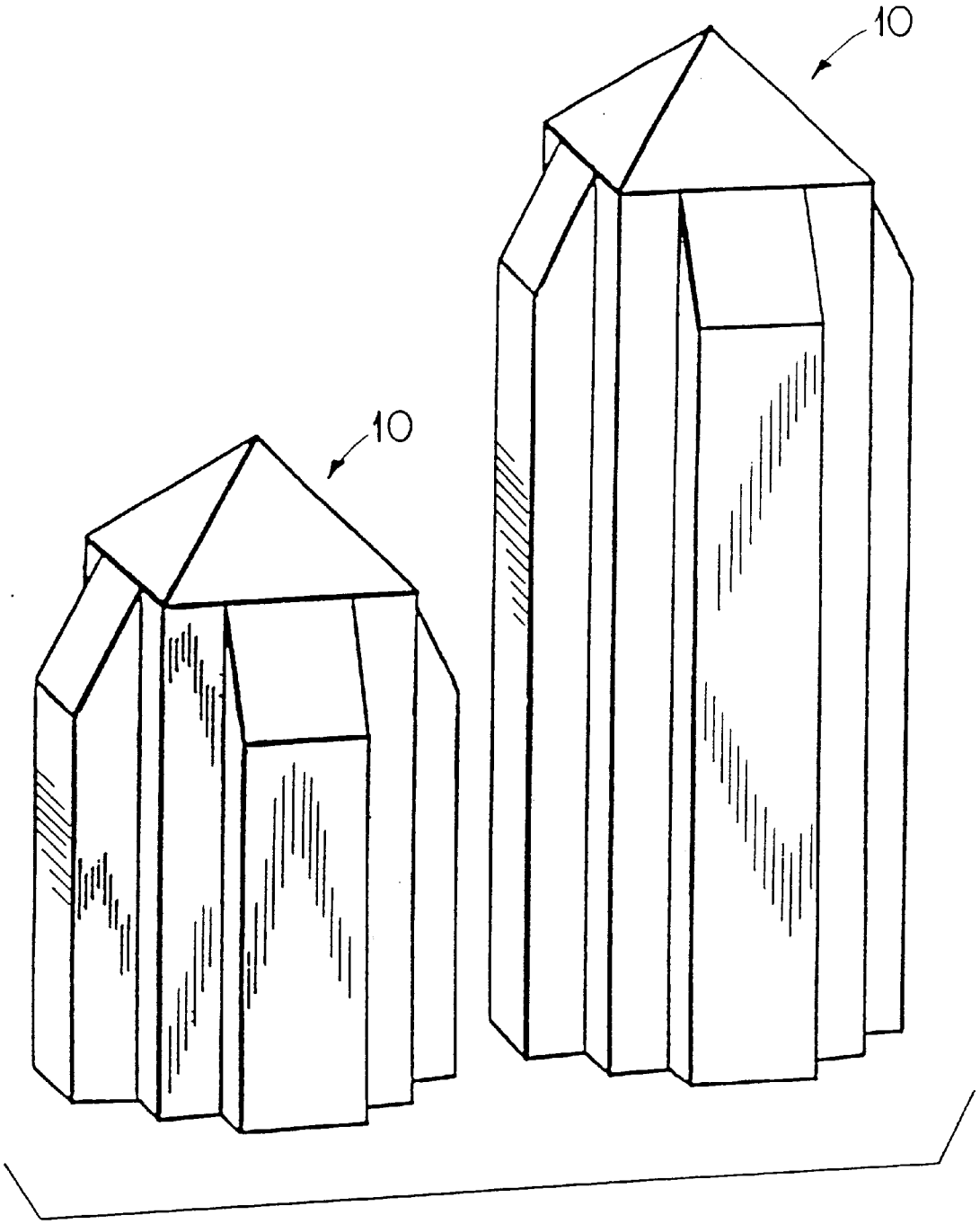
FIG. 22 is a perspective view of several projection-type interconnect components having different heights.

FIG. 22 illustrates another way in which the required insertion-force can be spread out over time as mating occurs (and in which programmed mating can be provided). With reference to FIG. 22, different rows of projection-type interconnect components 10 can have different heights so that mating is initiated for different rows of the interconnect components at different times. The rows may can be alternately high and low in height, for example, or the height of the rows can increase progressively with each row. Also, the components within a given row may have different heights. Further, the embodiments of FIGS. 21 and 22 may be combined to achieve an embodiment wherein different rows of interconnect components vary in height, and the conductive posts of each interconnect component within the different rows also vary in height. Also, the conductive beams 31 or the contact portions 32 of each receiving-type interconnect component could vary in length as in FIG. 18 to similarly reduce the insertion force or provide programmed mating with care taken to retain adequate normal force.

The spreading of the conductive beams 31 during mating performs a wiping function to wipe away debris and other contaminants that may be present on the surfaces of the posts 11, the buttress 12 (if used), and the beams 31. Such wiping allows for more reliable electrical interconnection and the provision of a greater contact area between mated conductive elements.

Figure 23B:
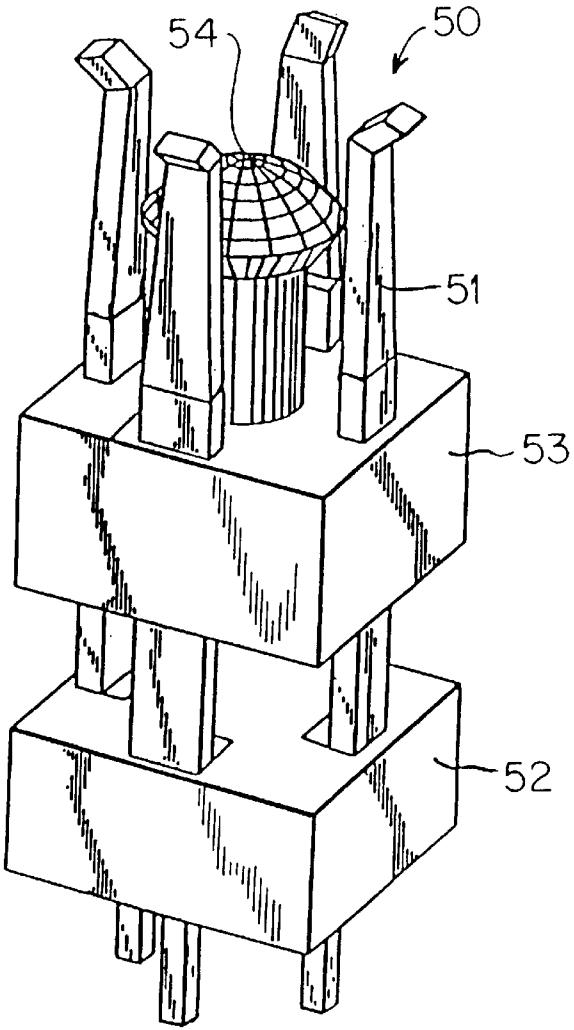
FIG. 23(*a*) is a perspective view of a first type of low-insertion-force or zero-insertion-force component in a first state.
Figure 23A:
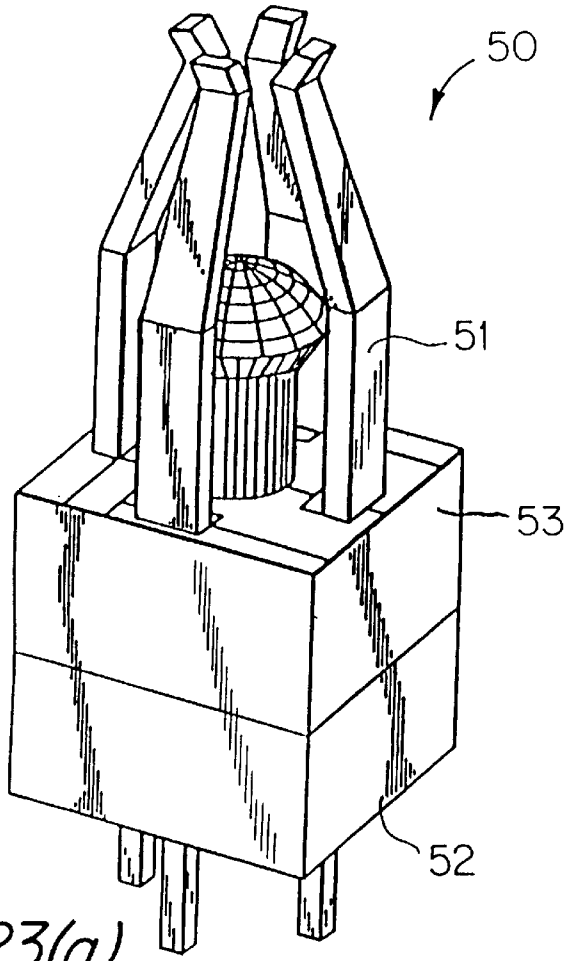
Figure 23C:
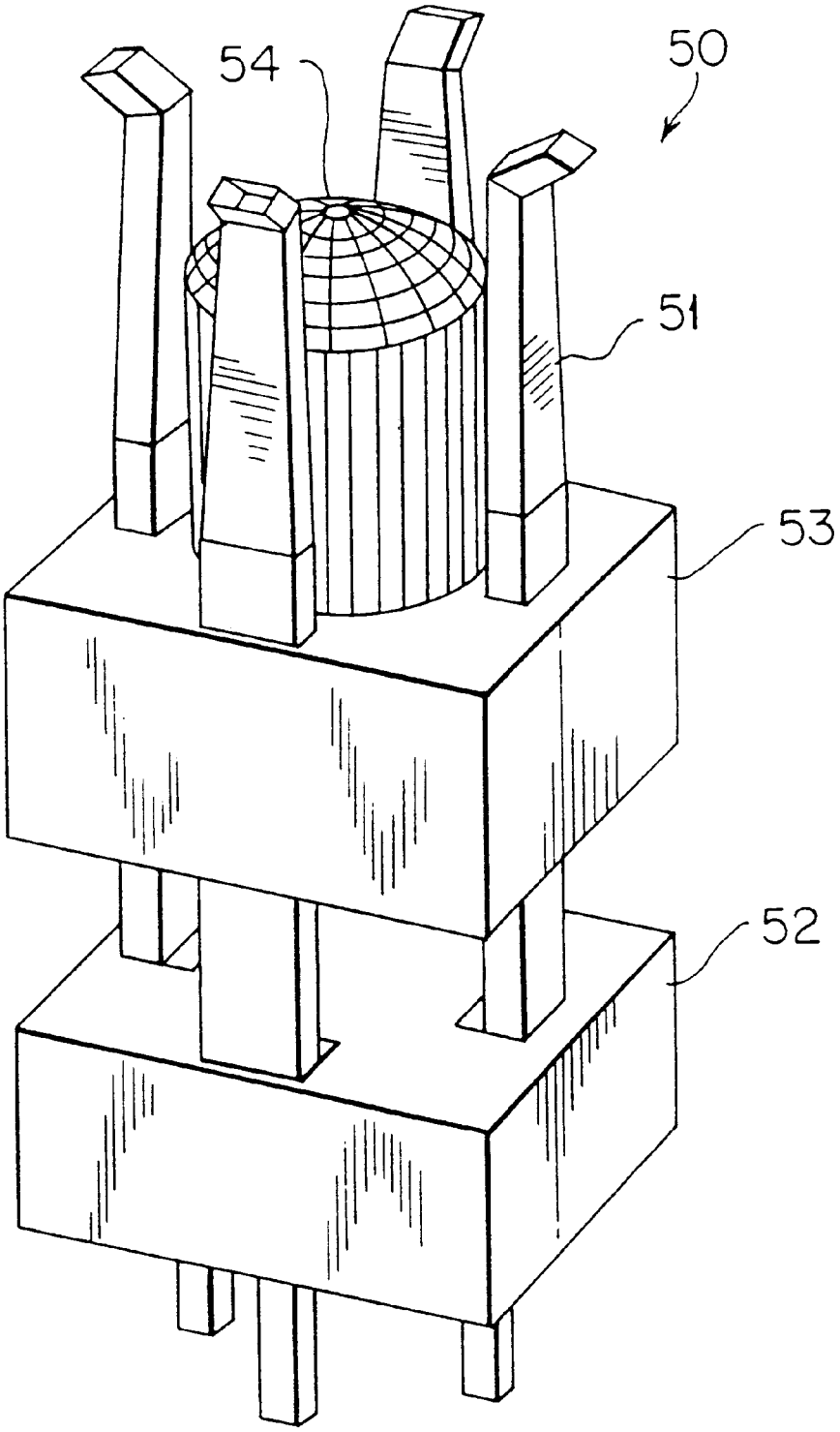

The insertion-force can essentially be entirely eliminated using a zero-insertion-force receiving-type interconnect component. FIGS. 23(*a*), 23(*b*), and 23(*c*) (collectively referred to herein as FIG. 23) show a first type of zero-insertion-force component 50, while FIGS. 24(*a*), 24(*b*), and 24(*c*) (collectively referred to herein as FIG. 24) show a second type of zero-insertion-force component 60. Zero-insertion-force components and very-low-insertion-force components, the latter being discussed in greater detail below, are especially important because as the number of contacts increases, it is desirable to reduce or eliminate the insertion force required for mating.

With reference to FIGS. 23(*a*) and 23(*b*), zero-insertion-force interconnect component 50 includes a plurality (e.g., four) of conductive beams 51 supported by an insulative substrate 52. The interconnect component 50 also includes a movable substrate 53 and a bulbous member 54 fixed to the movable substrate. The movable substrate may be manually operated, or operated by machine. Also, the bulbous member may be replaced by a straight member with no bulb, as shown in FIG. 23(*c*).

FIG. 23(*a*) shows the initial state of the interconnect component 50. Prior to mating the interconnect component 50 with a projection-type interconnect component, the movable substrate 53 is moved upward as depicted in FIG. 23(*b*) causing bulbous member 54 to spread apart the conductive beams 51 to a distance wider than the mating projection-type component. By spreading the conductive beams 51 prior to mating, the insertion-force normally associated with the insertion of the projection-type interconnect component is essentially eliminated. The bulbous member 54 moves back into its original position in response to insertion of the projection-type interconnect component or under the control of a separate mechanical device such as a cam, thereby releasing the beams of the receiving-type interconnect component.

The component 50 in FIG. 23 may be modified so that prior to receiving a projection-type interconnect component, the member 54 does not fully spread the conductive beams 51. In this modification, with the beams 51 only spread part of the way prior to mating, only a very-low-insertion-force is required, while at the same time, the ability of the system to perform wiping is provided. This wiping cleans the contact surfaces to assure good contact.

Figure 24B:
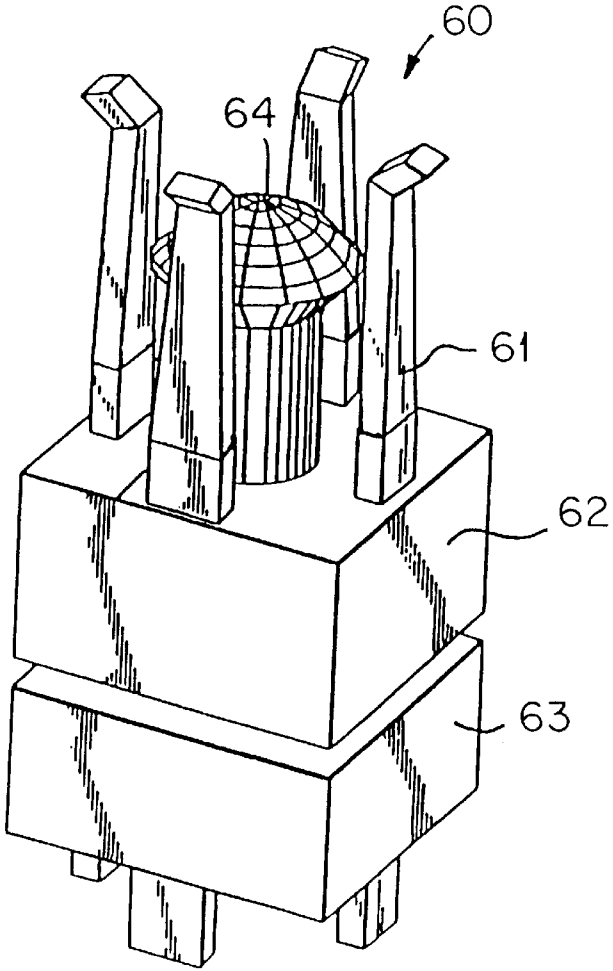
FIG. 24(*a*) is a perspective view of a second type of low-insertion-force or zero-insertion-force component in a first state.
Figure 24A:
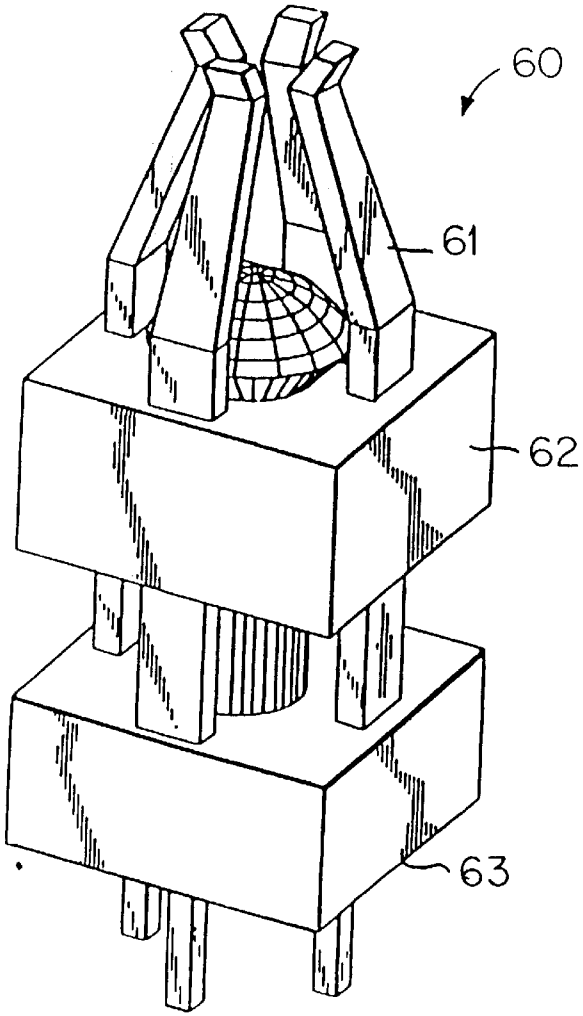
Figure 24C:
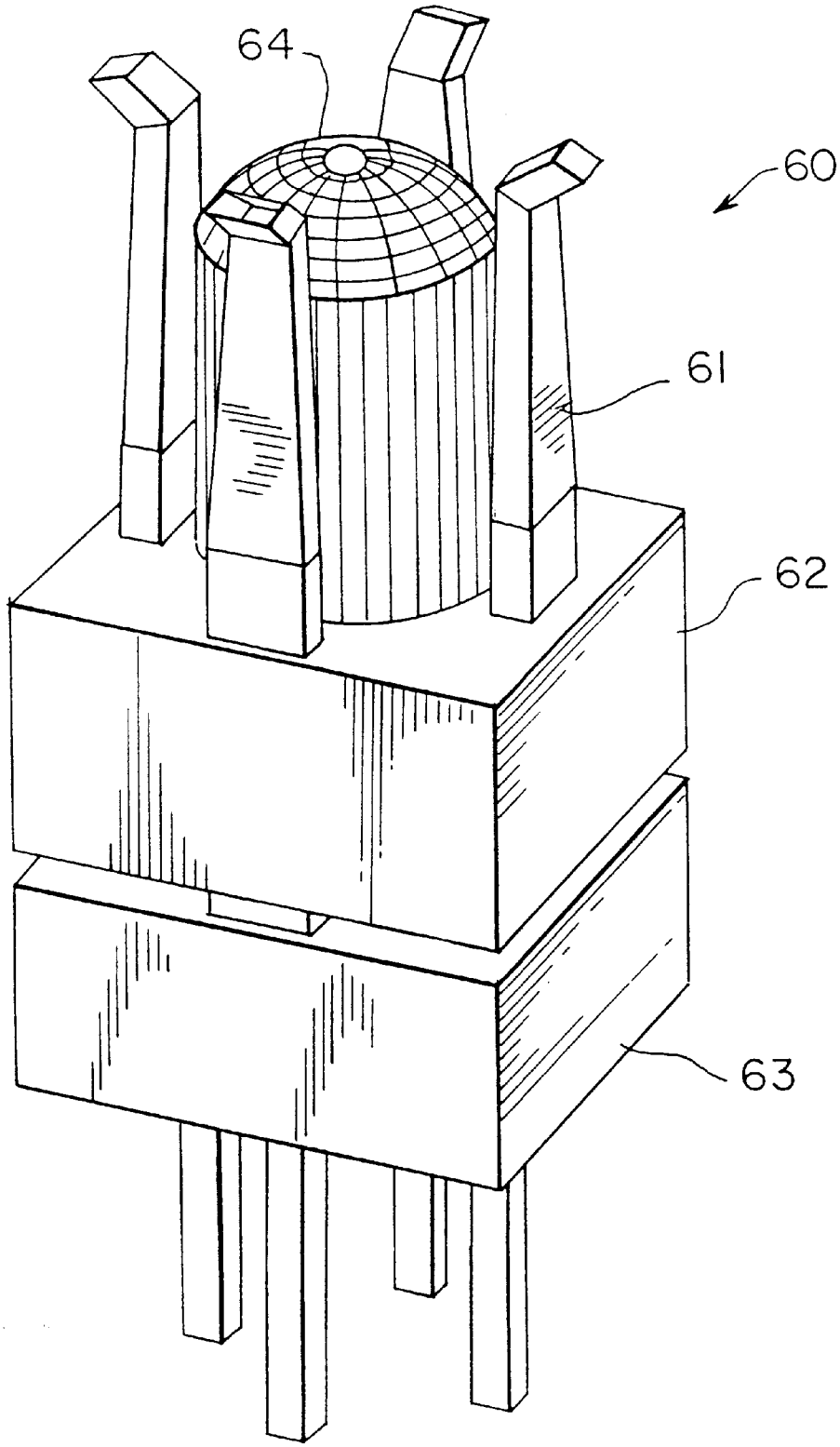

With reference to FIGS. 24(*a*) and 24(*b*), zero-insertion-force interconnect component 60 includes a plurality (e.g., four) of conductive beams 61 supported by an insulative substrate 62. Further, the interconnect component 60 includes a movable substrate 63 and a bulbous member 64 fixed to the movable substrate. The movable substrate may be manually operated, or operated by machine. Also, the bulbous member may be replaced by a straight member with no bulb, as in FIG. 24(*c*).

The zero-insertion-force interconnect component of FIG. 24 is essentially the same as the component shown in FIG. 23 except that the movable substrate 63 is located below the fixed substrate 62 and the fixed substrate 62 includes an aperture to allow movement of the bulbous member 64 within that substrate.

FIG. 24(*a*) shows the initial state of the interconnect component 60. Prior to mating the interconnect component 60 with a projection-type interconnect component, the movable substrate 63 is moved toward the fixed substrate 62 as depicted in FIG. 24(*b*) causing member 64 to spread apart the conductive beams 61 to a distance wider than the mating projection-type component. By spreading the conductive beams 61 prior to mating, the insertion-force normally associated with the insertion of the projection-type interconnect component is essentially eliminated. The bulbous member 64 moves back into its original position in response to insertion of the projection-type interconnect component or under the control of a separate mechanical device such as a cam, thereby releasing the beams of the receiving-type interconnect component to make contact.

The electrical interconnect component 60 in FIG. 24 may be modified so that prior to receiving a projection-type interconnect component, the member 64 does not fully spread the conductive beams 61. In this modification, with the beams 61 only spread part of the way prior to mating, only a very-low-insertion-force is required, while at the same time the ability of the system to perform wiping is provided to assure good contact.

Figure 25B:
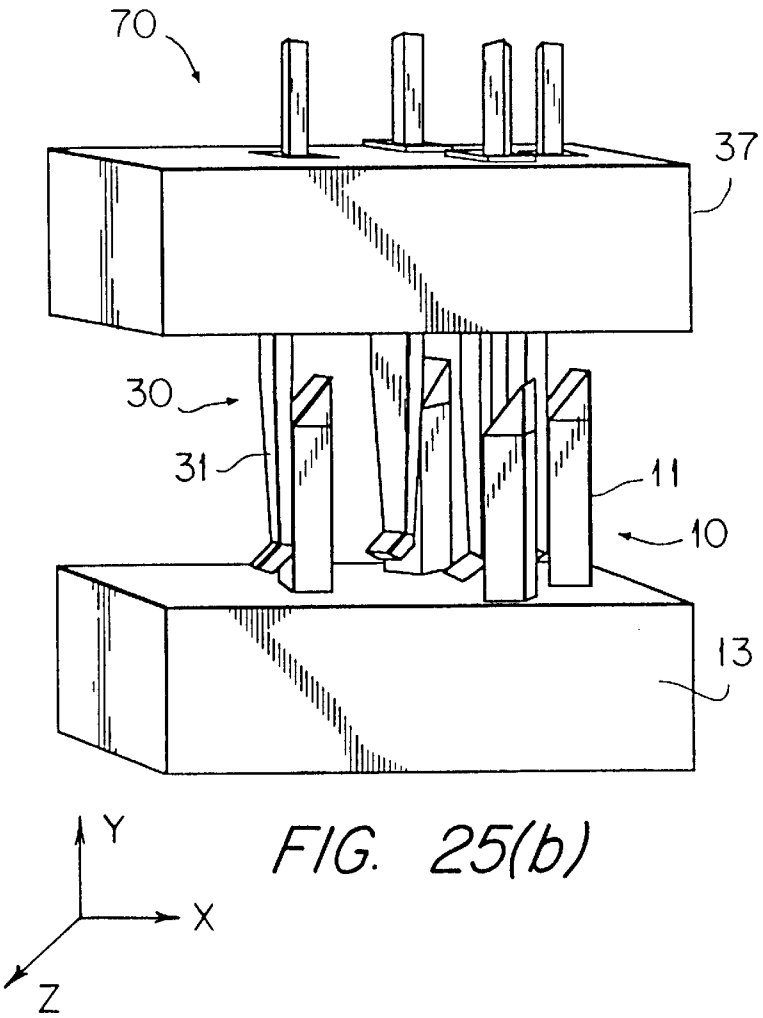
FIG. 25(*a*) is a perspective view of a third type of low-insertion-force or zero-insertion-force component in a first state.
Figure 25A:
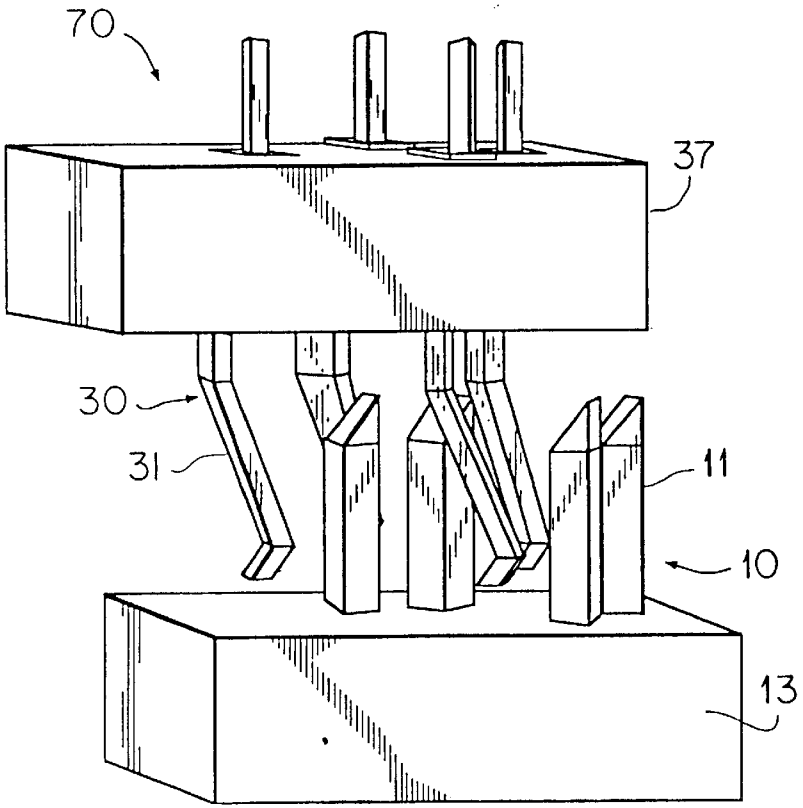

FIGS. 25(*a*) and 25(*b*) (collectively referred to herein as "FIG. 25") show a third type of zero-insertion-force interconnect system 70 or very-low-insertion-force interconnect system 70 in accordance with the present invention. In the system of FIG. 25, the projection-type interconnect component 10 includes several (e.g., three) conductive posts 11 attached to an insulative substrate 13, and the receiving-type component 30 includes several (e.g., three) conductive beams 31 attached to another insulative substrate 37. The leftward post 11 in FIGS. 25(*a*) and 25(*b*) is from a projection-type interconnect component other than the projection-type interconnect component associated with the remaining posts shown in FIGS. 25(*a*) and 25(*b*). Similarly, the leftward beam 31 in FIGS. 25(*a*) and 25(*b*) is from a receiving-type interconnect component other than the receiving-type interconnect component associated with the remaining beams shown in FIGS. 25(*a*) and 25(*b*).

FIG. 25(*a*) shows the interconnect system during the mating process, and FIG. 25(*b*) shows the interconnect system in the mated condition. Mating through use of the system of FIG. 25 is performed as follows. First, substrate 13 and substrate 37 are moved toward one another in the X plane until the condition shown in FIG. 25(*a*) is achieved. Next, the substrates 13 and 37 are moved parallel to one another (for example, by a cam or other mechanical device) in the X plane until the contact portions of the posts 11 and the contact portions of the beams 31 contact or mate, as shown in FIG. 25(*b*). Essentially no insertion force is required to achieve the condition shown in FIG. 25(*b*) because the posts 11 and beams 31 do not contact one another until after the condition shown in FIG. 25(*b*) is achieved.

Figure 26A:
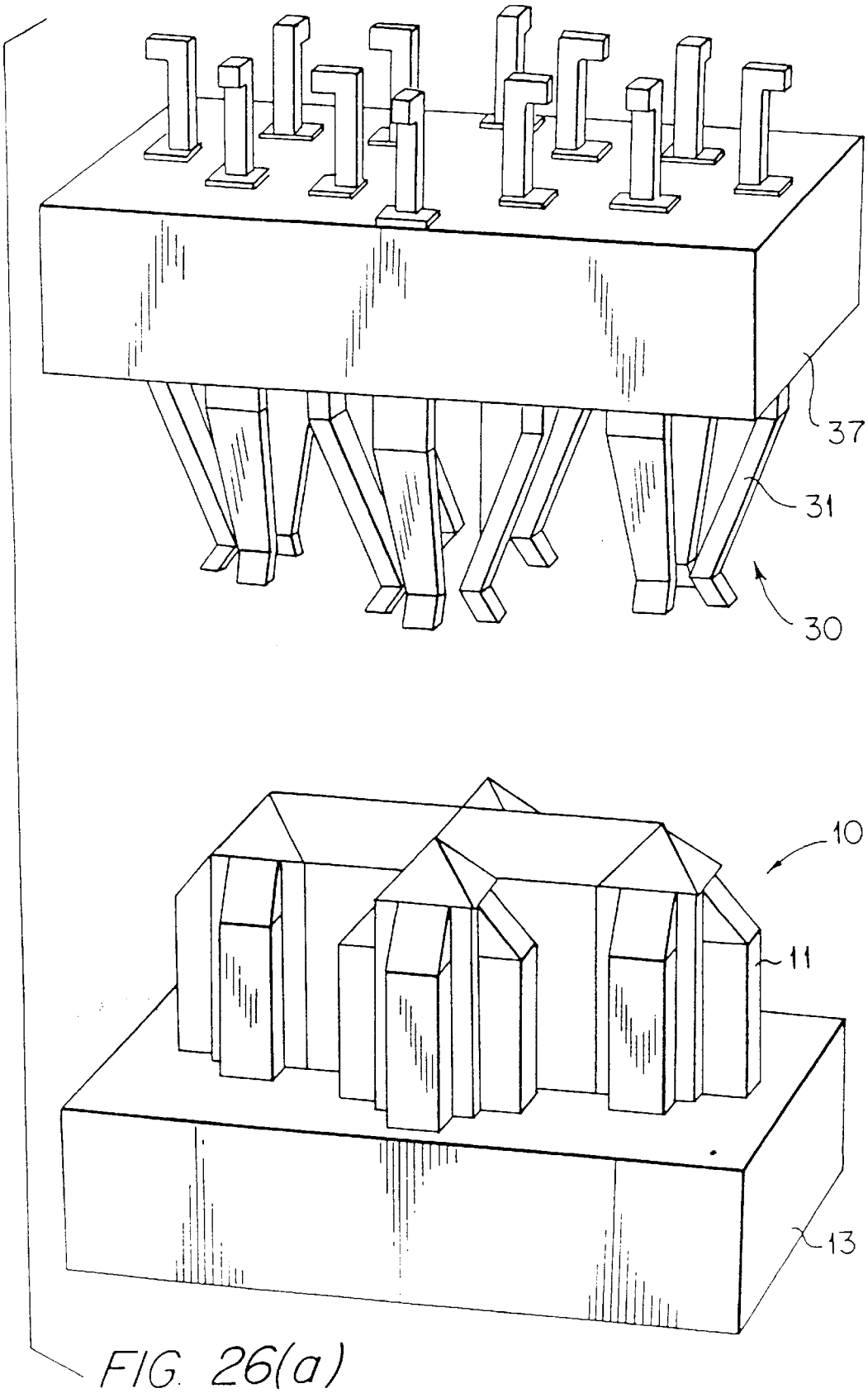
FIG. 26(*a*) is a perspective view of an interconnect system including the interconnect component of FIG. 12(*a*) in a position prior to mating.
Figure 26B:
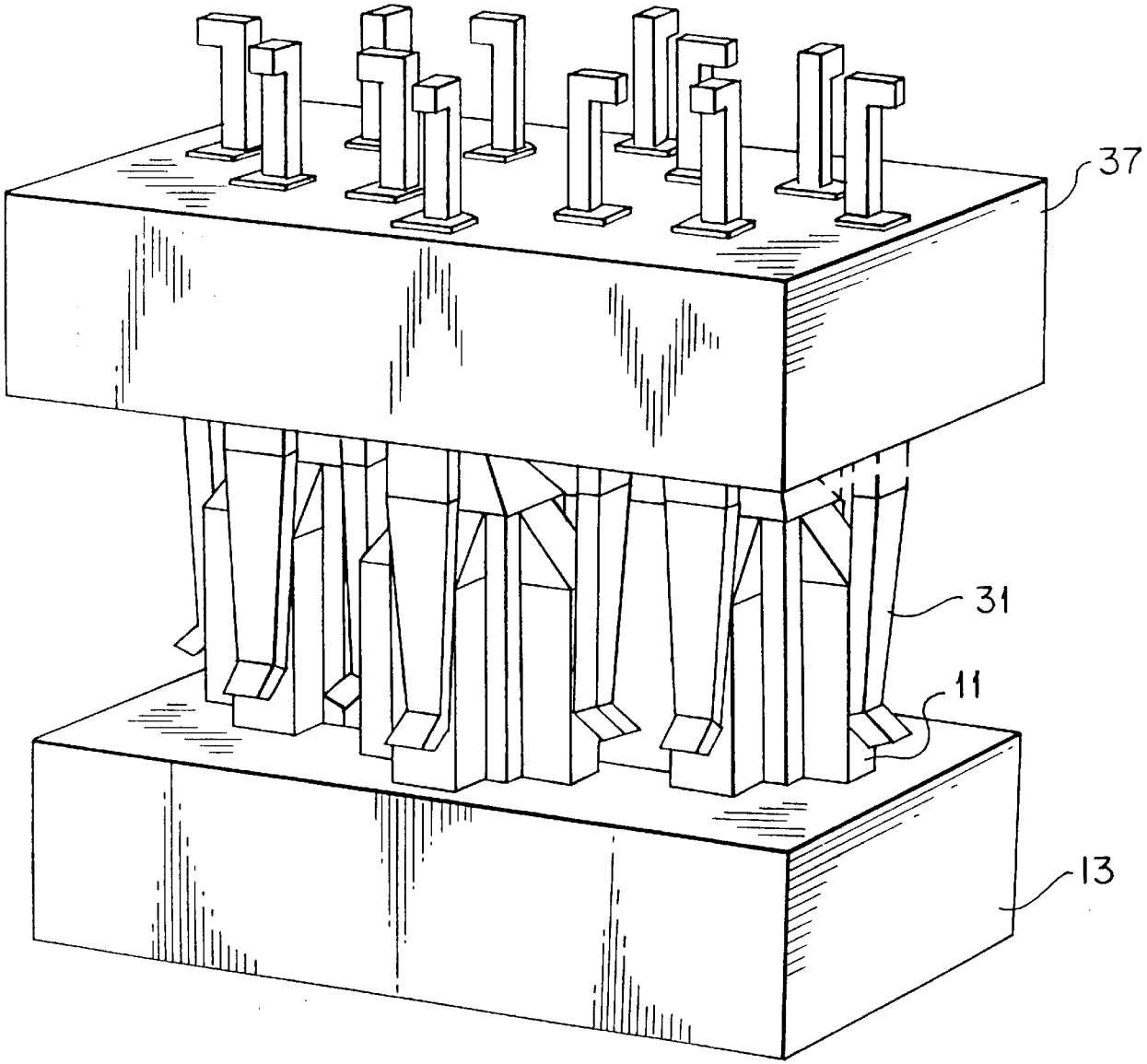

FIG. 26(*a*) illustrates the projection-type interconnect component 10 of FIG. 12(*a*) prior to mating with a corresponding receiving-type interconnect component 30, and FIG. 26(*b*) illustrates such components after mating has occurred. The receiving-type interconnect component of FIGS. 26(*a*) and 26(*b*) includes, for example, twelve conductive beams 31 for mating with the conductive posts 11 of the corresponding projection-type interconnect component 10.

Figure 27A:
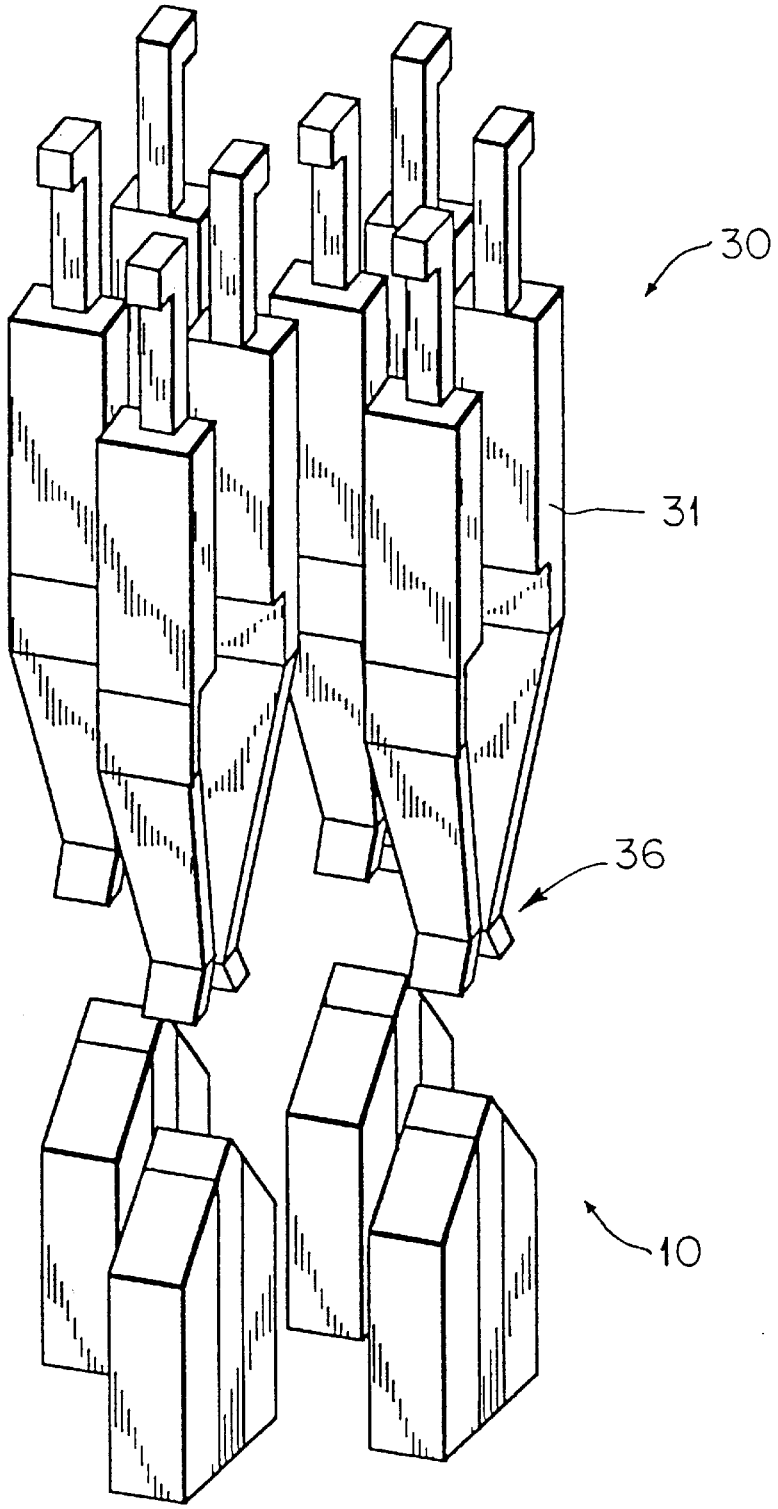
FIG. 27(*a*) is a perspective view of an interconnect system including the interconnect component of FIG. 13(*a*) in a position prior to mating.
Figure 27B:
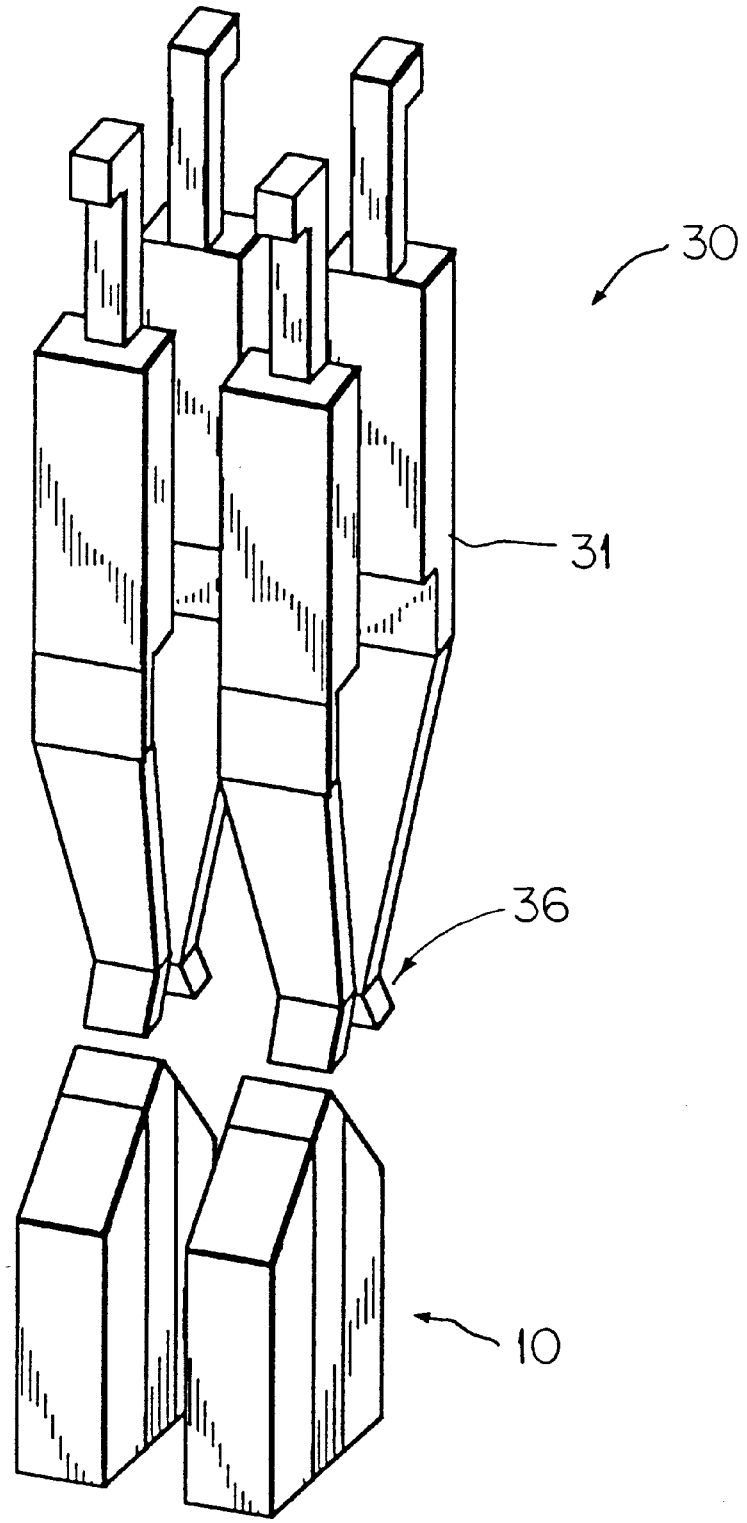
Figure 27C:
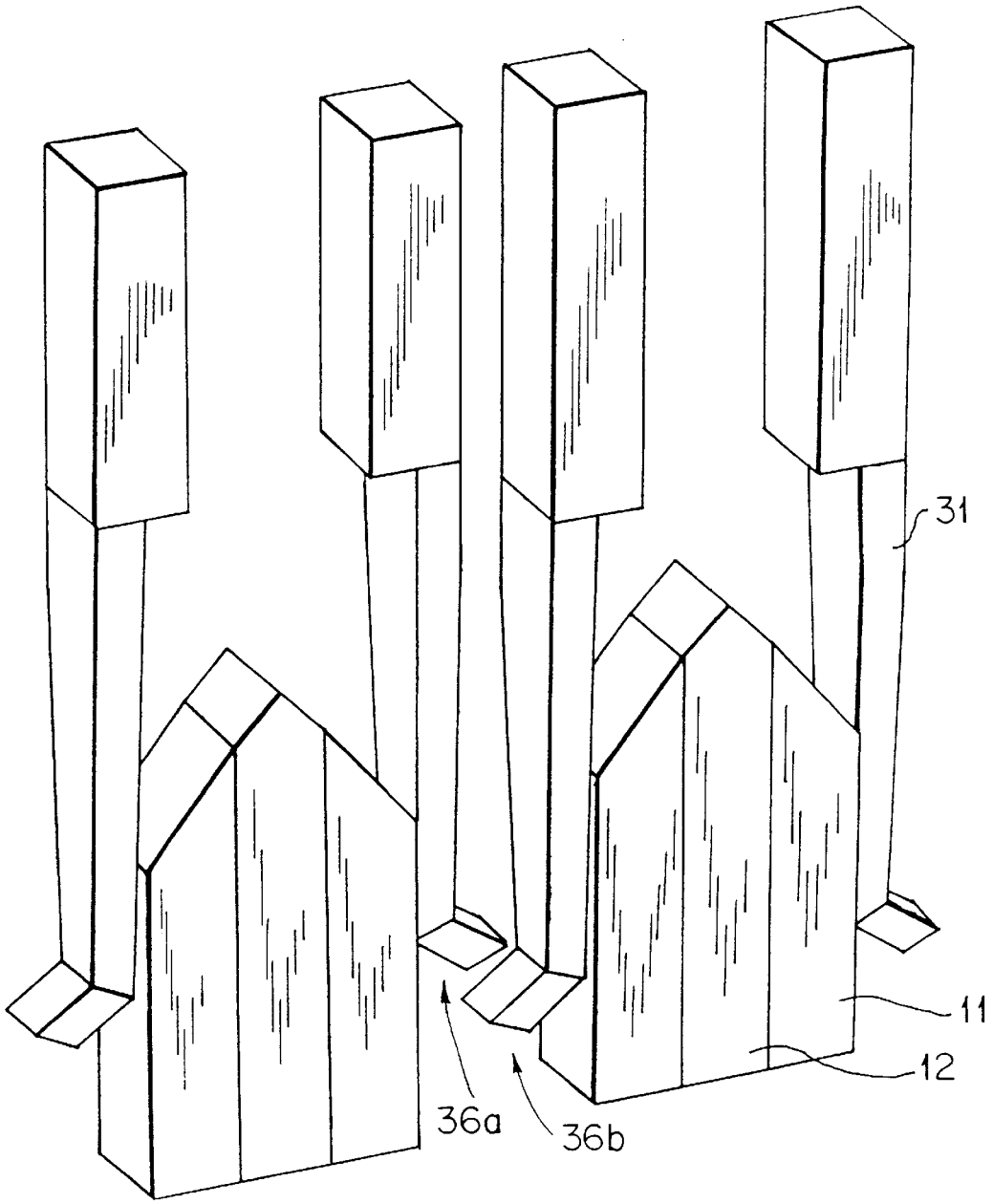

FIGS. 27(*a*), 27(*b*), and 27(*c*) illustrate the mating of at least one projection-type interconnect component 10 of FIG.

13(*a*) within a corresponding receiving-type interconnect component 30. Each receiving-type interconnect component 30 of FIGS. 27(*a*), 27(*b*), and 27(*c*) includes two conductive beams 31 for mating with the two conductive posts of the projection-type interconnect component. FIG. 27(*a*) shows the interconnect system wherein the projection-type interconnect components are arranged in a diamond-shaped or offset configuration. FIG. 27(*b*) shows the interconnect system wherein the projection-type interconnect components are located side-by-side. FIG. 27(*c*) shows the interconnect system in a mated position. The lead-in portions 36*a* and 36*b* of the conductive beams 31 in FIG. 27(*c*) are at different heights to allow for beam clearance and an arrangement having an even higher density.

HYBRID ELECTRICAL INTERCONNECT COMPONENTS

Figure 28B:
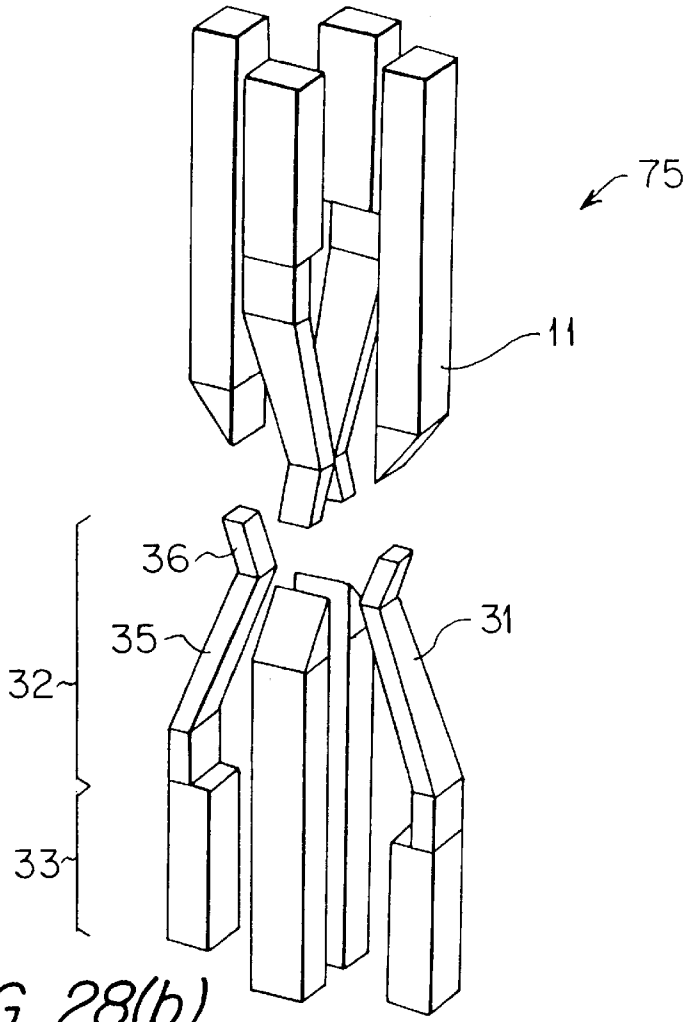
FIG. 28(*a*) is a perspective view of an electrical interconnect system using hybrid interconnect components prior to mating.
Figure 28A:
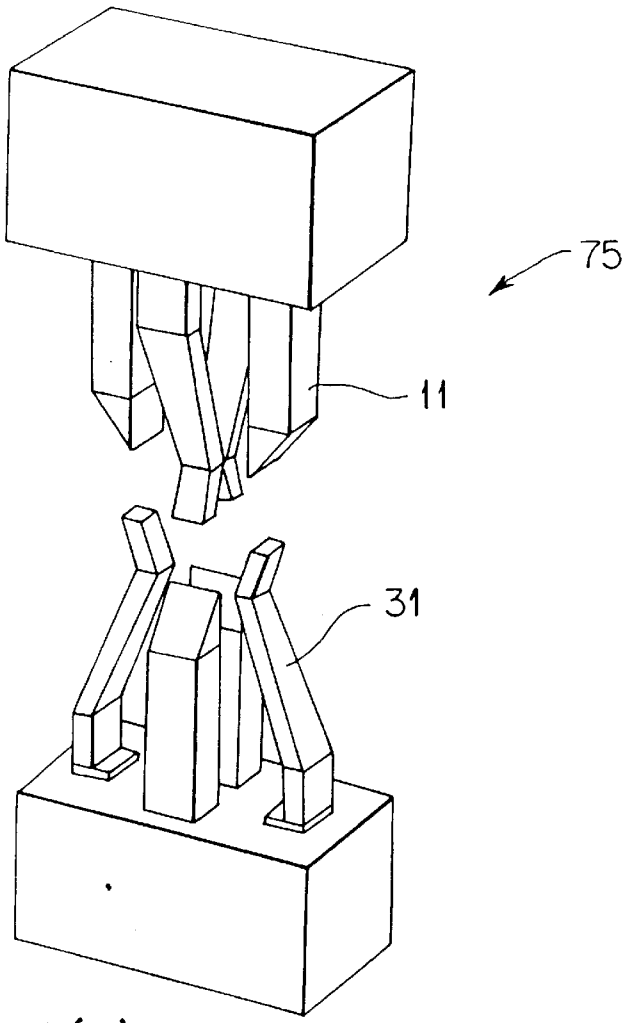

Heretofore, projection-type electrical interconnect components 10 having a plurality of posts 11 have been discussed. Receiving-type electrical interconnect components 30 having a plurality of conductive beams 31 have also been discussed. FIG. 28(*a*) shows a pair of hybrid electrical interconnect components 75. Each of the hybrid electrical interconnect components 75 includes a plurality of conductive posts 11 and a plurality of conductive beams 31. For the upper hybrid electrical interconnect component 75 in FIG. 28(*a*), the conductive posts 11 are closer to one another than are the conductive beams 31. For the lower hybrid electrical interconnect components 75 in FIG. 28(*a*), the conductive beams 31 are closer to one another than are the conductive posts 11. The hybrid electrical interconnect components 75, like the projection-type electrical interconnect components 10 and the receiving-type electrical interconnect components 30, may include a buttress (not shown in FIG. 28(*a*)), if desired.

FIG. 28(*b*) shows the various portions which make up the conductive posts 11 and the conductive beams 31 used in the hybrid electrical interconnect components 75. For example, FIG. 28(*b*) shows that each conductive beam 31 in a hybrid electrical interconnect component 75 may include a contact portion 32 having an interface portion 35 and a lead-in portion 36, and a stabilizing portion 33. Foot portions for the conductive posts 11 and conductive beams 31 are not shown in FIGS. 28(*a*) and 28(*b*), although foot portions are applicable to hybrid electrical interconnect component 75.

Figure 29A:
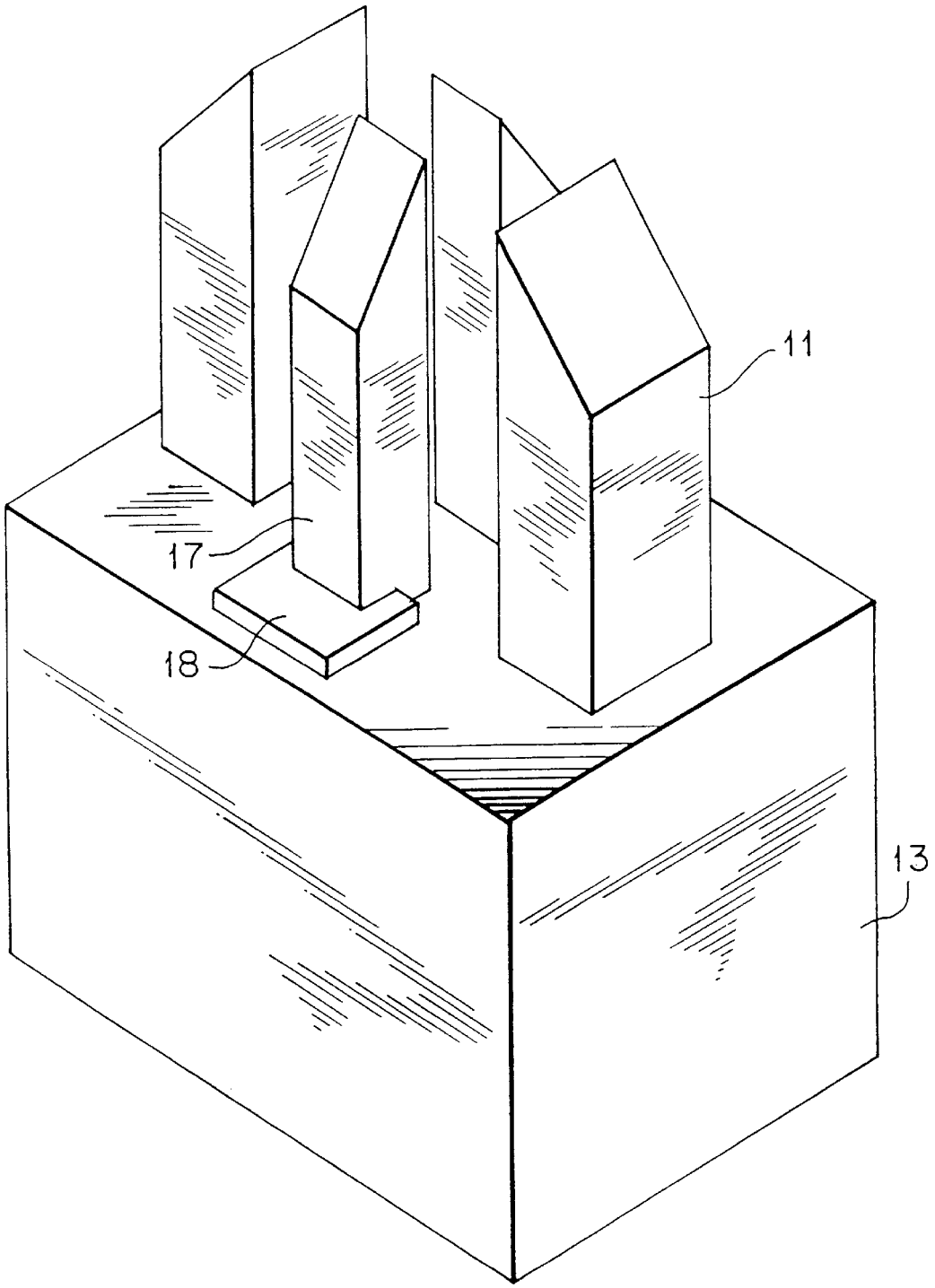
FIG. 29(*a*) is a perspective view of a projection-type interconnect component in accordance with the present invention.
Figure 29B:
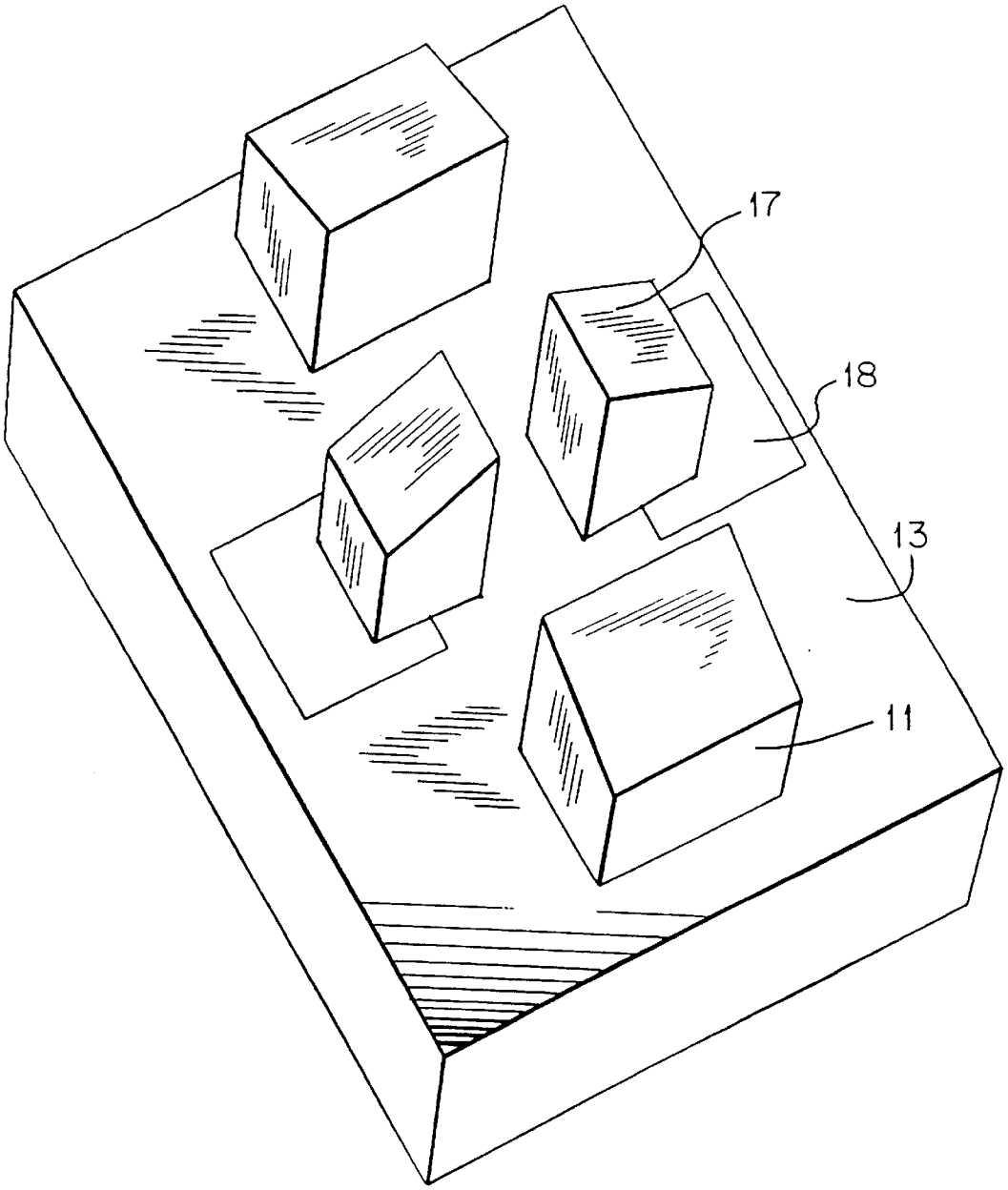

FIGS. 29(*a*) and 29(*b*) show a variation on the previously-disclosed projection-type electrical interconnect component 10. In FIGS. 29(*a*) and 29(*b*), opposing posts 11 are of the same width, but the posts 11 that are next to one another around the periphery of the interconnect component are of different widths. Moreover, the conductive posts 11 have contact portions 17 that are offset toward one another as compared to the stabilizing portions 18 of such posts. As with other projection-type interconnect components, the component shown in FIGS. 29(*a*) and 29(*b*) may have an insulative buttress (not shown in these figures), and that component may be configured for receipt within a corresponding receiving-type electrical interconnect component.

THE INSULATIVE SUBSTRATES

As explained above, the conductive posts of the projection-type interconnect component are attached to an insulative substrate 13. Likewise, the conductive beams of the receiving-type component are attached to an insulative substrate 37.

Figure 30A:
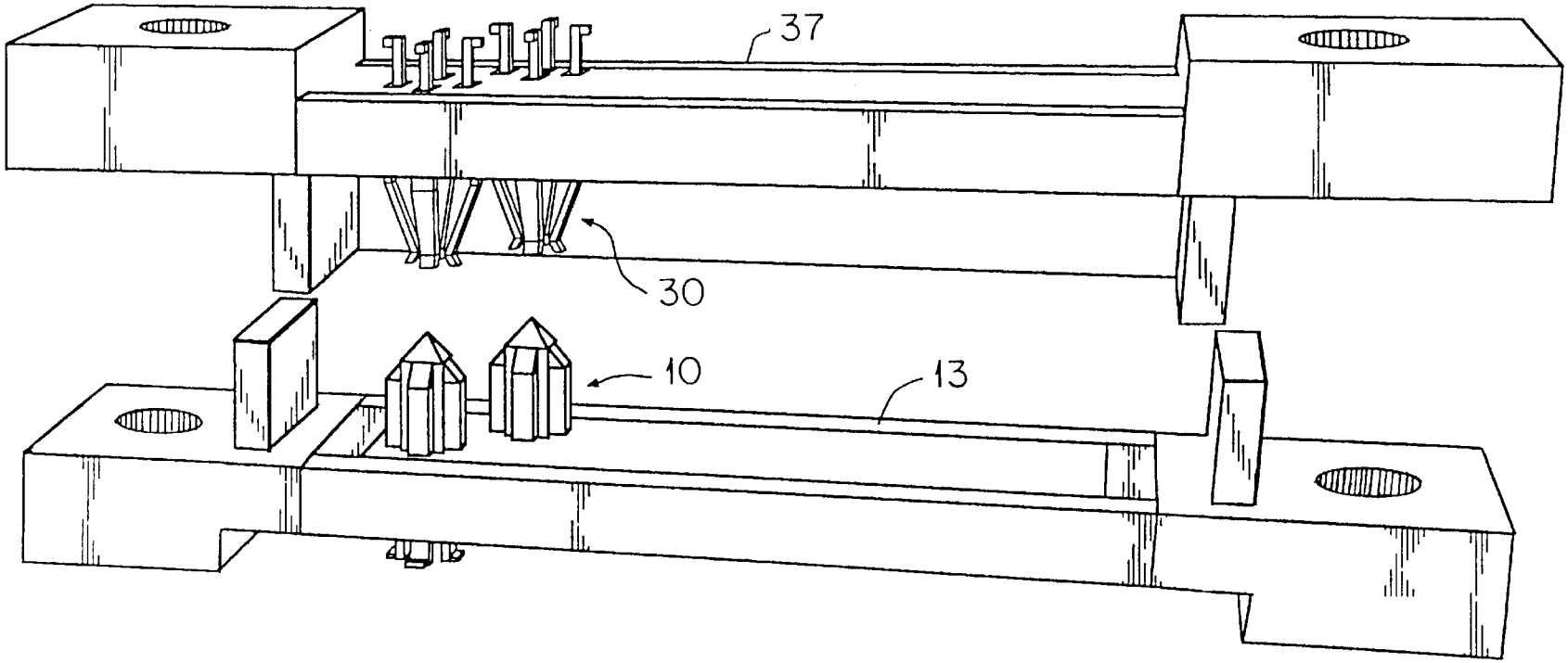
FIG. 30(*a*) is a perspective view of an electrical interconnect system showing insulative electrical carriers functioning as the substrates for the system.
Figure 30B:
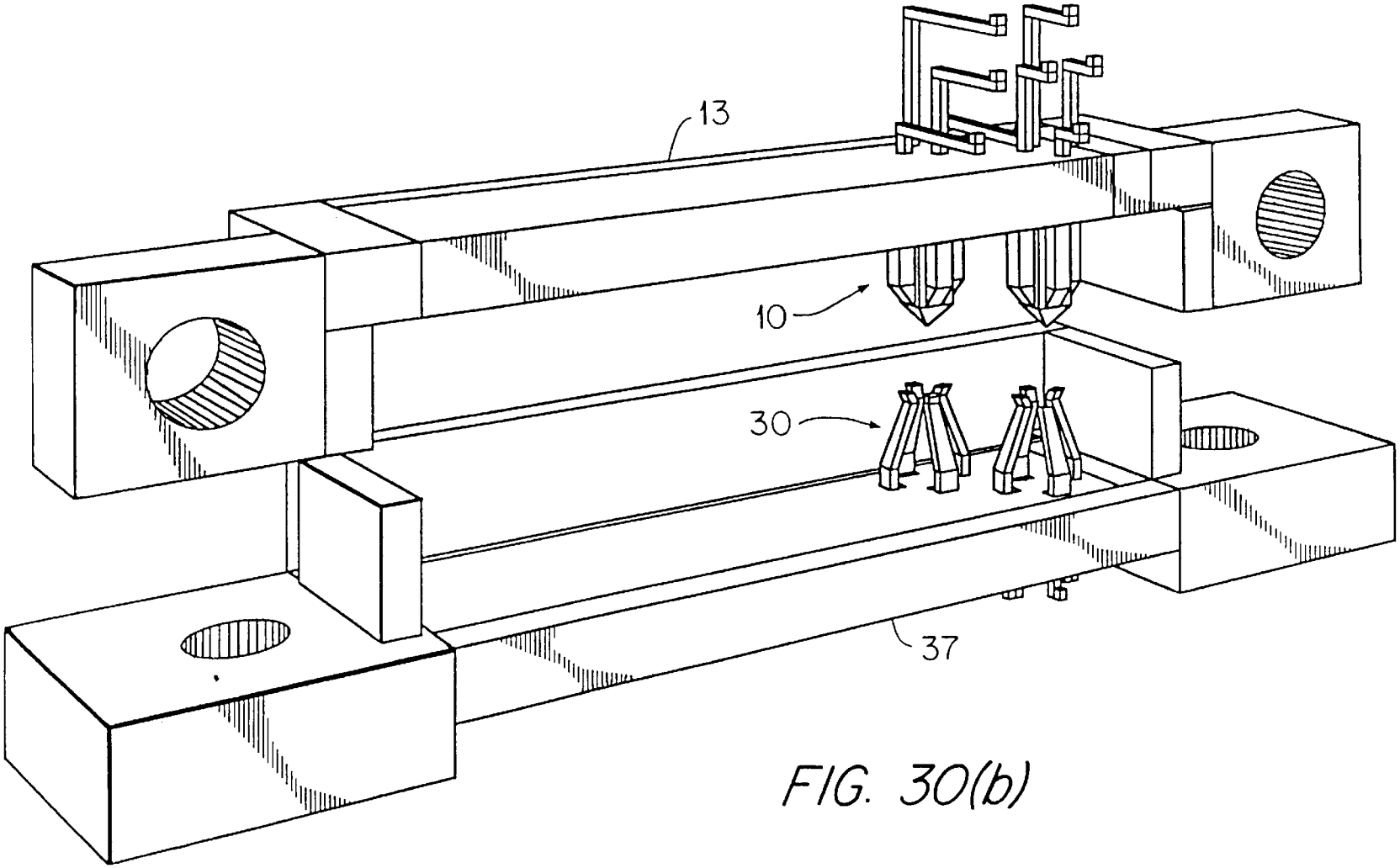

FIGS. 30(*a*) and 30(*b*) (referred to collectively herein as "FIG. 30") show an insulative electrical carrier functioning as the substrate 13 for the projection-type interconnect component 10 and an insulative electrical carrier functioning as the substrate 37 for the receiving-type interconnect component 30. The carrier 13 in FIG. 30(*b*) is arranged so that a right-angle connection may be made using the foot portions of the projection-type interconnect component 10. The carrier 37 in FIG. 30(*b*), as well as the carriers in FIG. 30(*a*), are arranged for straight rather than right-angle connections. Either carrier in FIG. 30(*a*) or FIG. 30(*b*) could be a right-angle or a straight carrier.

When used for surface mounting to a printed wire board, for example, the foot portion of each post and/or beam being surface mounted could extend beyond the furthest extending portion of the substrate by approximately 0.3 mm. This compensates for inconsistencies on the printed wiring board, and makes the electrical interconnect system more flexible and compliant.

The connectors of FIG. 30 are polarized so that the chance of backward mating is eliminated. Keying is another option which can differentiate two connectors having the same contact count.

THE INTERCONNECT ARRANGEMENT

The present invention holds a distinct advantage over prior art electrical interconnect systems because the interconnect components of the present invention can be arranged in a nested configuration far more dense than typical grid arrays or edge connector arrangements. Such a configuration is not contemplated by existing prior art electrical interconnect systems.

Figure 31:
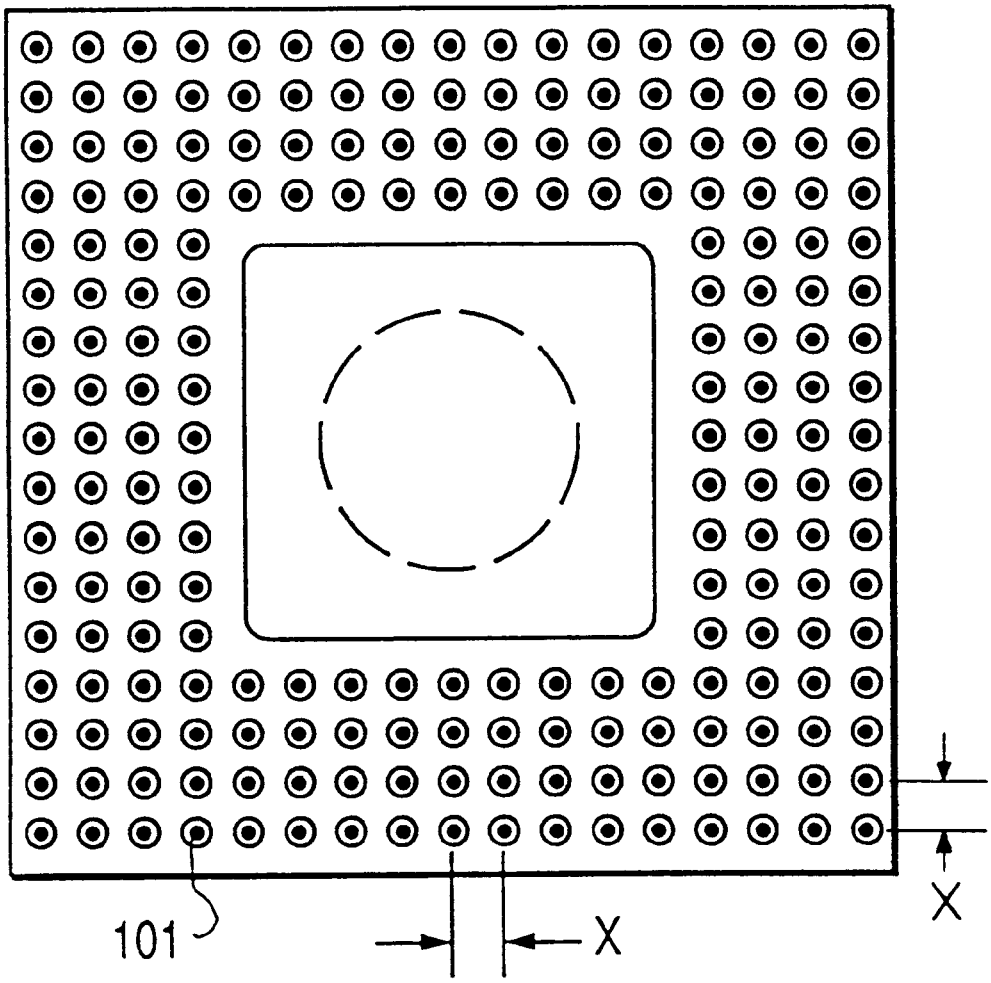
FIG. 31 PRIOR ART
FIG. 31 is a top view of a conventional grid array.

A prior art grid array is shown in FIG. 31. In a typical prior art grid array, several rows of post-type interconnect components 101 are positioned on a support surface. All of the posts 101 of the grid array within a given row or column are separated from one another by a distance X. In the grid array of FIG. 31, the minimum distance that X may be is approximately 1.25 mm. This could yield a density of 400 contacts per square inch.

The present invention is capable of providing much higher densities. Instead of using a grid or rows of individual posts for connecting to respective individual sockets, the electrical interconnect system of the present invention arranges a plurality of conductive posts into groups, with the groups being interleaved among one another for receipt of each group within a respective receiving-type interconnect component. Like the conductive posts, the conductive beams are also arranged into groups, with the groups being interleaved among one another each for receiving a respective projection-type interconnect component. Thus, while prior art interconnect systems function by interconnecting individual pins with individual sockets, the present invention increases density and flexibility by interconnecting individual projection-type interconnect components including groups of posts with individual receiving-type interconnect components including groups of beams, in the most efficient manner possible.

Figure 32:
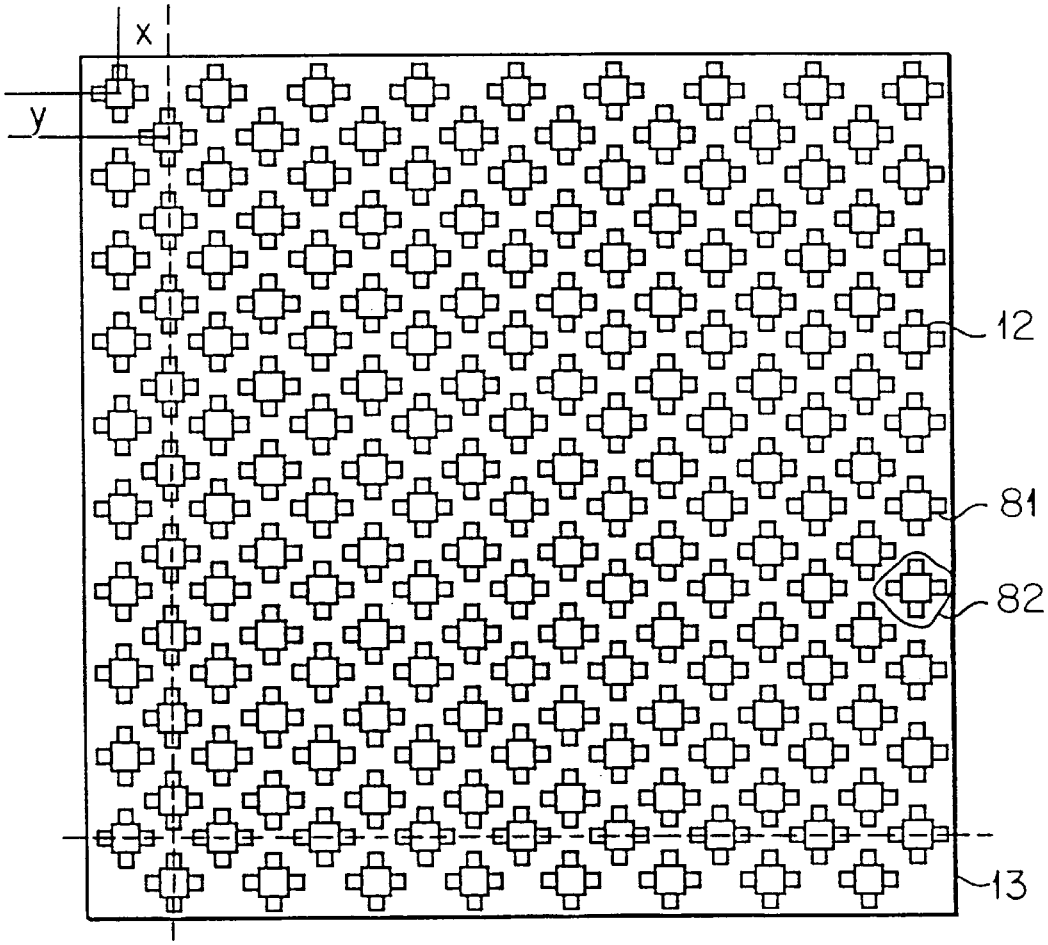
FIG. 32 is a view of a nested arrangement of electrical interconnect components in accordance with the present invention.

FIG. 32 depicts an arrangement of groups of holes or passages 81 in accordance with the present invention. In accordance with the arrangement of FIG. 32, groups of holes or passages 81 are formed in an insulated substrate 13. A conductive post 11 (FIG. 5, for example) is fitted within each of the passages to form an array of projection-type interconnect components or, alternatively, a conductive beam 31 (FIG. 14, for example) is fitted into each of the passages to form an array of receiving-type interconnect components.

Herein, reference numeral 82 will be used to refer to each group of contacts forming an interconnect component or, more generically, to the interconnect component including the group of contacts. Thus, each interconnect component 82 referred to herein may be a projection-type interconnect component 10 including a plurality of conductive posts 11 or, alternatively, a receiving-type interconnect component 30 including a plurality of conductive beams 31 or, alternatively, a hybrid interconnect component (see FIG. 28, for example) including a plurality of conductive posts 11 and a plurality of conductive beams 31.

If the electrical interconnect components 82 are projection-type interconnect components, each of the interconnect components 82 is configured for receipt within a corresponding receiving-type interconnect component (e.g., the receiving-type interconnect component shown in FIG. 14). Furthermore, the conductive contacts of each interconnect component are arranged such that the contacts of each interconnect component may be interleaved or nested within the contacts of other ones of the interconnect components. In other words, the conductive contacts of the array are arranged so that portions of each group 82 overlap into columns and rows of adjacent groups of contacts to achieve the highest possible density while providing adequate clearance for the mating beams of the receiving-type interconnect components used. It should be noted that while each group of contacts or electrical interconnect component 82 of FIG. 32, when such components are projection-type interconnect components or hybrid interconnect components, may have a buttress 12 located at a central portion of that interconnect component, either in contact with the conductive contact or not in contact with the conductive contacts, one or more (e.g., all) of the interconnect components may be without a buttress. When the electrical interconnect components are receiving-type interconnect components, such components do not include a buttress.

As shown in FIG. 32, each group of contacts 82 forming an interconnect component may be arranged in the shape of a cross. However, other shapes (such as would result from the components illustrated in FIGS. 12(*a*), 12(*b*), 13(*a*), 13(*c*), 25, 28, or 29, or other shapes that may be easily nested) are contemplated. The grouping of contacts into the shape of a cross (as in FIG. 32) aids in balancing beam stresses to keep the conductive beams of each receiving-type interconnect component or hybrid interconnect component from being overly stressed. Further, the use of cross-shaped groups results in alignment advantages not found in prior art systems such as the grid array of FIG. 31. For example, the cross-shaped interconnect components shown in FIG. 32, when the electrical interconnect components 82 are projection-type interconnect components, each align with the beams of a corresponding receiving-type interconnect component, causing the whole arrangement of FIG. 32 to be similarly aligned.

The nesting of groups (e.g., cross-shaped groups) of holes or contacts (i.e., the nesting of projection-type, receiving-type, or hybrid interconnect components) allows adequate clearance between the contacts for mating with corresponding interconnect components, while decreasing to a minimum the space between the contacts. No prior art system known to the inventor utilizes space in this manner. Furthermore, as explained above, when the electrical interconnect components 82 are projection-type interconnect components or hybrid interconnect components, the inclusion of a buttress between the contacts of each electrical interconnect component 82 is optional. In the absence of a buttress, each group of posts 11 for each projection-type interconnect component or hybrid interconnect component is capable of spreading corresponding conductive beams of corresponding interconnect components during mating due to the sloped upper surfaces of the posts.

The nested configuration of FIG. 32 eliminates the need for providing insulative walls between the contacts, although such insulative walls may be used if desired. Also, although the nested configuration of FIG. 32 may be an arrangement for the posts 11 of projection-type interconnect components in an electrical interconnect system, the nested configuration of FIG. 32 could also be the arrangement for the beams 31 of the receiving-type interconnect components for that system. For example, for both the projection-type and receiving-type interconnect components within a given electrical interconnect system, the contacts of such components could be arranged so that portions of each group of contacts associated with an electrical interconnect component overlap into columns and rows of adjacent groups of contacts associated with other electrical interconnect components. In other words, both the projection-type and receiving-type components within a given electrical interconnect system may be arranged in a nested configuration. This also applies to electrical interconnect systems incorporating hybrid electrical interconnect components. Furthermore, by arranging the contacts into groups (e.g., the cross-shaped groups 82 of FIG. 32), the foot portions of the interconnect components for each group may be arranged to enhance the layout and trace routing of the interface devices (e.g., printed wire boards) being interconnected.

Figure 33B:
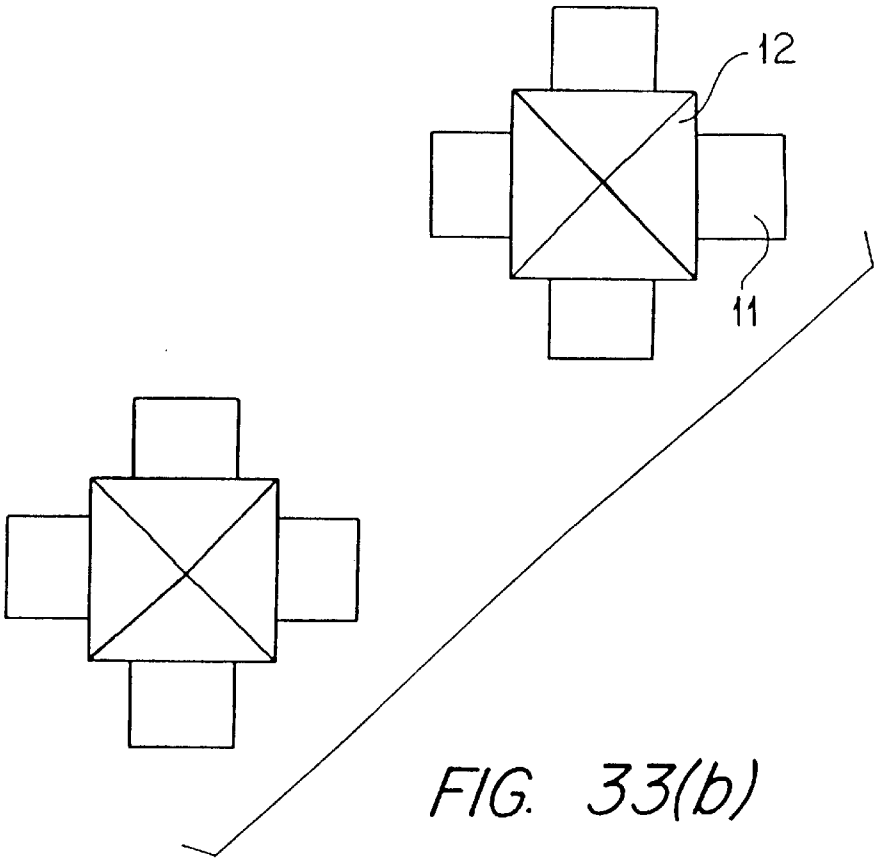
FIG. 33(*a*) is a view of an arrangement of electrical interconnect components in accordance with the present invention.
Figure 33A:
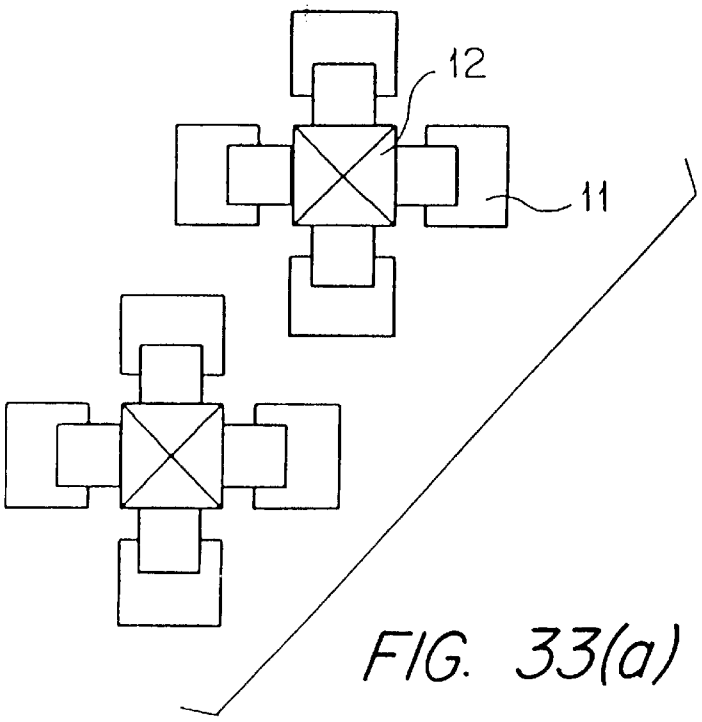

The density of the interconnect arrangement of FIG. 32, when the electrical interconnect components 82 are projection-type interconnect components or hybrid interconnect components each including a buttress, depends on the configuration of the posts and beams, the spacing between buttresses, and the size of the buttresses used. In accordance with the illustrations in FIGS. 33(*a*) and 33(*b*), respectively, the cross-section of each buttress 12 may be 0.5 mm×0.5 mm, 0.9 mm×0.9 mm, or some other dimension. As an example, the interconnect components of FIG. 33(*a*) may each include a 0.5 mm×0.5 mm buttress and offset posts such as that shown in FIG. 7, and the interconnect components of FIG. 33(*b*) may each include a 0.9 mm×0.9 mm buttress and non-offset posts such as that shown in FIG. 6. Preferably, as shown in FIGS. 33(*a*) and 33(*b*), both the distance between adjacent contacts within a single electrical interconnect component, and the distance between adjacent contacts from different electrical interconnect components, are greater than or equal to 0.2 mm.

Figure 34:
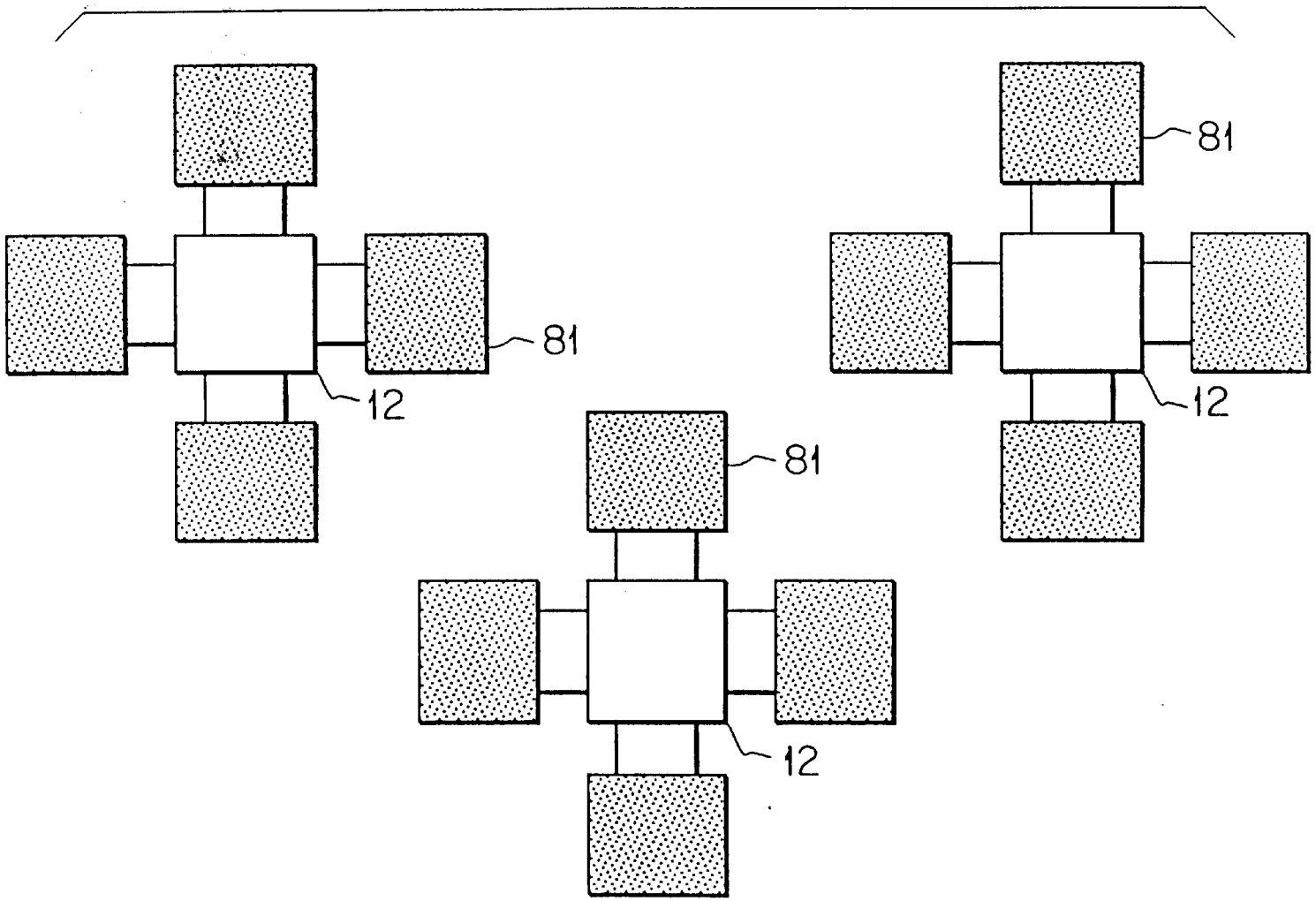
FIG. 34 is a view showing electrical interconnect components arranged in accordance with the nested arrangement illustrated in FIG. 32.

An arrangement wherein each buttress is 0.5 mm×0.5 mm is shown in FIG. 34. Even higher densities may be achieved when a buttress is not used.

For the arrangement of FIG. 32, when a 0.9 mm×0.9 mm buttress is used, a center-line to center-line distance X between columns of electrical interconnect components may be 1.5 mm; a center-line to center-line distance Y between rows of electrical interconnect components may be 1.25 mm; and the overall density for the arrangement may be 680 contacts per square inch. When a 0.5 mm×0.5 mm buttress is used, a center-line to center-line distance X between columns of electrical interconnect components may be 1.0 mm; a center-line to center-line distance Y between rows of electrical interconnect components may be 1.5 mm; and the overall density for the arrangement may be 828 contacts per square inch. When a small buttress or no buttress is used, a center-line to center-line distance X between columns of electrical interconnect components in a row may be 0.9 mm; a center-line to center-line distance Y between rows of electrical interconnect components may be 1.25 mm; and the overall density for the arrangement may be 1,028 contacts per square inch.

In the nested arrangement depicted in FIG. 32, the electrical interconnect components 82, whether of the projection-type, the receiving-type, or the hybrid type, are arranged in rows and columns on the insulative substrate 13 (the dotted lines a FIG. 32 designate a row and a column, respectively); the electrical interconnect components of adjacent rows of the arrangement are staggered as are the electrical interconnect components from adjacent columns of the arrangement; and the electrical interconnect components are interleaved among one another in a nested configuration such that a portion of each electrical interconnect component overlaps into an adjacent row of the electrical interconnect components or an adjacent column of the electrical interconnect components. The projection-type, receiving-type, and/or hybrid components within a given electrical interconnect system may all be arranged in accordance with the nested arrangement depicted in FIG. 32.

While FIG. 32 shows an arrangement having twenty rows and seventeen columns, arrangements having other numbers of rows and columns are envisioned. For example, arrangements having more or less than seventeen columns, and two, three, four, or more rows, are contemplated. Arrangements having two, three, and four rows and the like are particularly well-suited for use as edge connectors for PCBs and other such substrates.

Figure 35:
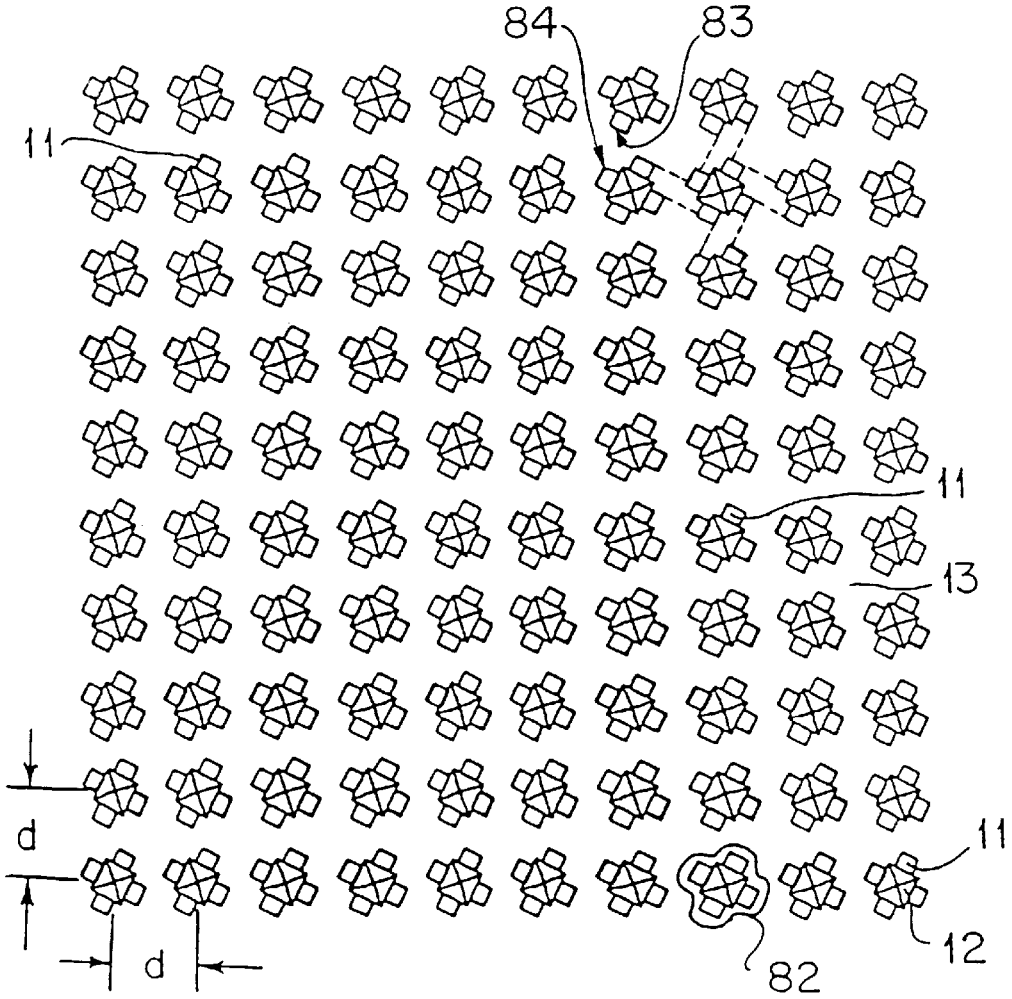
FIG. 35 is a view of a modified arrangement of electrical interconnect components in accordance with the present invention.

The nested configuration of FIG. 32 can be modified to provide even greater densities. An example of one contemplated modification is depicted in FIG. 35, which essentially results from rotating the arrangement of FIG. 32 and positioning the interconnect components such that even less space exists between the components. In the arrangement of FIG. 35, the electrical interconnect components 82, whether of the projection-type, the receiving-type, or the hybrid-type, are arranged in rows and columns on the insulative substrate 13; and at least one contact (e.g., a post 11 in FIG. 35) of each electrical interconnect component 82 includes a front surface 83 facing outwardly and away from that interconnect component along a line initially intersected by a side surface 84 of a contact from another electrical interconnect component of the arrangement. Also, in the arrangement of FIG. 35, adjacent interconnect components are offset such that a line drawn from the center of an interconnect component through the center of a contact for that component does not intersect the center of any interconnect components directly adjacent that component. It should be noted that, as with the nested arrangement depicted in FIG. 32, the arrangement in FIG. 35 uses cross-shaped groups of contacts for the electrical interconnect components, although other shapes are contemplated. Moreover, as with the arrangement of FIG. 32, the arrangement of FIG. 35 can be modified to include more or less rows and columns (for example, two, three, or four rows and eight columns) than those depicted. Also, all electrical interconnect components within a given electrical interconnect system (e.g., both the projection-type and receiving-type interconnect components in a pluggable system) may be arranged in accordance with the arrangement depicted in FIG. 35.

Figure 37:
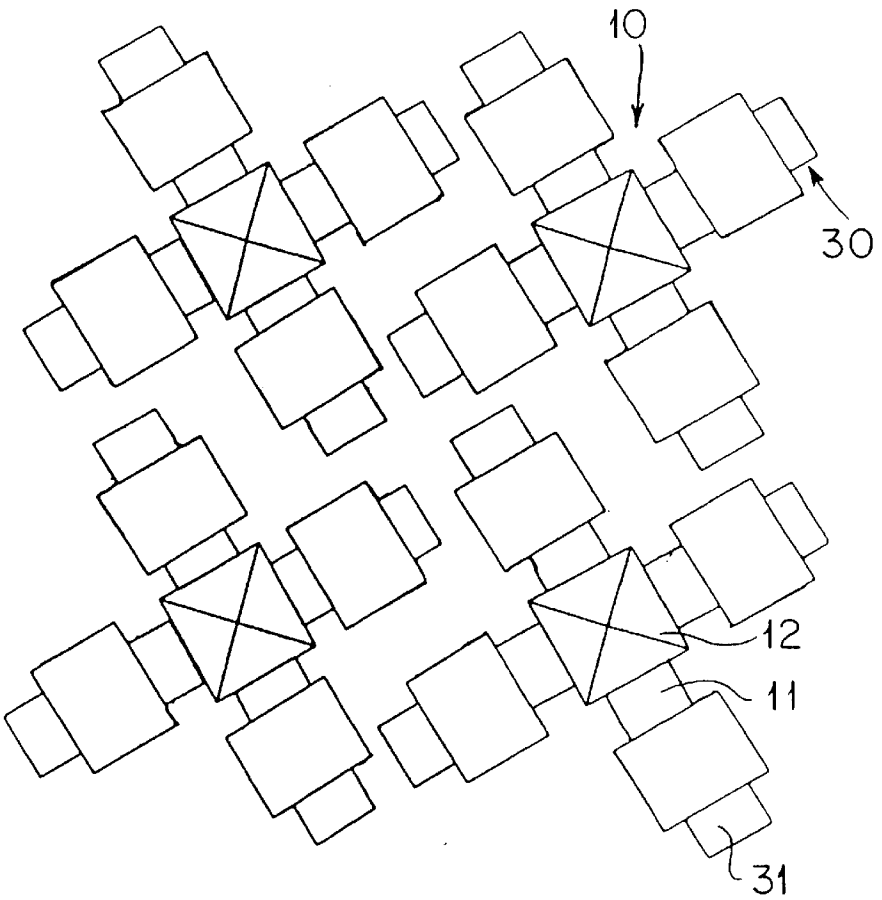
FIG. 37 is a view showing electrical interconnect components positioned in accordance with the modified arrangement shown in FIG. 35.
Figure 36:
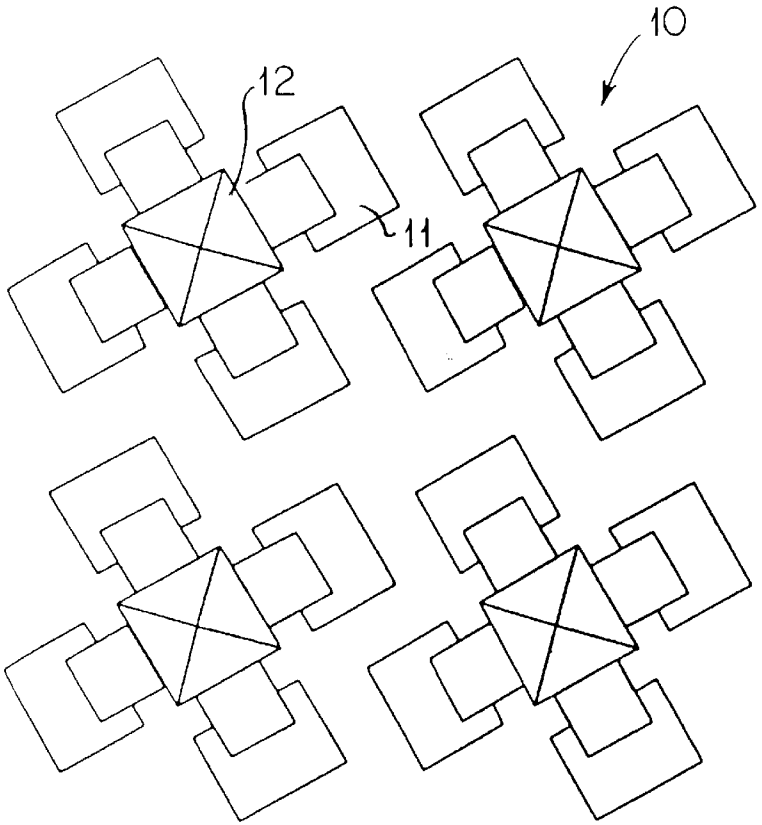
FIG. 36 is a view showing electrical interconnect components positioned in accordance with the modified arrangement shown in FIG. 35.

FIG. 36 shows a portion of the arrangement in accordance with FIG. 35 using buttresses that have a cross-section of 0.5 mm×0.5 mm. As seen from FIG. 37, when the projection-type electrical interconnect components 82 from FIG. 36 are each received within a corresponding receiving-type interconnect component 30, the conductive contacts or beams 31 of the receiving-type interconnect components are separated by a distance of 0.2 mm, for example.

Figure 38:
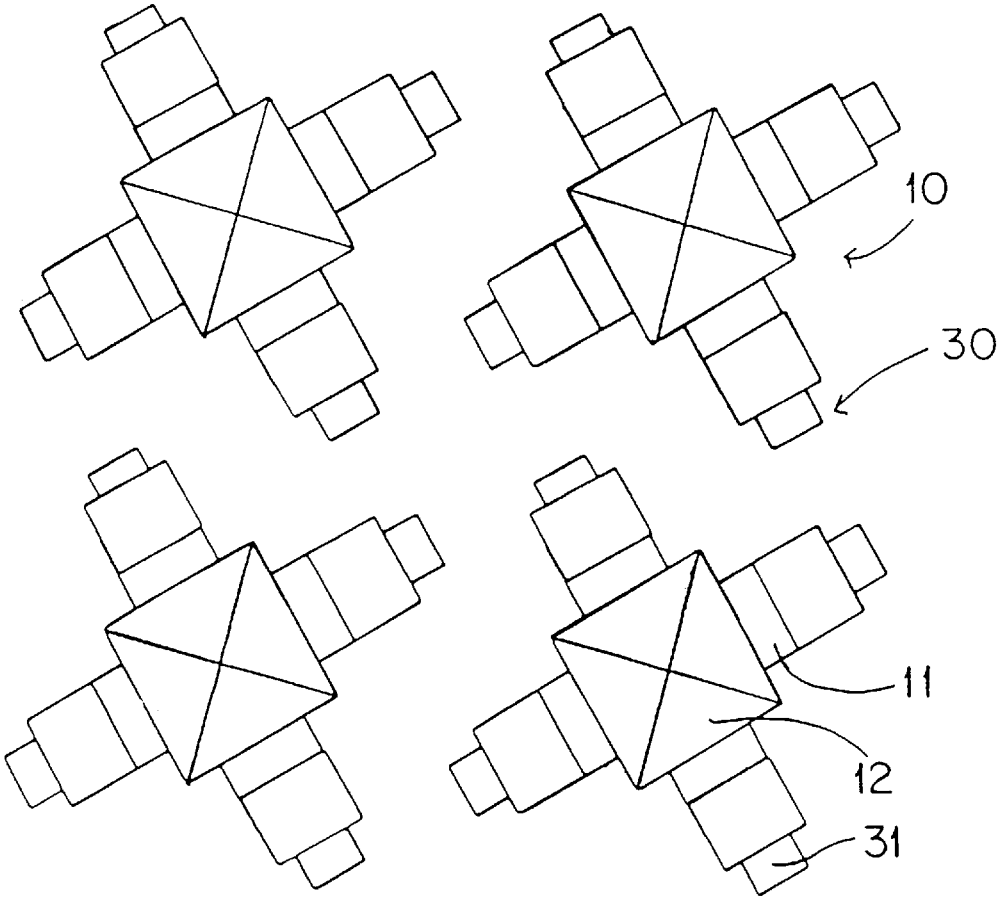
FIG. 38 is a view showing electrical interconnect components positioned in accordance with the modified arrangement shown in FIG. 35.

FIG. 38 is a view of projection-type electrical interconnect components 10 arranged in accordance with the arrangement of FIG. 35 and received within corresponding receiving-type interconnect components 30. In FIG. 38, the buttresses 12 for the projection-type interconnect components 10 may have a cross-section of 0.9 mm×0.9 mm. The distance between each conductive contact or beam 31 and the contact which it faces is 0.4 mm, for example.

It should be noted that for the arrangement of FIG. 35, when a 0.9 mm×0.9 mm buttress is used, the distance d between like surfaces of the contacts may be 2.19 mm; and the overall density for the arrangement may be 460 contacts per square inch. When a 0.5 mm×0.5 mm buttress is used, the distance d may be 1.60 mm; and the overall density for the arrangement may be 900 contacts per square inch. When no buttress is used, the distance d may be 1.5 mm; and the overall density for the arrangement may be 1,156 contacts per square inch.

In the arrangements of FIGS. 32 and 35, the rows and columns of each arrangement are continuous. In other words, aside from the regular spacing between the electrical interconnect components in each row and column, there are no breaks or interruptions in the rows or columns of the electrical interconnect components. Such continuous rows and columns are particularly useful in connection semiconductor chip bonding technologies wherein bonding occurs not only around the periphery of the semiconductor chip, but also directly beneath the chip. This is valuable in high pin count interconnects as well.

Figure 39:
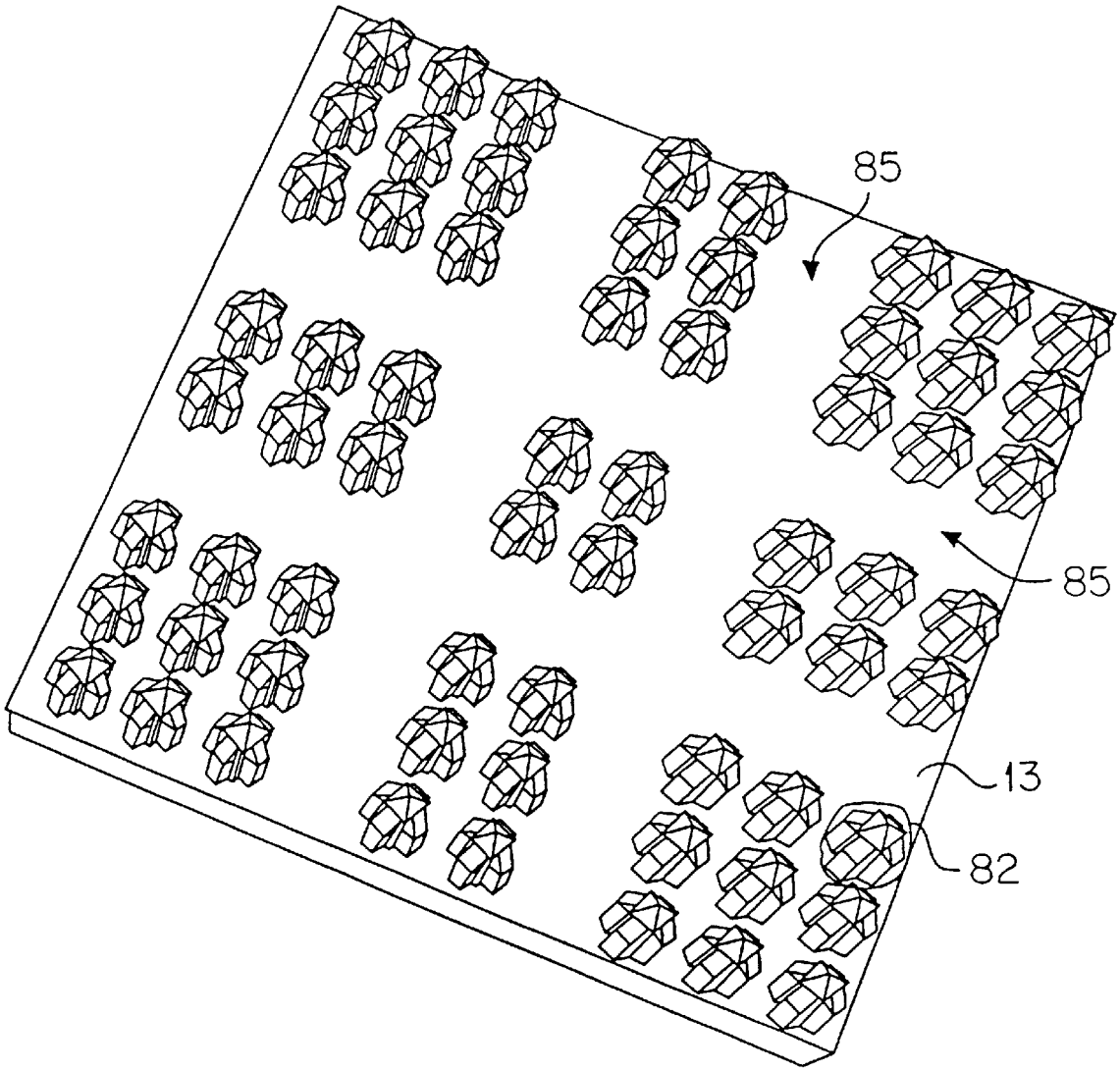
FIG. 39 is a view showing a discontinuous arrangement of electrical interconnect components in accordance with the modified arrangement of the present invention shown in FIG. 35.

Instead of being arranged in continuous rows and columns, the electrical interconnect components 82 (regardless of whether such components are of the projection-type, the receiving-type, or the hybrid-type) can be arranged in groups or clusters of four or more components separated by channels 85, as shown in FIG. 39. This type of arrangement, utilizing the channels 85 for routing traces, allows printed circuit boards and other interface surface traces to be routed easily to vias and the like on the interface surface. To promote such routing, the channels between the groups of clusters of electrical interconnect components 82 are wider than the spacings between the electrical interconnect components 82 within each group or cluster. The use of the channels 85 is applicable to all of the interconnect arrangements disclosed in the present application, including the arrangements of FIGS. 32 and 35.

Figure 40:
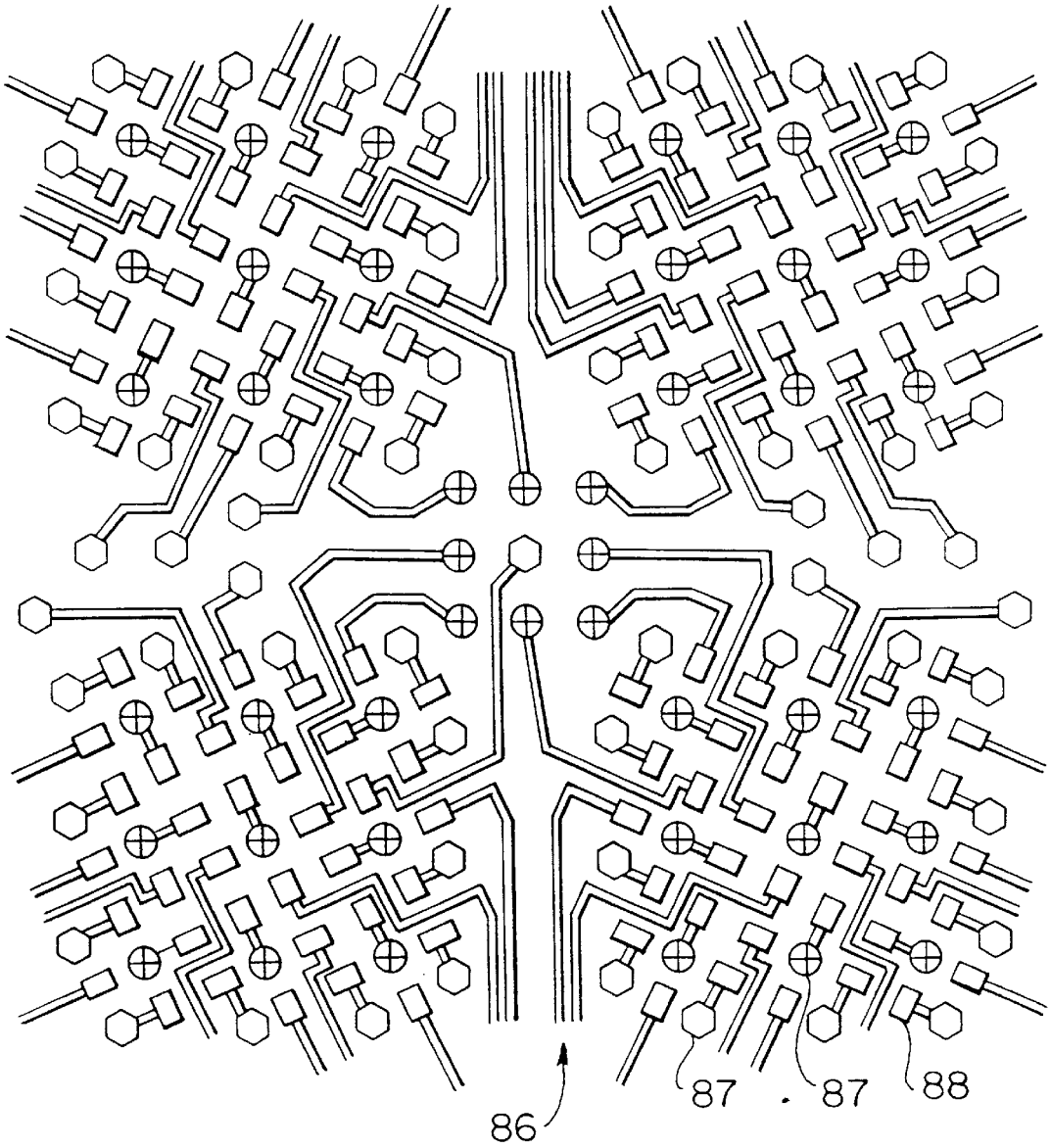
FIG. 40 is a view of a pattern on a printed circuit board suitable for use in connection with a discontinuous arrangement of electrical interconnect components in accordance with the present invention.

The channels 85 between the groups or clusters of electrical interconnect components correspond to spaces where vias, pads, through-holes, and/or traces can be positioned. FIG. 40 is an example of a pattern on a printed circuit board suitable for use in connection with a discontinuous arrangement of electrical interconnect components such as that shown in FIG. 39. The illustrated dimensions for the pattern are 17.33 mm and 17.69 mm, providing a density of 300 contacts per square inch. As can be seen from FIG. 40, the pattern of the printed circuit board includes traces 86, vias 87, and pads 88, for example, with the pads being arranged in a pattern corresponding to the pattern of the electrical interconnect components. The pattern of the printed circuit board shown in FIG. 40 routes traces, vias, and the like in the area of the printed circuit board corresponding to the channels 85 between the electrical interconnect components. Exemplary dimensions for the pattern shown in FIG. 40 are 0.15 mm for the width of the traces 86; 0.15 mm separating the traces 86 from other conductive components on the board surface; and a diameter of 0.6 mm for the vias 87. Although FIG. 40 shows an exemplary pattern from a circuit board or other substrate upon which electrical interconnect components in accordance with the present invention may be mounted, other patterns in accordance with the present invention are envisioned.

Figure 41B:
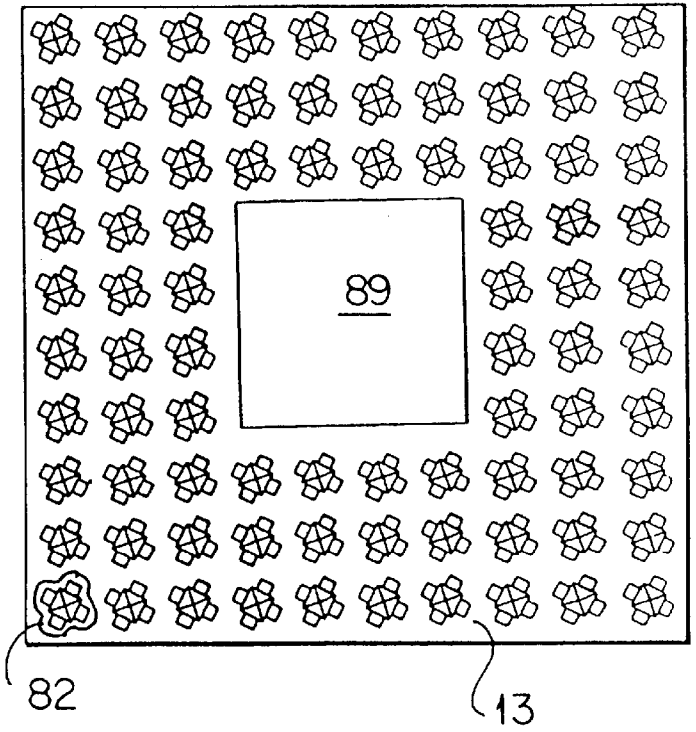
FIG. 41(*a*) is a view of an arrangement of electrical interconnect components in accordance with the nested arrangement of FIG. 32 modified to include a space at a center portion thereof.
Figure 41A:
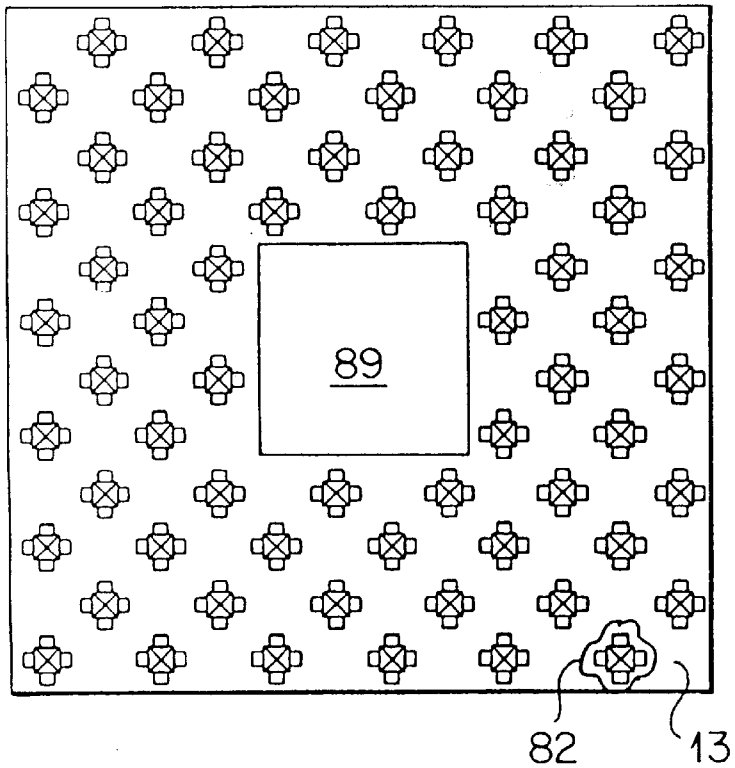

In addition to the continuous arrangements of FIG. 32 and 35, and the clustered or discontinuous arrangement of FIG. 39, all of the arrangements of the present invention can be modified to include a space 89 at a center portion thereof to facilitate interfacing with semiconductor chip carriers manufactured using bonding techniques such as wire bonding, TAB, and the like. FIGS. 41(*a*) and 41(*b*), respectively, are examples of the manner in which the arrangements of FIGS. 32 and 35 formed on the insulative substrate 13 can be modified to include a space 89.

FIG. 41(*a*) shows an example of the arrangement of electrical interconnect components 82 from FIG. 32 modified to include a space 89 at a central portion thereof. In FIG. 41(*a*), each of the sides of the array is approximately 25 mm long, so that 252 conductive contacts may be provided using only 625 sq. mm of area.

FIG. 41(*b*) shows an example of the arrangement of electrical interconnect components 82 from FIG. 35 modified to include a space 89 at a central portion thereof. In FIG. 41(*b*), each of the sides of the array is approximately 23 mm long, so that 336 contacts may be provided using only 529 sq. mm of area.

Figure 42:
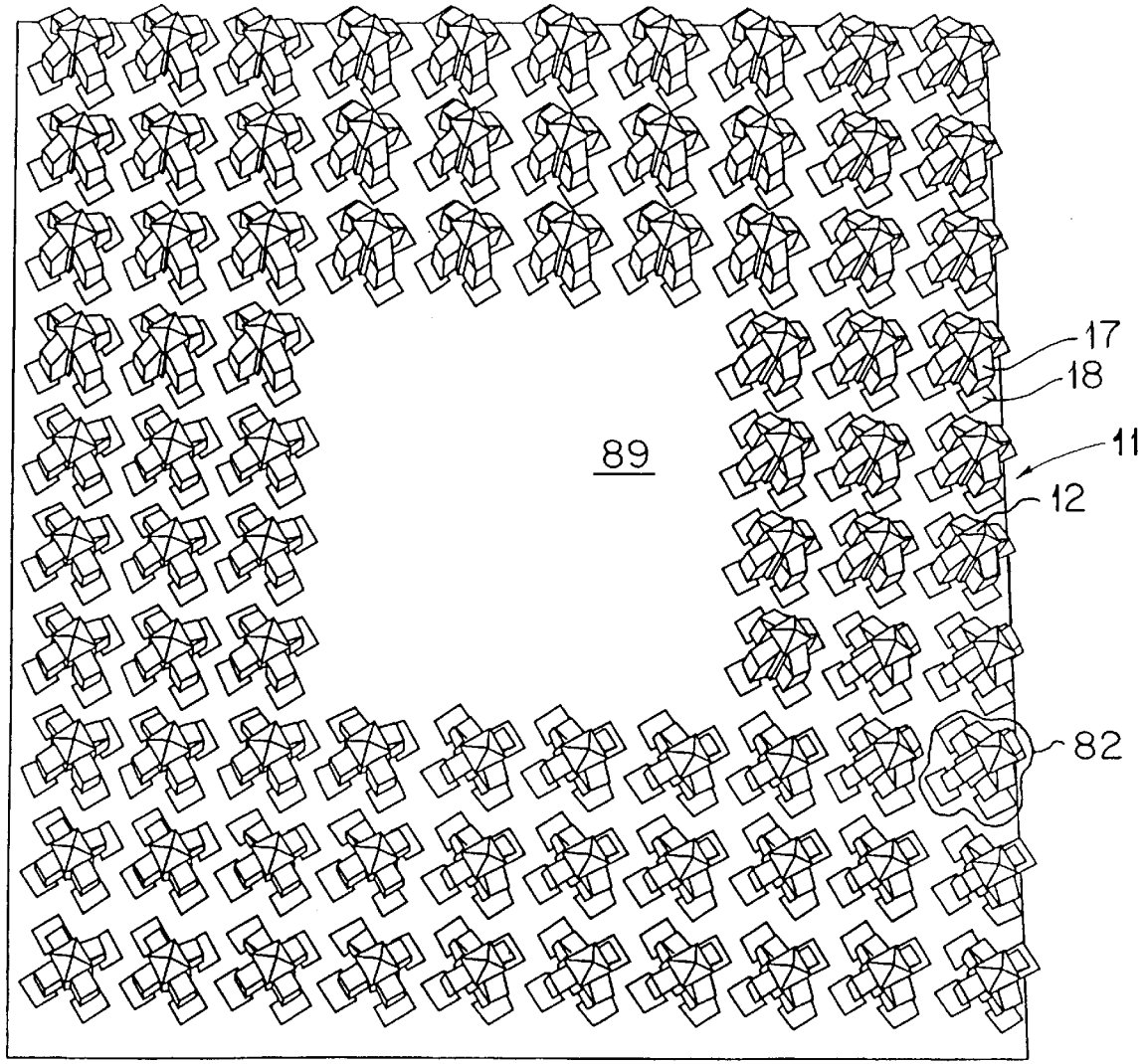
FIG. 42 is a view of an arrangement of electrical interconnect components in accordance with the modified arrangement of FIG. 35 modified to include a space at a center portion thereof.

FIG. 42 is another view of the arrangement depicted in FIG. 41(*b*), showing posts 11 each having a contact portion 17 that is offset with respect to a corresponding stabilizing portion 18 in the manner of the offset post depicted in FIG. 7. FIG. 42, like FIGS. 41(*a*) and 41(*b*), illustrates that each arrangement in accordance with the present invention can be modified to include a space 89 at a central portion thereof. For the arrangements of FIGS. 41(*a*), 41(*b*), and 42, the depicted electrical interconnect components 82 are projection-type interconnect components each including a buttress 12. However, in accordance with the present invention, such components could be buttress-free projection-type interconnect components or receiving-type or hybrid interconnect components.

Figure 43:
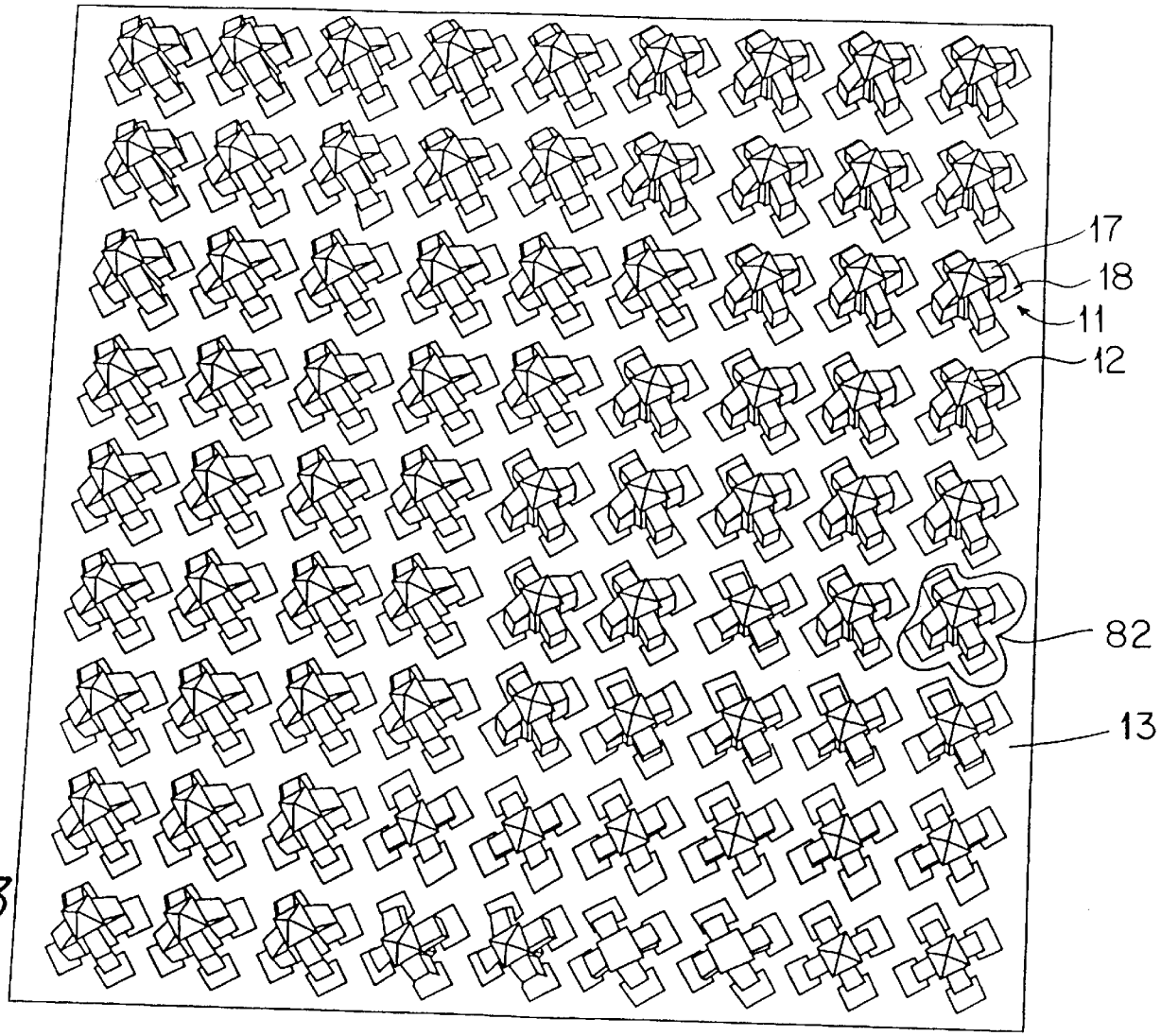
FIG. 43 is a view of an arrangement of electrical interconnect components in accordance with the modified arrangement of FIG. 35.
Figure 44:
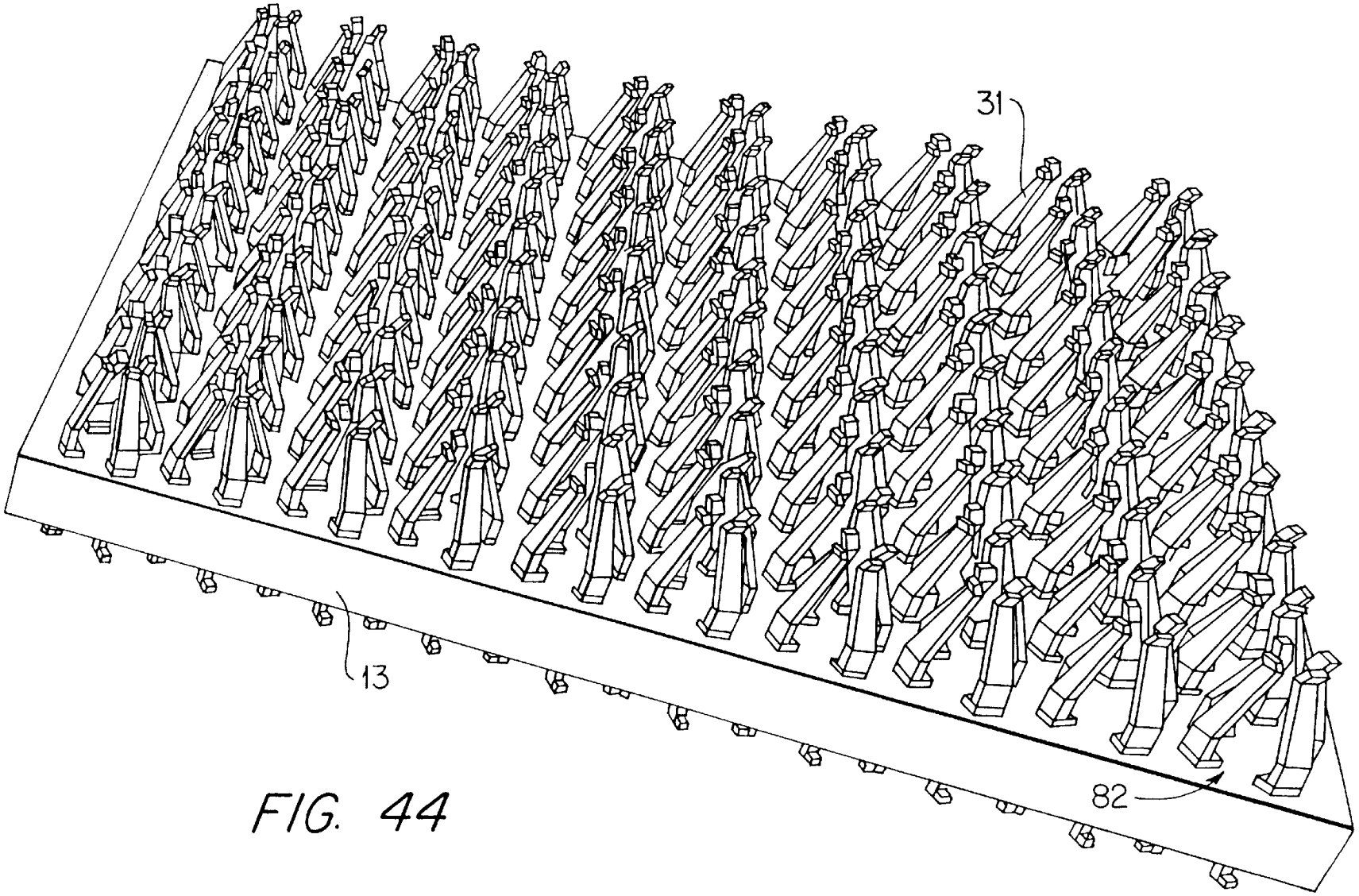
FIG. 44 is a view of a modified arrangement of receiving-type electrical interconnect components in accordance with the present invention.
Figure 45:
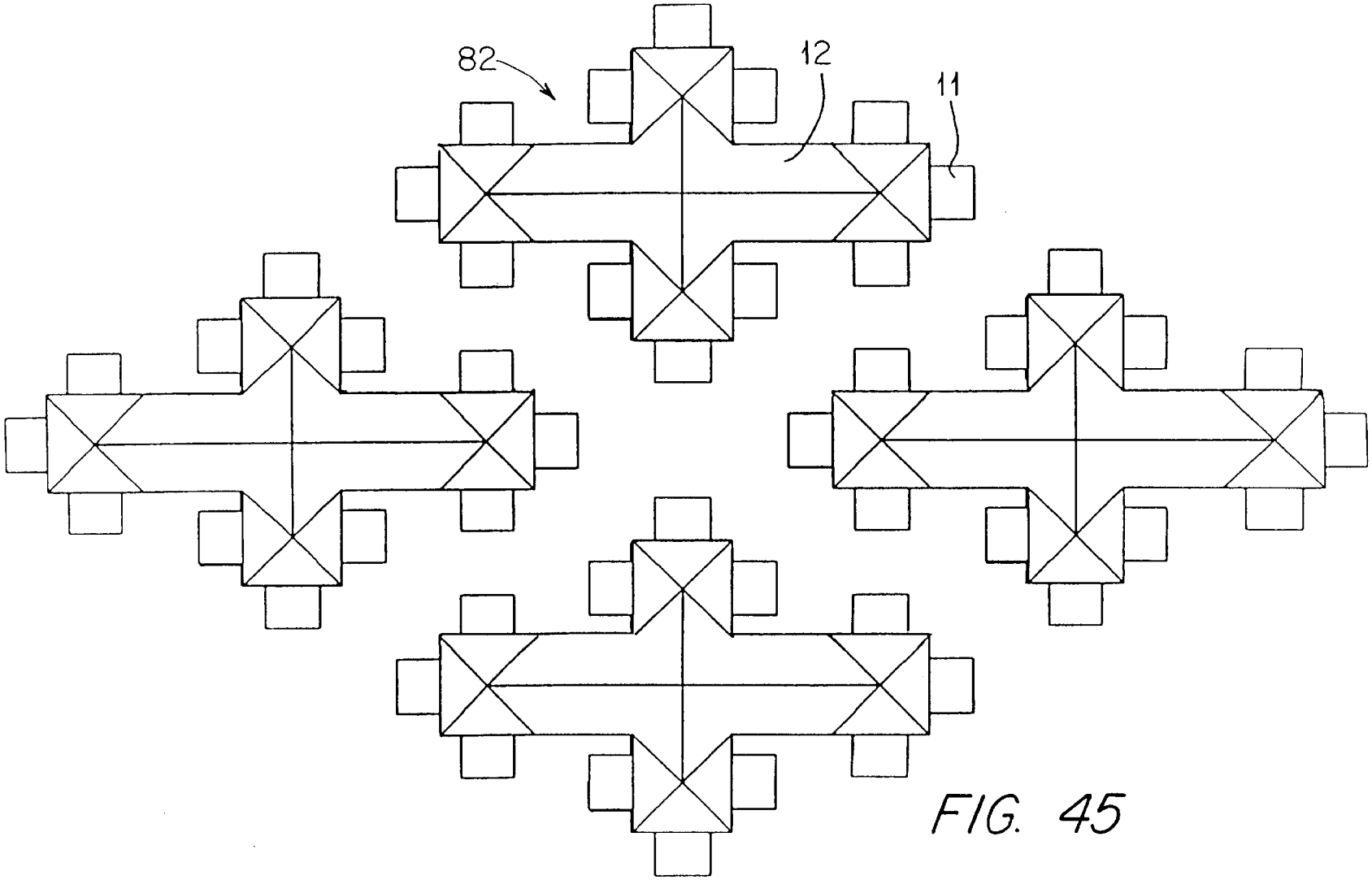
FIG. 45 is a top view of a nested arrangement of projection-type electrical interconnect components in accordance with the illustration in FIG. 12(*a*).
Figure 46:
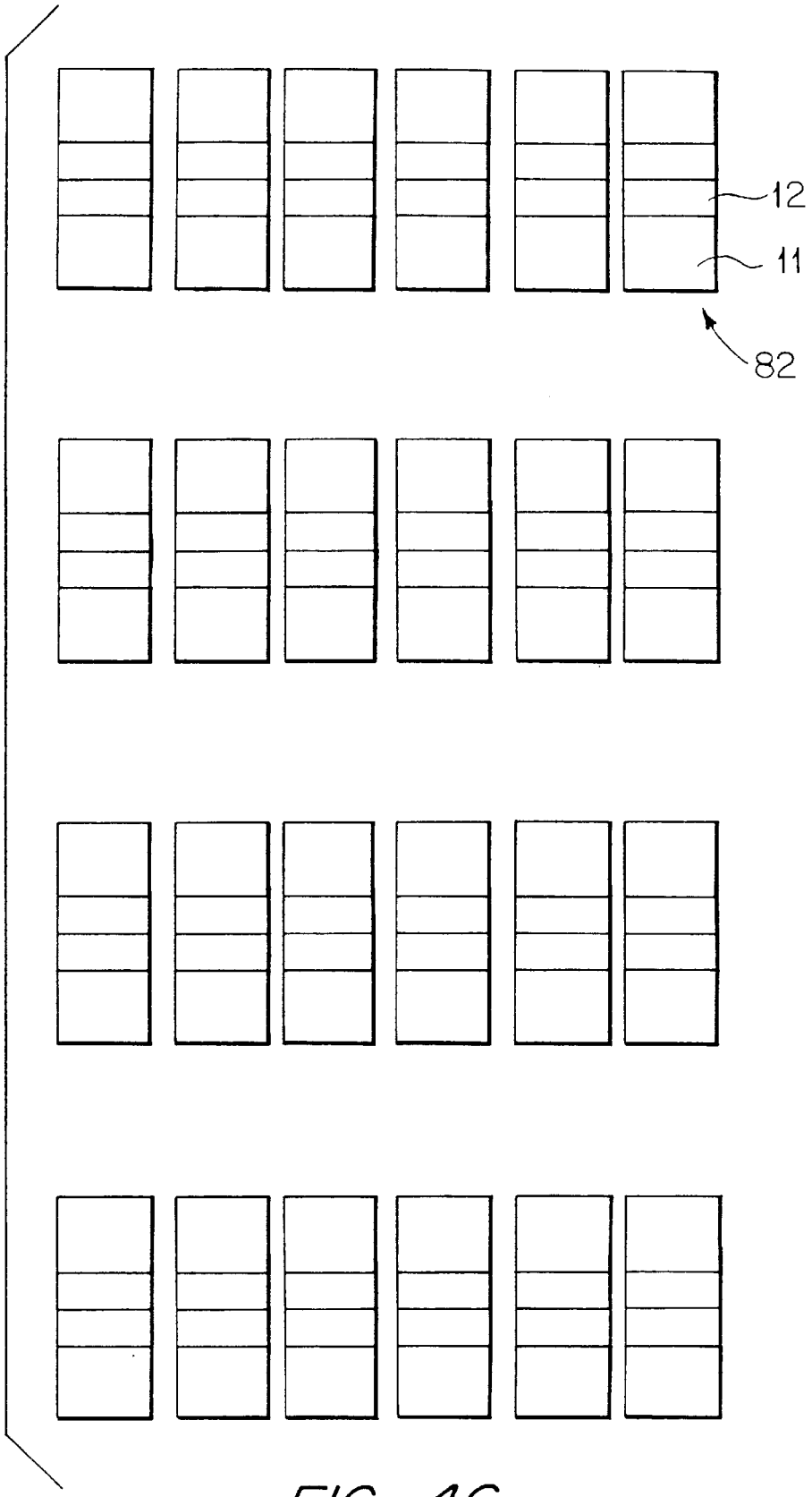
FIG. 46 is a top view of an arrangement of projection-type electrical interconnect components in accordance with the illustration in FIG. 13(*a*).
Figure 47:
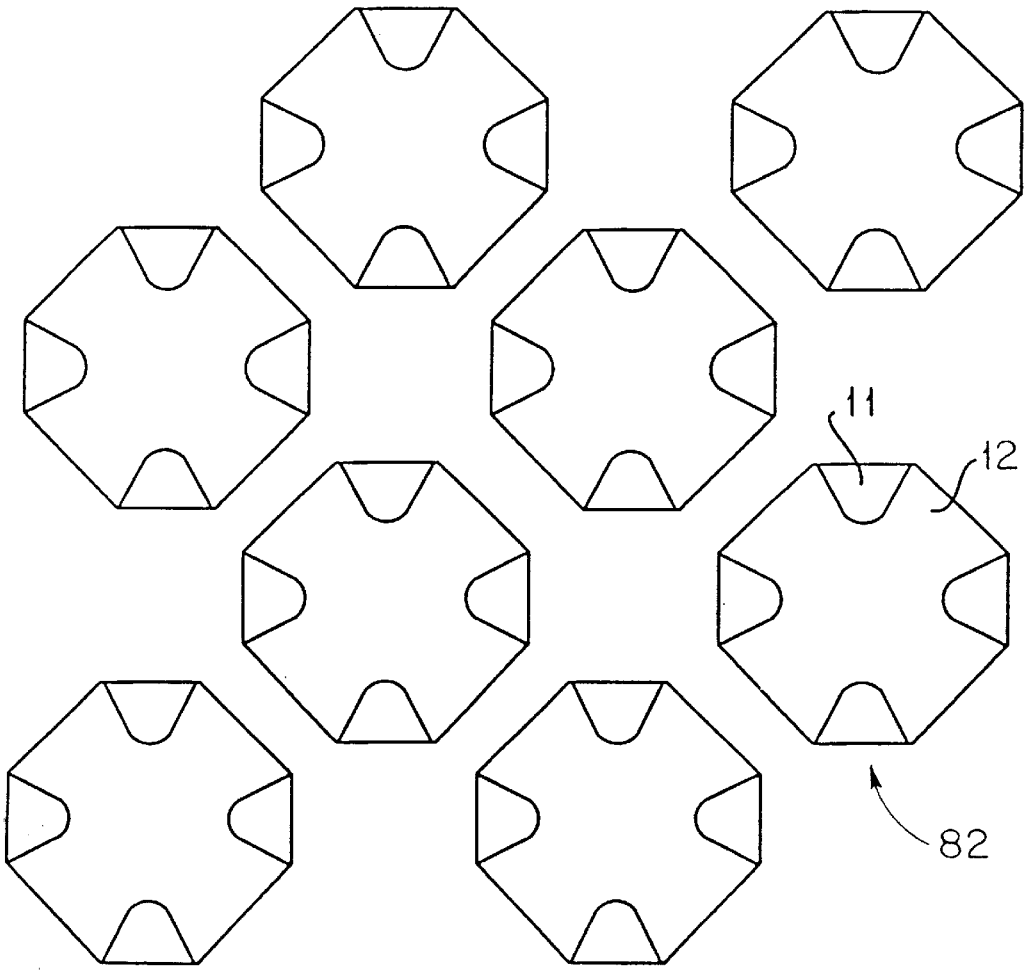
FIG. 47 is a top view of a nested arrangement of projection-type electrical interconnect components in accordance with the configuration illustrated in FIG. 13(*c*).
Figure 48A:
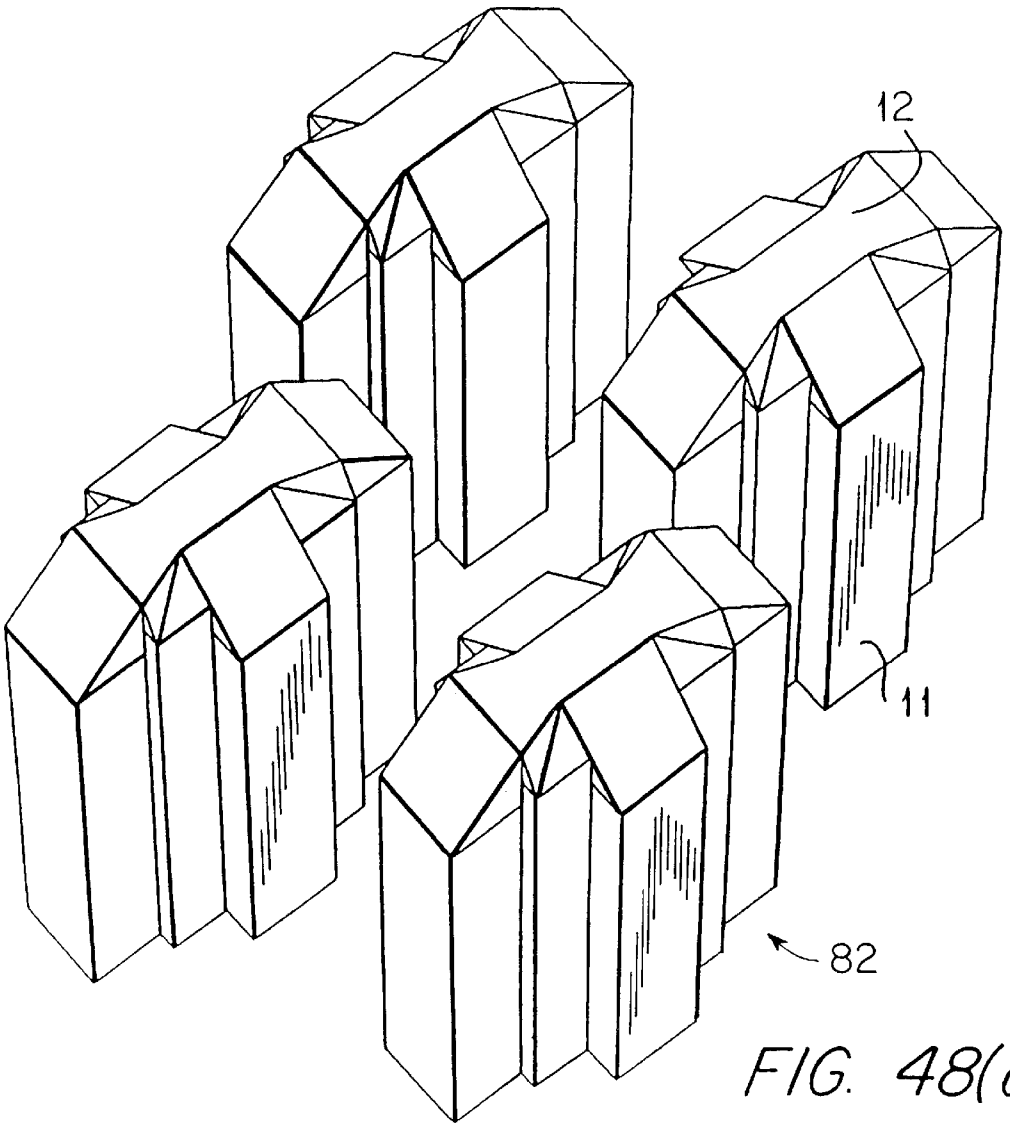
FIG. 48(*a*) is a perspective view of an arrangement of projection-type electrical interconnect components in accordance with the configuration illustrated in FIG. 12(*b*).
Figure 48B:
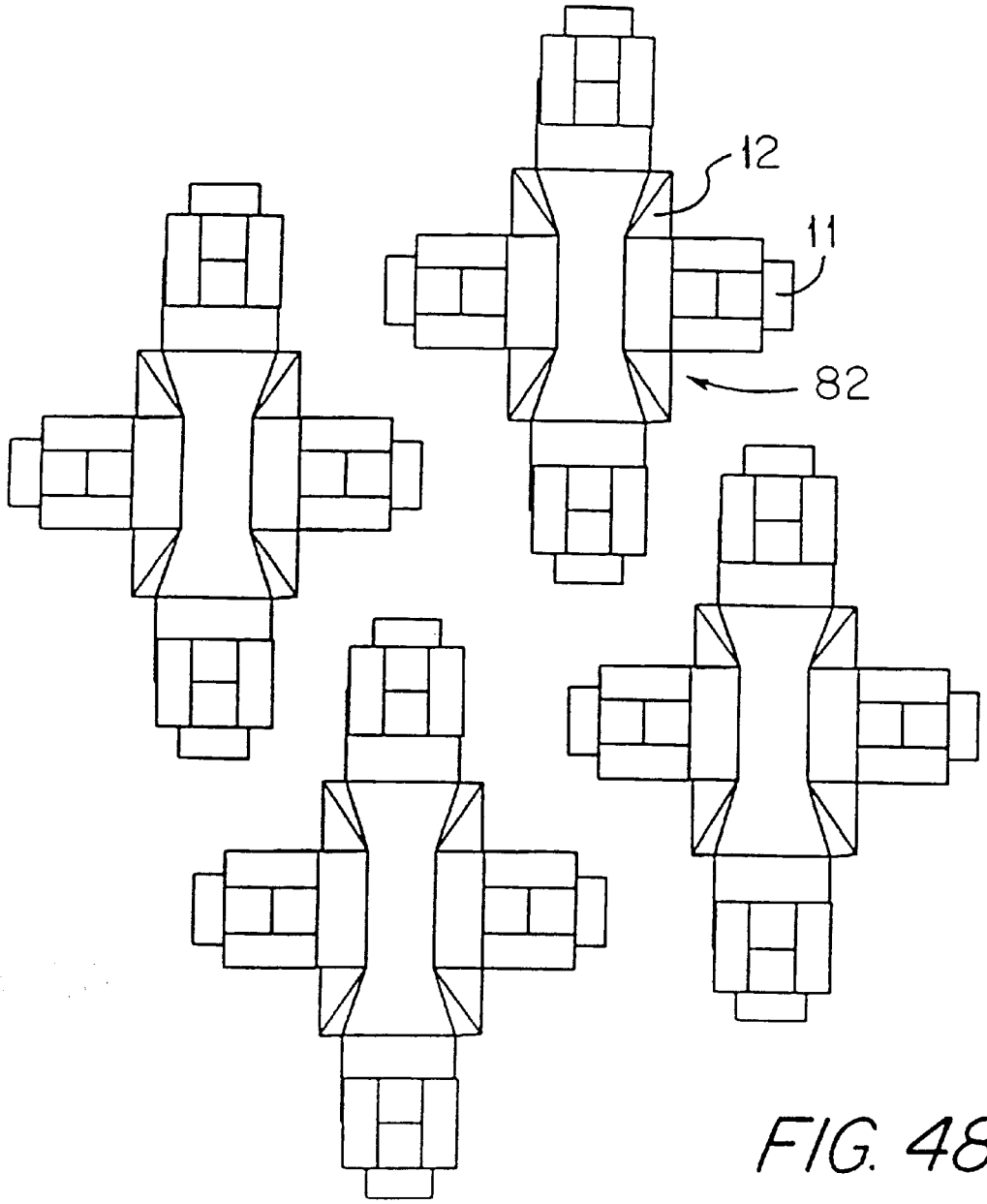
Figure 48C:
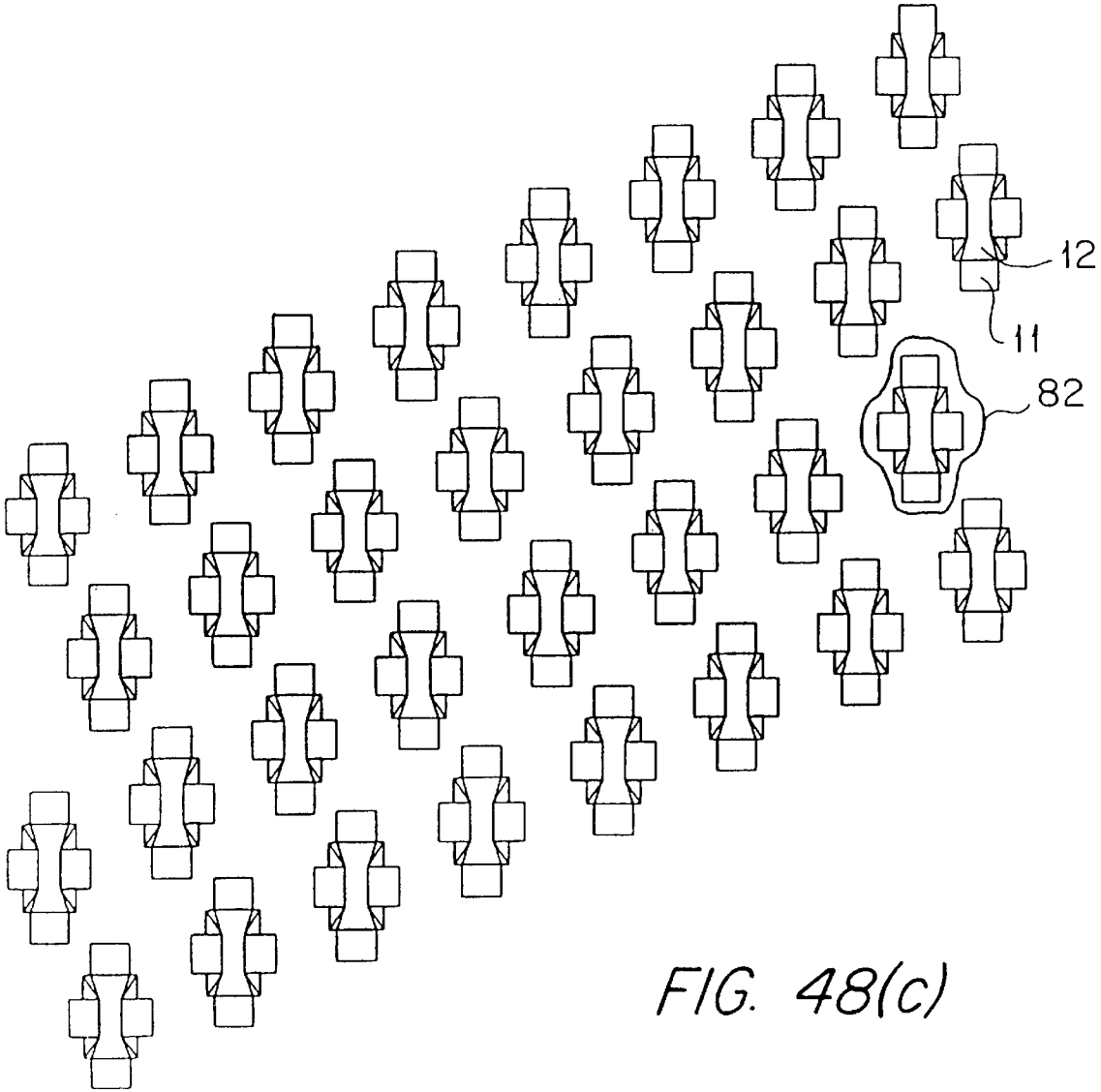
Figure 48D:
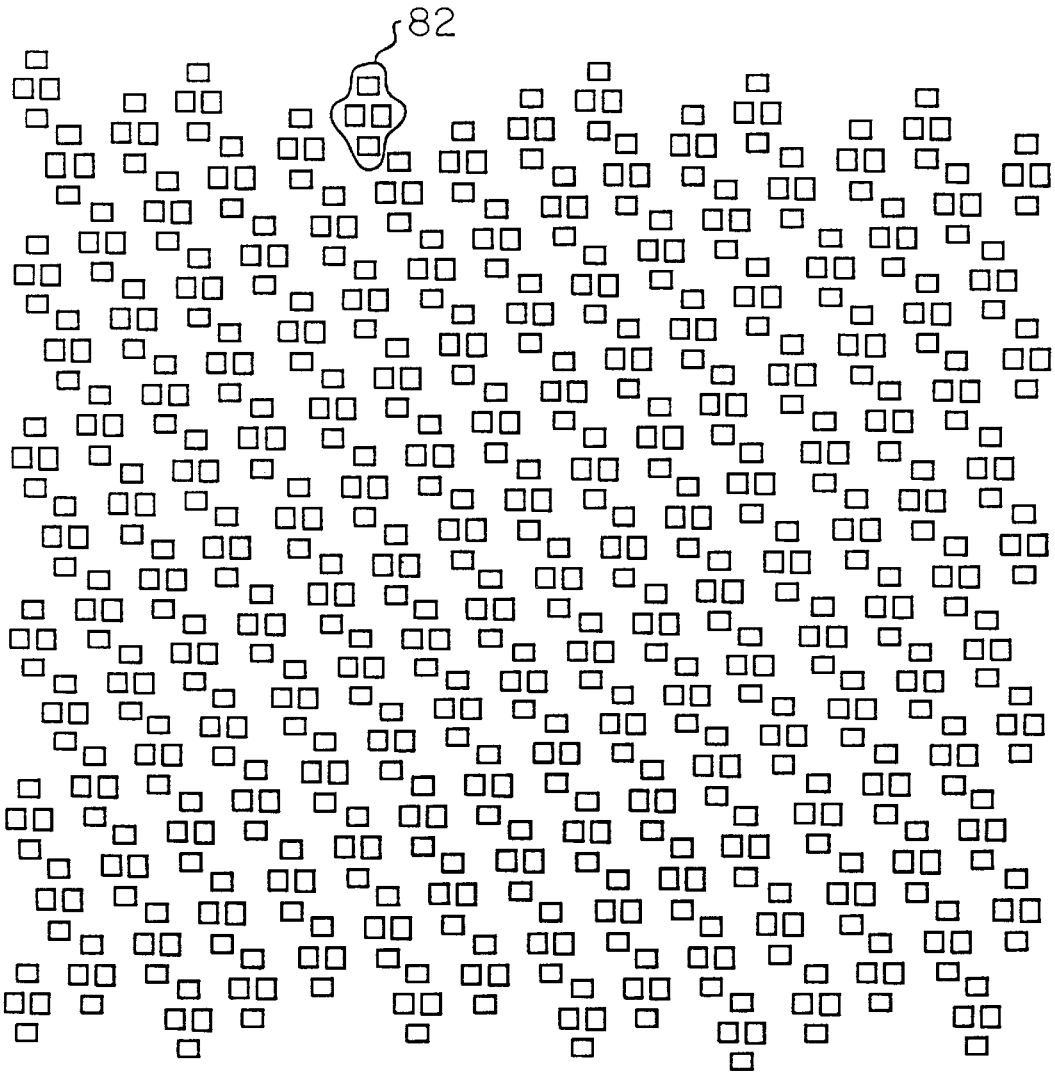

FIGS. 43 through 47 illustrate various aspects relating to arrangements in accordance with the present invention. FIG. 43, for example, shows a continuous arrangement of projection-type electrical interconnect components 82, with each post 11 having a contact portion 17 that is offset with respect to a corresponding stabilizing portion 18 in the manner of the post depicted in FIG. 7. FIG. 44 illustrates that the electrical interconnect components 82 may be receiving-type electrical interconnect components from a socket that may be mounted to a PCB or other interface surface using the SMT methodology; this allows an arrangement of projection-type interconnect components to be plugged into the socket from above. FIG. 45 illustrates that electrical interconnect components 82 of a nested arrangement may be configured like the projection-type electrical interconnect components shown in FIG. 12(*a*). FIG. 46 shows an 837-contact per square inch arrangement for electrical interconnect components 82 such as the projection-type electrical interconnect component illustrated in FIG. 12(*b*) each including two contacts or posts 11 and, optionally, a four-sided insulative buttress 12. FIG. 47 depicts an arrangement for electrical interconnect components 82 such as the projection-type electrical interconnect component partially depicted in FIG. 13(*c*).

FIG. 48, which incorporates FIGS. 48(*a*) through 48(*d*), depicts arrangements for electrical interconnect components 82 such as the H-shaped electrical interconnect components shown in FIG. 12(*b*). Dimensions for the arrangements of H-shaped interconnect components are shown in FIGS. 48(*c*) and 48(*d*). The arrangement of FIG. 48(*c*) can provide a density of 716 contacts per square inch. The arrangement of FIG. 48(*d*), on the other hand, can provide a density of 636 contacts per square inch.

Conductive posts 11 or conductive beams 31, discussed previously, may be used in the above arrangements. The separate contact, stabilizing, and foot portions of the conductive posts and beams operate to maximize the effectiveness of the interconnect arrangements. For example, as shown in FIG. 7, the contact portion 17 of each conductive post 11 may be offset in the direction of the interior of the projection-type interconnect component for that post. By offsetting the contact portion in this fashion, a smaller buttress may be used, or the buttress may be eliminated entirely. Accordingly, the density of the electrical interconnect arrangements discussed above, for example, will be increased using an offset post such as shown in FIG. 7.

Figure 49:
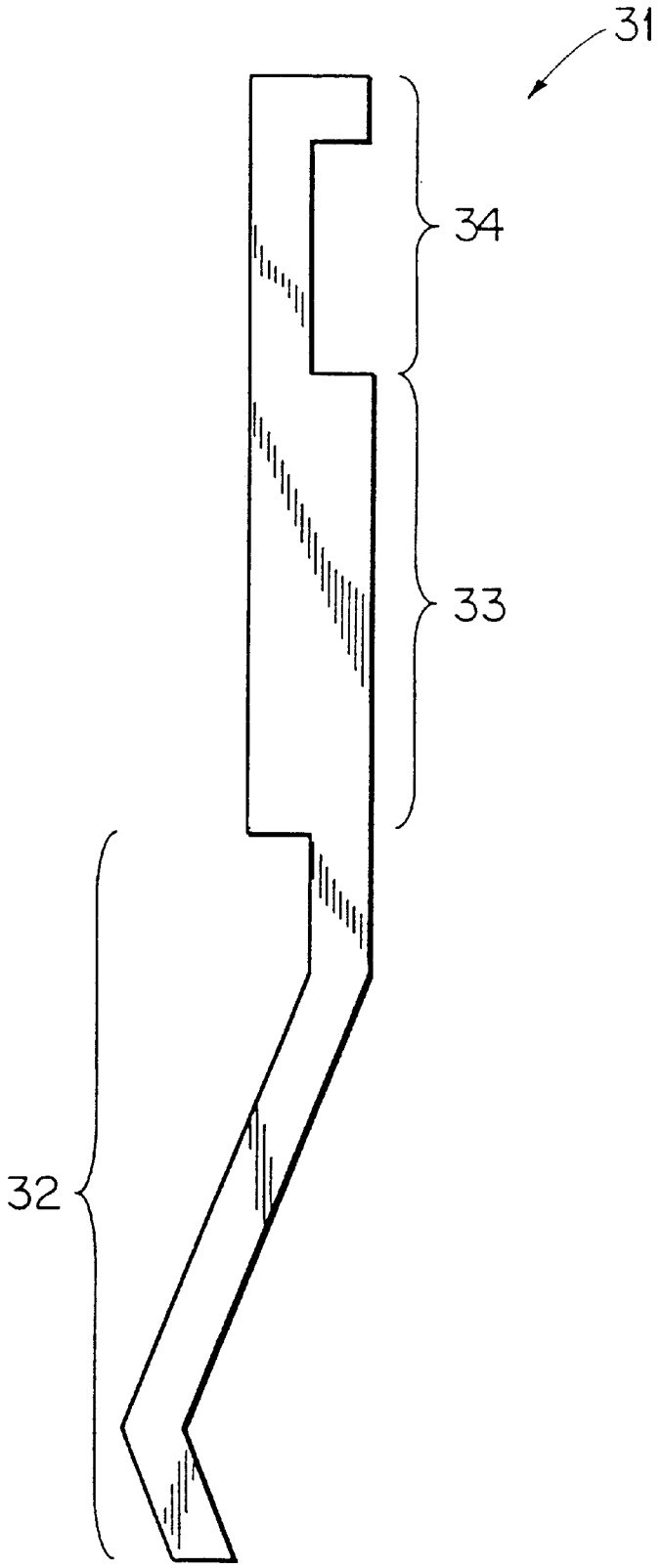
FIG. 49 is a side view of a conductive beam having an offset contact portion.

When an offset type post (e.g., as in FIG. 7) is used, the contact portion of the corresponding conductive beam may also be offset. However, as shown in FIG. 49, the contact portion 32 of the conductive beam 31 is generally offset away from the buttress to decrease the amount of stress exerted on the conductive beam and to minimize space used. Through use of the offset post 11 of FIG. 7 in connection with the offset beam 31 of FIG. 49, higher electrical interconnect densities may be achieved.

Figure 50A:
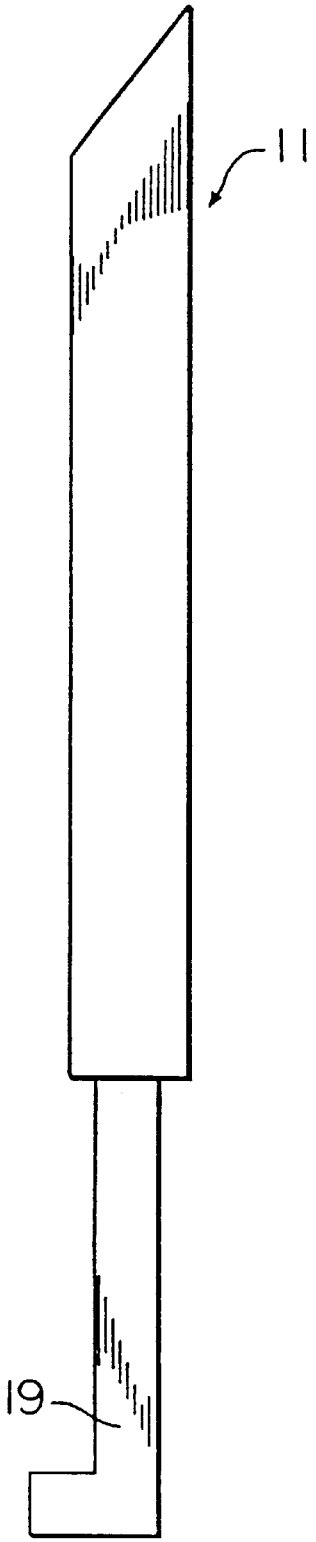
FIG. 50(*a*) is a side view of a conductive post having aligned stabilizing and foot portions.
Figure 50B:
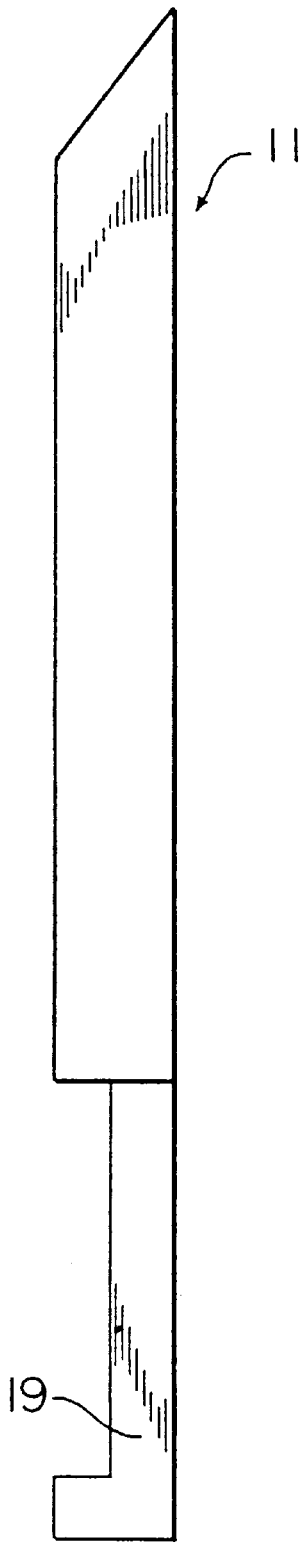

Like the contact portion, the foot portion of a conductive post 11 or conductive beam 31 may be aligned with or offset from its corresponding stabilizing portion. FIG. 50(*a*) shows a conductive post 11 having a foot portion 19 aligned about the central axis of the stabilizing portion, while FIG. 50(*b*) shows a conductive post 11 having a foot portion 19 offset from its stabilizing portion. The alignment and offset shown in FIGS. 50(*a*) and 50(*b*), respectively, are equally applicable to each conductive beam 31.

The configuration of FIG. 50(*a*) might be used for north and south contacts when the substrate 13 is arranged perpendicularly with respect to the device with which the foot portion 19 is interfacing. The configuration of FIG. 50(*b*), on the other hand, may be used when a straight or right-angle interconnect is being made between a foot portion and the interface device, and there is little room on the interface device for making a connection to the foot. It should be noted that the foot portion of a post may be aligned or offset with its corresponding stabilizing portion to fit within a foot interface pattern normally associated with a beam, or the foot portion of a beam may be aligned or offset with its corresponding stabilizing portion to fit within a foot interface pattern normally associated with a post. This also allows for freedom in trace routing. Other advantages result from the use of a post 11 and/or beam 31 including separate contact, stabilizing, and foot portions, and configurations of such portions other than those discussed above are contemplated. For example, the contact portion of a post or beam may be the same size as the stabilizing portion of that post or beam as in FIG. 8 for ease of manufacturing, or the contact portion may be smaller (i.e., narrower) than the stabilizing portion as in FIG. 6 to increase the density of the interconnect system.

In the situation where the contact portion is made narrower than its corresponding stabilizing portion, the hole or passage in which the post or beam is secured may be configured to have a different width or diameter at different levels. For example, the width or diameter near the portion of the hole through which the contact portion protrudes may be narrower than the width or diameter at the other side of the substrate through which the foot portion protrudes. In this type of configuration, the post or beam is inserted into the hole with the contact portion entering first, and then pushed further into the hole until the shoulder of the stabilizing portion abuts the section of the hole having the narrower width or diameter. By configuring the hole in this manner, over-insertion (i.e., insertion of the post or beam to the extent that the stabilizing portion extends through the hole), as well as push-out due to high mating forces, may be prevented.

Like the contact portion, the foot portion of each post or beam may be the same size as the stabilizing portion of that post or beam, or the foot portion may be smaller (i.e., narrower) than the stabilizing portion to interface with high-density interface devices and/or provide circuit design and routing flexibility. In the situation where the foot portion is made narrower than its corresponding stabilizing portion, the hole or passage in which the post or beam is secured may be configured to have a different width or diameter at different levels. For example, the width or diameter near the portion of the hole through which the foot portion protrudes may be narrower than the width or diameter at the other side of the substrate through which the contact portion protrudes. In this type of configuration, the post or beam is inserted into the hole with the foot portion entering first, and then pushed further into the hole until the shoulder of the stabilizing portion abuts the section of the hole having the narrower width or diameter. By configuring the hole in this manner, over-insertion (i.e., insertion of the post or beam to the extent that the stabilizing portion extends through the hole), as well as push-out due to high mating forces, may be prevented.

It should be noted that when the contact portion of a post or beam is offset from the stabilizing portion (for example, as shown in FIG. 7), the post or beam must be inserted into the corresponding hole with the foot portion entering first. Similarly, when the foot portion of a post or beam is offset from the stabilizing portion, the post or beam must be inserted into the corresponding hole with the contact portion entering first.

The foot portion of each post or beam may be arranged in many different configurations. For example, the foot portion may have its central axis aligned with the central axis of the stabilizing portion, as in FIG. 50(*a*). Alternatively, the foot portion may be offset from the stabilizing portion so that a side of the foot portion is coplanar with a side of the stabilizing portion, as shown in FIG. 50(*b*).

Also, the foot portion of each post or beam may be attached to different portions of the stabilizing portion. For example, the foot portion may be attached to the middle, corner, or side of a stabilizing portion to allow trace routing and circuit design flexibility, and increased interface device density.

Further variations of the foot portion of each post or beam are contemplated. Within a given projection-type or receiving-type interconnect component, the foot portions of that component can be configured to face toward or away from one another, or certain foot portions may face toward one another while other ones of the foot portions face away from one another. Likewise, the foot portions of a given interconnect component may be arranged so that each foot portion faces the foot portion to its immediate left, or so that each foot portion faces the foot portion to its immediate right.

Also, a secondary molding operation could be used to bind the foot portions of one or more interconnect components together. In this type of configuration, an insulative yoke or substrate could be formed around the foot portions just above the point at which the foot portions connect to the interface device to hold the foot portions in place, to aid in alignment, and to protect the foot portions during shipping.

Additionally, portions of the foot portions of the posts and/or beams may be selectively covered with insulative material to prevent shorting and to allow closer placement of the foot portions with respect to one another (e.g., the placement of the foot portions up against one another). This type of selective insulating is especially applicable to right-angle connections such as shown in FIG. 11(*a*). With reference to FIG. 11(*b*), such selective insulation of the foot portions can be used to allow closer placement of all of the foot portions within each component to one another. Alternatively, such selective insulation can be used to allow closer placement of only the foot portions within each component that share the same row (e.g., rows C, D, and E of FIG. 11(*b*)) to one another. Although the selective insulation of the foot portions helps to prevent shorting when these types of closer placements are made, such closer placements may be made in the absence of the selective insulation.

As can be seen from the foregoing description, the use of posts and beams which include separate contact, stabilizing, and foot portions formed from a single piece maximizes the efficiency and effectiveness of the interconnect arrangement of the present invention. Further, the selective structure of the conductive posts and beams allows flexibility in circuit design and signal routing not possible through the use of existing interconnect systems.

MANUFACTURING

The conductive posts and conductive beams of the electrical interconnect components may be stamped from strips or from drawn wire, and are designed to ensure that the contact and interface portions face in the proper direction in accordance with the description of the posts and beams above. Both methods allow for selective plating and automated insertion. The foot portions in the right-angle embodiments protrude from the center of the stabilizing section, thereby allowing one pin die with different tail lengths to supply contacts for all sides and levels of the electrical interconnect system of the present invention. However, for maximum density, the foot portions may be moved away from the center of the stabilizing portion to allow maximum density while avoiding interference between adjacent foot portions.

The stamped contacts can be either loose or on a strip since the asymmetrical shape lends itself to consistent orientation in automated assembly equipment. Strips can either be between stabilizing areas, at the tips, or as part of a bandolier which retains individual contacts. The different length tails on the right-angle versions assist with orientation and vibratory bowl feeding during automated assembly.

The present invention is compatible with both stitching and gang insertion assembly equipment. The insulative connector bodies and packaging have been designed to facilitate automatic and robotic insertion onto printed circuit boards or in termination of wire to connector. As an alternative to forming an insulative substrate and then inserting the contacts into the substrate, the insulative substrate may be formed around the contacts in an insert molding process. The completed parts are compatible with PCB assembly processes.

CONCLUSION

The present invention provides an electrical interconnect system that is higher in density, faster, less costly, and more efficient than existing high-density electrical interconnect systems. Accordingly, the present invention is capable of keeping pace with the rapid advances that are currently taking place in the semiconductor and computer technologies.

It will be apparent to those skilled in the art that various modifications and variations can be made in the disclosed electrical interconnect system without departing from the scope or spirit of the invention. Other embodiments of the invention will be apparent to those skilled in the art from consideration of the specification and practice of the invention disclosed herein It is intended that the specification and examples be considered as exemplary only, with a true scope and spirit of the invention being indicated by the following claims.

What is claimed is:

1. An electrical interconnect component comprising:

a support element;

an array of groups of multiple electrically conductive contacts held by said support element, each group including at least three electrically conductive contacts, wherein each of the electrically conductive contacts comprises a contact portion and a tail portion opposite the contact portion;

a plurality of buttresses, wherein each group of electrically conductive contacts corresponds to one of said plurality of buttresses, the electrically conductive contacts of each group being arranged circumferentially around its corresponding buttress; and wherein said contact portion of each electrically conductive contact is adapted to contact a corresponding electrically conductive contact and wherein said tail portion of each electrically conductive contact comprises a blade having a forked end, said forked end adapted to receive and provide electrical contact to a wire, and wherein the blades of the electrically conductive contacts within each group are in planes parallel to each other.

2. The electrical interconnect component of claim 1, wherein said forked end of said blade comprises two projections.

3. The electrical interconnect component of claim 2, wherein said projections are separated by a slot.

4. The electrical interconnect component of claim 3, wherein said slot comprises elongated channel portion and a wire receiving portion.

5. The electrical interconnect component of claim 4, wherein said wire receiving portion comprises a semicircular recess.

6. An electrical interconnect component comprising:

a support element;

an array of groups of multiple receiving-type electrically conductive contacts held by said support element, each group including at least three receiving-type electrically conductive contacts, and each of the receiving-type electrically conductive contacts comprising a contact portion and tail portion, wherein the receiving-type electrically conductive contacts of each group of contacts are circumferentially arranged such that a projection-type interconnect component may be received therein; and wherein said contact portion of each receiving-type electrically conductive contact is adapted to contact a corresponding electrically conductive contact of the projection-type interconnect component and wherein said tail portion of each receiving-type electrically conductive contact comprises a blade having a forked end, said forked end adapted to receive and provide electrical contact to a wire, and wherein the blades of the receiving-type electrically conductive contacts within each group are in planes parallel to each other.

7. The electrical interconnect component of claim 6, wherein said forked end of said blade comprises two projections.

8. The electrical interconnect component of claim 7, wherein said projections are separated by a slot.

9. The electrical interconnect component of claim 8, wherein said slot comprises elongated channel portion and a wire receiving portion.

10. The electrical interconnect component of claim 9, wherein said wire receiving portion comprises a semicircular recess.

11. An electrical interconnect system comprising:

a first support element;

a first array of groups of multiple electrically conductive contacts held by said first support element, each group in said first array including at least three electrically conductive contacts, and each of the electrically conductive contacts of said first array comprising a contact portion and tail portion;

a plurality of buttresses, wherein each group of electrically conductive contacts of said first array corresponds to one of said plurality of buttresses, the electrically conductive contacts of each group being arranged circumferentially around its corresponding buttress;

a second support element;

a second array of groups of multiple electrically conductive contacts held by said second support element, each group in said first array including at least three electrically conductive contacts, and each of the electrically conductive contacts of said second array comprising a contact portion and tail portion, wherein each group of the electrically conductive contacts of said second array are circumferentially arranged so as to receive a buttress and a plurality of electrically conductive contacts of said first array therein; and wherein said contact end of each electrically conductive contact of said first array is adapted to contact a corresponding contact end of each said electrically conductive contact of said second array and wherein said tail end of each electrically conductive contact of at least one of said first and second arrays comprises a blade having a forked end, said forked end adapted to receive and provide electrical contact to a wire, and wherein the blades within each group are in planes parallel to each other.

12. The electrical interconnect system of claim 11, wherein the electrically conductive contacts of said second array further comprise a receiving-type electrically conductive contact.

13. The electrical interconnect system of claim 11, wherein said tail end of each electrically conductive contact of both said first and second arrays are comprise a blade having a forked end, said forked end adapted to receive and provide electrical contact to a wire.

14. The electrical interconnect system of claim 11, wherein said forked end of said blade comprises two projections.

15. The electrical interconnect system of claim 14, wherein said projections are separated by a slot.

16. The electrical interconnect system of claim 15, wherein said slot comprises elongated channel portion and a wire receiving portion.

17. The electrical interconnect system of claim 16, wherein said wire receiving portion comprises a semicircular recess.

* * * * *